United States Patent [19]

Pasemann

[11] 3,937,934

[45] Feb. 10, 1976

[54] SYSTEM AND METHOD FOR OPERATING A STEAM TURBINE WITH DIGITAL CONTROL HAVING VALIDITY CHECKED DATA LINK WITH HIGHER LEVEL DIGITAL CONTROL

[75] Inventor: Klaus Pasemann, Martin, Pa.

[73] Assignee: Westinghouse Electric Corporation, Pittsburgh, Pa.

[22] Filed: Dec. 21, 1973

[21] Appl. No.: 427,281

Related U.S. Application Data

[63] Continuation of Ser. No. 247,884, April 26, 1972, abandoned.

[52] U.S. Cl...... 235/151.21; 444/1; 290/40 R; 415/17

[51] Int. Cl... F01d 17/02; G05b 15/00; G06f 15/06

[58] Field of Search..... 235/151.21, 151.34, 151.3, 235/151; 415/17, 15, 13, 1; 60/73, 105, 39.28 R; 290/40; 340/172.5; 444/1

[56] References Cited

UNITED STATES PATENTS

| | | | |
|---|---|---|---|
| 3,552,872 | 1/1971 | Giras et al. | 415/17 |
| 3,555,251 | 1/1971 | Shavit | 235/151 |
| 3,561,216 | 2/1971 | Moore, Jr. | 60/73 |
| 3,564,273 | 2/1971 | Cockrell | 415/17 X |
| 3,588,265 | 6/1971 | Berry | 415/17 X |

OTHER PUBLICATIONS

Application of the Prodac 50 System to Direct Digital Control, J. C. Belz, G. J. Kirk, P. S. Radcliffe, IEEE Intl. Conv. Rec. Part 3, 1965, pp. 102–122.

Monitoring and Automatic Control in Steam Power Stations by Process Computer, E. Doetsch & G. Hirschberg, Siemens Review XXXV (1968), No. 12, pp. 471–476.

*Primary Examiner*—Felix D. Gruber
*Assistant Examiner*—Edward J. Wise
*Attorney, Agent, or Firm*—E. F. Possessky

[57] ABSTRACT

A digital computer control system is provided for operating a steam turbine in an electric power plant. The computer develops steam valve position signals to control turbine speed and load. Various turbine temperature, pressure and other process parameter signals are coupled to the computer which stores the parameter values along with other parameters such as control loop setpoints in its memory. Another computer at the plant level or at the system dispatch level is coupled to the turbine computer through a data link which includes data link programs in each computer and data transmitter and receiver circuitry connected to the two computers. The higher level computer is the controlling computer on the data link. Control words are used to identify data transmission modes and validity checks are made on transmitted words. Turbine computer core data is accessible and transmittable to either higher level computer. Load demand and load rate are transmitted to the turbine computer from the dispatch computer, and the plant computer transmits setpoints to provide turbine control from the plant level. To check validity, a checksum quantity is generated with respect to predetermined data words at the transmission and receiver ends of the data link. The receiver compares the checksum quantities to validate linked data before such data is permitted to be used for turbine control or other purposes.

4 Claims, 29 Drawing Figures

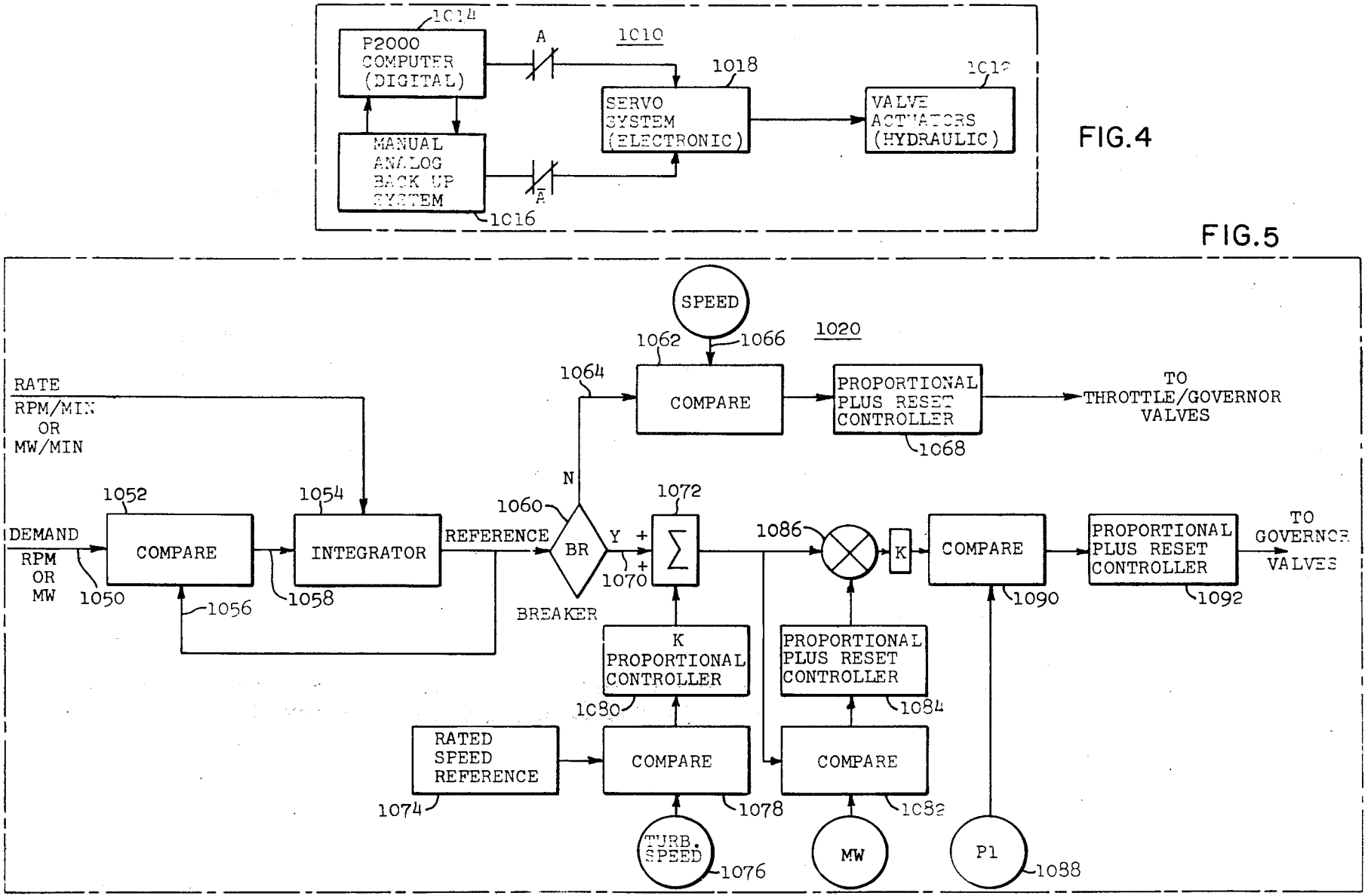
FIG.4
FIG.5
1010
1014
P2000 COMPUTER (DIGITAL)
MANUAL ANALOG BACK UP SYSTEM
1016
A
A
1018
SERVO SYSTEM (ELECTRONIC)
VALVE ACTUATORS (HYDRAULIC)
1020
SPEED
1066
1062
COMPARE
1064
PROPORTIONAL PLUS RESET CONTROLLER
1068
TO THROTTLE/GOVERNOR VALVES
N
BR
Y
1060
1070
1072
REFERENCE
BREAKER
1052
COMPARE
1050
1056
1054
INTEGRATOR
1058
RATE
RPM/MIN OR MW/MIN
DEMAND
RPM OR MW
1086
K
COMPARE
1090
PROPORTIONAL PLUS RESET CONTROLLER
1092
TO GOVERNOR VALVES
P1
1088
PROPORTIONAL PLUS RESET CONTROLLER
1084
COMPARE
1082
MW
K PROPORTIONAL CONTROLLER
1080
COMPARE
1078
TURB. SPEED
1076
RATED SPEED REFERENCE
1074

1012

SYSTEM AND METHOD FOR OPERATING A STEAM TURBINE WITH DIGITAL CONTROL HAVING VALIDITY CHECKED DATA LINK WITH HIGHER LEVEL DIGITAL CONTROL

CROSS-REFERENCE TO RELATED APPLICATIONS

This is a continuation of application Ser. No. 247,884 filed Apr. 26, 1972, now abandoned.

1. Ser. No. 722,779, entitled "Improved System and Method for Operating a Steam Turbine and an Electric Power Generating Plant" filed by Theodore C. Giras and Manfred Birnbaum on Apr. 4, 1968, assigned to the present assignee, and continued as Ser. No. 124,993 on Mar. 16, 1971, and Ser. No. 319,115, on Dec. 29, 1972.

2. Ser. No. 408,962, entitled "System and Method for Starting, Synchronizing and Operating a Steam Turbine with Digital Computer Control" filed as a continuation of Ser. No. 247,877 which had been filed by Theodore C. Giras and Robert Uram on Apr. 26, 1972, assigned to the present assignee and hereby incorporated by reference; other related cases are set forth in Ser. No. 408,962.

BACKGROUND OF THE INVENTION

The present invention relates to electric power generation and more particularly to remote control and monitoring of turbine-generators used in generating electric power.

In the generation of electric power, one or more turbine-generators may be located at a single generation plant and the total power generated by a power system is the sum of the process generated by the plants in the system. To match load demand and generated load and hold system frequency, and to provide for power exchange with other power systems, centralized power system supervision and/or control is required. At the plant level, plant centralized supervision and/or control is similarly needed for coordination of a steam generator and its turbine-generator and possibly for coordination of multiple generation units where multiple units are provided at a plant site.

To implement centralized control and/or supervision where digital controls and monitors are provided at the turbine level and at the higher control level, it is desirable to employ a digital data link. A related and coassigned patent application Ser. No. 390,471 is directed to the application of data link technology to the operation of steam turbines in the generation of electric power. The present invention is directed to the implementation of data validation techniques in such a digital turbine data linked controller.

The description of prior art herein is made on good faith and no representation is made that any prior art considered is the best pertaining prior art nor that the interpretation placed on it is unrebuttable.

SUMMARY OF THE INVENTION

A digital controller operates inlet valves for a steam turbine, and it is linked with one or more remote digital controllers through either or both a digital data link and a load dispatch link. Means are preferably provided for transmitting setpoint change data from the remote controller to the turbine controller. Preferably, the remote controller has supervisory data link control, and the local controller has means for disabling the controller linkage and placing the local controller under load control. Means are provided as a part of the data link transmitting and receiving means to transmitter and receiver end generated checks related in a predetermined way to a predetermined group of transmitted digital data signals. If the checks show a discrepancy at the receiver end, an error indication is generated.

BRIEF DESCRIPTION OF THE DRAWINGS

FIG. 4 shows a simplified block diagram of the digital Electro Hydraulic Control System in accordance with the principle of the invention;

FIG. 5 shows a block diagram of a control program used in accordance with the principles of the invention;

DESCRIPTION OF THE PREFERRED EMBODIMENT

A. POWER PLANT

Figure 1:
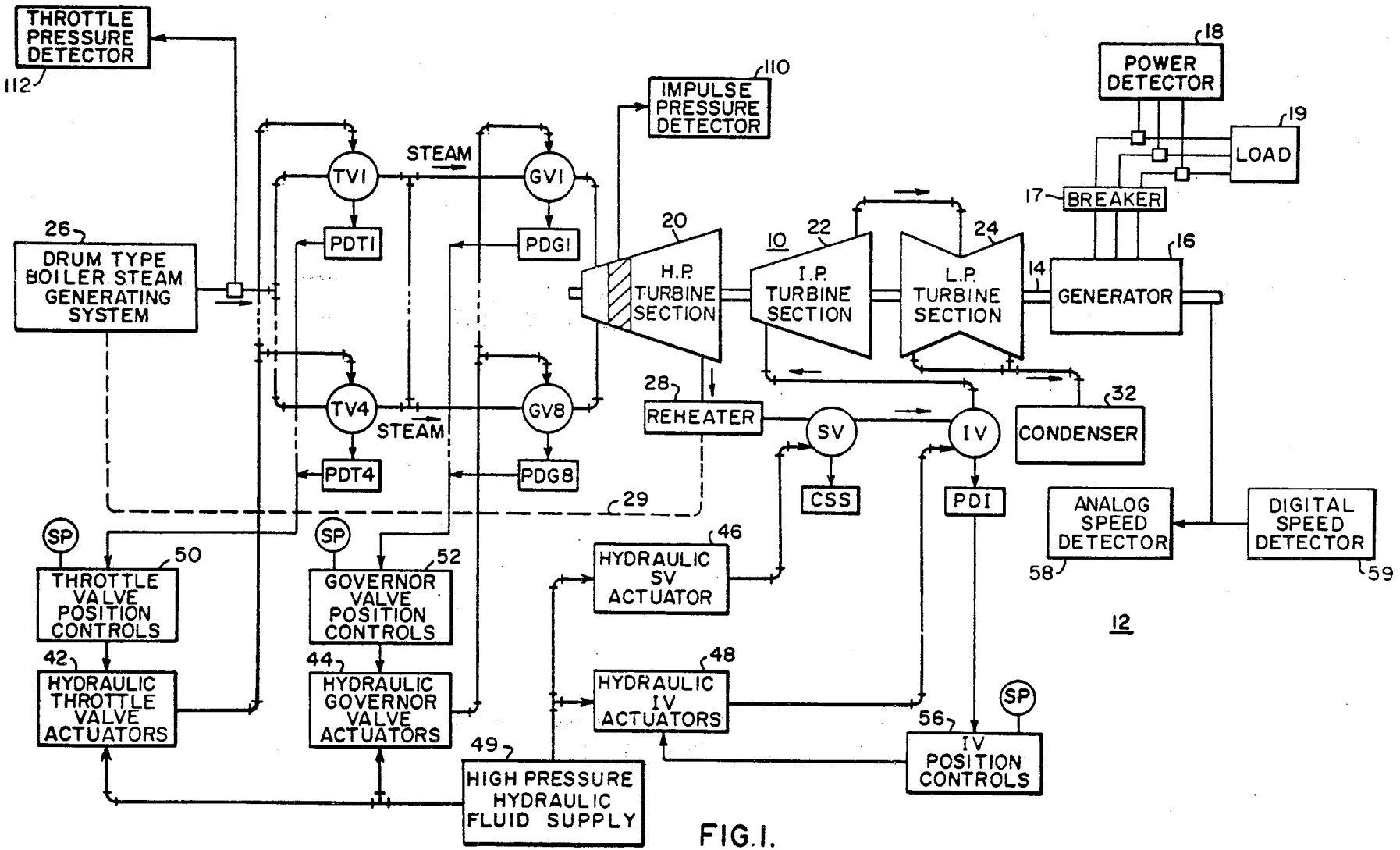
FIG. 1 shows a schematic diagram on an electric power plant including a large steam turbine and a fossile fuel fired drum type boiler and control devices which are all operable in accordance with the principles of the invention.
Figure 2:
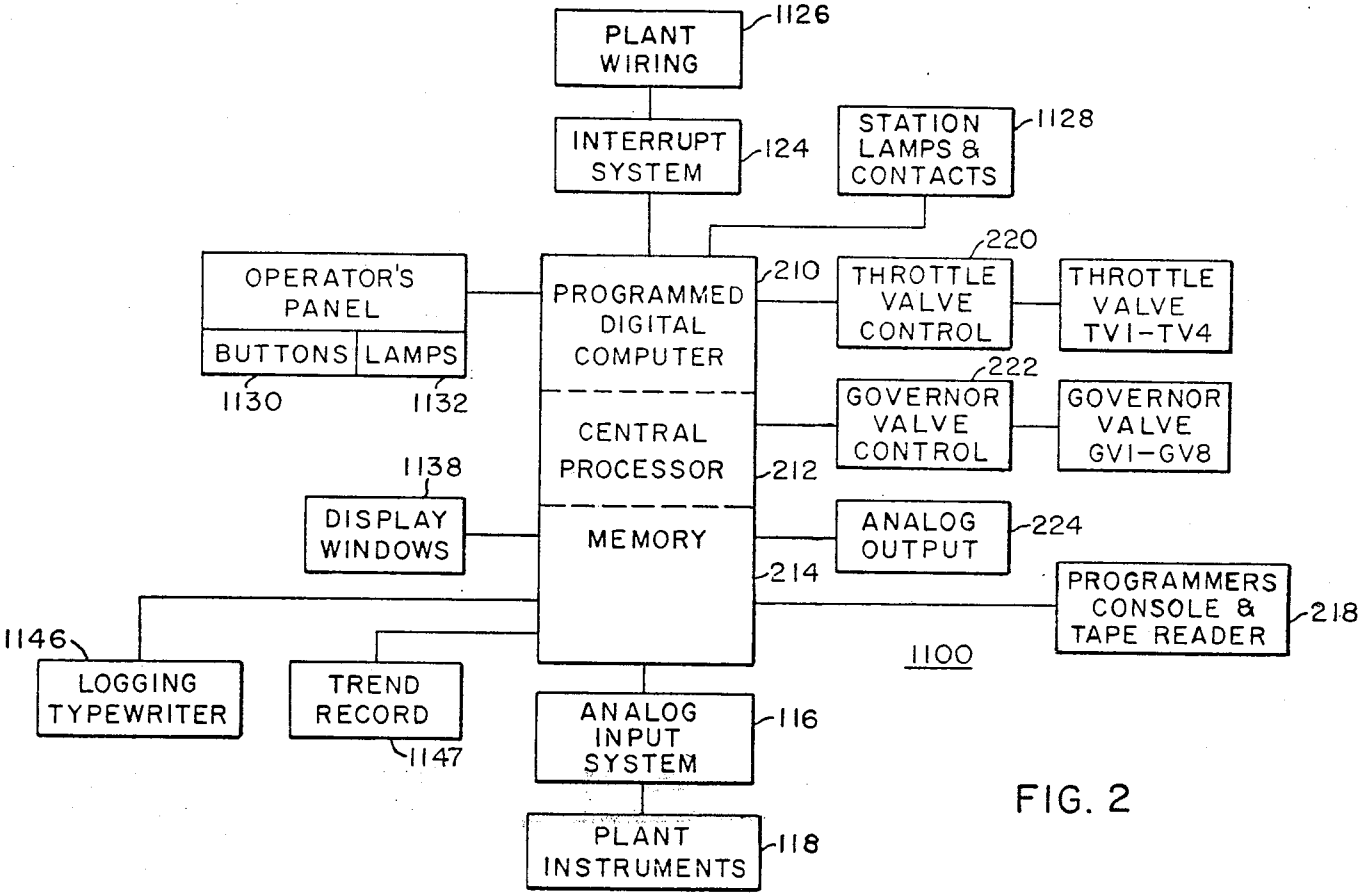
FIG. 2 shows a schematic diagram on a programmed digital computer control system operable with a steam turbine and its associated devices shown in FIG. 1 in accordance with the principles of the invention.

More specifically, there is shown in FIG. 1 a large single reheat steam turbine constructed in a well known manner and operated and controlled in an electric power plant 12 in accordance with the principles of the invention. As will become more evident through this description, other types of steam turbines can also be controlled in accordance with the principles of the invention and particularly in accordance with the broader aspects of the invention. The generalized electric power plant shown in FIG. 1 and the more general aspects of the computer control system to be described in connection with FIG. 2 are like those disclosed in the aforementioned Giras and Birnbaum patent application Ser. No. 319,115. As already indicated, the present application is directed to general improvements in turbine operation and control as well as more specific improvements related to digital computer operation and control of turbines.

The turbine 10 is provided with a single output shaft 14 which drives a conventional large alternating current generator 16 to produce three-phase electric power (or any other phase electric power) as measured by a conventional power detector 18 which measures the rate of flow of electric energy. Typically, the generator 16 is connected through one or more breakers 17 per phase to a large electric power network and when so connected causes the turbo-generator arrangement to operate at synchronous speed under steady state conditions. Under transient electric load change conditions, system frequency may be affected and conforming turbo-generator speed changes would result. At synchronism, power contribution of the generator 16 to the network is normally determined by the turbine steam flow which in this instance is supplied to the turbine 10 at substantially constant throttle pressure.

In this case, the turbine 10 is of the multistage axial flow type and includes a high pressure section 20, an intermediate pressure section 22, and a low pressure section 24. Each of these turbine sections may include a plurality of expansion stages provided by stationary vanes and an interacting bladed rotor connected to the shaft 14. In other applications, turbines operating in accordance with the present invention may have other forms with more or fewer sections tandemly connected to one shaft or compoundly coupled to more than one shaft.

The constant throttle pressure steam for driving the turbine 10 is developed by a steam generating system 26 which is provided in the form of a conventional drum type boiler operated by fossil fuel such as pulverized coal or natural gas. From a generalized standpoint, the present invention can also be applied to steam turbines associated with other types of steam generating systems such as nuclear reactor or once through boiler systems.

The turbine 10 in this instance is of the plural inlet front end type, and steam flow is accordingly directed to the turbine steam chest (not specifically indicated) through four throttle inlet valves TV1–TV4. Generally, the plural inlet type and other front end turbine types such as the single ended type or the end bar lift type may involve different numbers and/or arrangements of valves.

Steam is directed from the admission steam chest to the first high pressure section expansion stage through eight governor inlet valves GV1–GV8 which are arranged to supply steam to inlets arcuately spaced about the turbine high pressure casing to constitute a somewhat typical governor valving arrangement for large fossil fuel turbines. Nuclear turbines might on the other hand typically utilize only four governor valves.

During start-up, the governor valves GV1–GV8 are typically all fully opened and steam flow control is provided by a full arc throttle valve operation. At some point in the start-up process, transfer is made from full arc throttle valve control to full arc governor valve control because of throttling energy losses and/or throttling control capability. Upon transfer the throttle valves TV1–TV4 are fully opened, and the governor valves GV1–GV8 are normally operated in the single valve mode. Subsequently, the governor valves may be individually operated in a predetermined sequence usually directed to achieving thermal balance on the rotor and reduced rotor blade stressing while producing the desired turbine speed and/or load operating level. For example, in a typical governor valve control mode, governor valves GV5–GV8 may be initially closed as the governor valves GV1–GV4 are jointly operated from time to time to define positions producing the desired corresponding total steam flows. After the governor valves GV1–GV4 have reached the end of their control region, i.e., upon being fully opened, or at some overlap point prior to reaching their fully opened position, the remaining governor valves GV5–GV8 are sequentially placed in operation in numerical order to produce continued steam flow control at higher steam flow levels. This governor valve sequence of operation is based on the assumption that the governor valve controlled inlets are arcuately spaced about the 360° periphery of the turbine high pressure casing and that they are numbered consecutively around the periphery so that the inlets corresponding to the governor valves GV1 and GV8 are arcuately adjacent to each other.

After the steam has crossed past the first stage impulse blading to the first stage reaction blading of the high pressure section, it is directed to a reheater system 28 which is associated with a boiler or steam generating system 26. In practice, the reheater system 28 may typically include a pair of parallel connected reheaters coupled to the boiler 26 in heat transfer relation as indicated by the reference character 29 and associated with opposite sides of the turbine casing.

With a raised enthalpy level, the reheated steam flows from the reheater system 28 through the intermediate pressure turbine section 22 and the low pressure turbine section 24. From the latter, the vitiated steam is exhausted to a condenser 32 from which water flow is directed (not indicated) back to the boiler 26.

Respective hydraulically operated throttle valve actuators indicated by the reference character 42 are provided for the four throttle valves TV1–TV4. Similarly, respective hydraulically operated governor valve actuators indicated by the reference character 44 are provided for the eight governor valves GV1–GV8. Hydraulically operated actuators indicated by the reference characters 46 and 48 are provided for the reheat stop and interceptor valves SV and IV. A computer monitored high pressure fluid supply 50 provides the controlling fluid for actuator operation of the valves TV1–TV4, GV1–GV8, SV and IV. A computer supervised lubricating oil system (not shown) is separately provided for turbine plant lubricating requirements.

The respective actuators 42, 44, 46 and 48 are of conventional construction, and the inlet valve actuators 42 and 44 are operated by respective stabilizing position controls indicated by the reference characters 50 and 52. If desired, the interceptor valve actuators 48 can also be operated by a position control 56 although such control is not employed in the present detailed embodiment of the invention. Each position control includes a conventional analog controller (not shown in FIG. 1) which drives a suitably known actuator servo valve (not indicated) in the well known manner. The reheat stop valve actuators 46 are fully open unless the conventional trip system or other operating means causes them to close and stops the reheat steam flow.

Since the turbine power is proportional to steam flow under the assumed control condition of substantially constant throttle pressure, steam valve positions are controlled to produce control over steam flow as an intermediate variable and over turbine speed and/or load as an end control variable or variables. Actuator operation provides the steam valve positioning, and respective valve position detectors PDT1–PDT4, PDG1–PDG8 and PDI are provided to generate respective valve position feedback signals for developing position error signals to be applied to the respective position controls 50, 52 and 56. One or more contact sensors CSS provides status data for the stop valving SV. The position detectors are provided in suitable conventional form, for example, they may make conventional use of linear variable differential transformer operation in generating negative position feedback signals for algebraic summing with respect to position setpoint signals SP in developing the respective input error signals. Position controlled operation of the interceptor valving IV would typically be provided only under a reheat steam flow cutback requirement.

A speed detector 58 is provided for determining the turbine shaft speed for speed control and for frequency participation control purposes. The speed detector 58 can for example be in the form of a reluctance pickup (not shown) magnetically coupled to a notched wheel (not shown) on the turbo-generator shaft 14. In the detailed embodiment subsequently described herein, a plurality of sensors are employed for speed detection. Analog and/or pulse signals produced by the speed detector 58, the electric power detector 18, the pressure detectors 38 and 40, the valve position detectors PDT1–PDT4, PDG1–PDG8 and PDI, the status contact or contacts CSS, and other sensors (not shown) and status contacts (not shown) are employed in programmed computer operation of the turbine 10 for various purposes including controlling turbine performance on an on-line real time basis and further including monitoring, sequencing, supervising, alarming, displaying and logging.

B. DEH - COMPUTER CONTROL SYSTEM

As generally illustrated in FIG. 2, a Digital Electro-Hydraulic control system (DEH) 1100 includes a programmed digital computer 210 to operate the turbine 10 and the plant 12 with improved performance and operating characteristics. The computer 210 can include conventional hardware including a central processor 212 and a memory 214. The digital computer 210 and its associated input/output interfacing equipment is a suitable digital computer system such as that sold by Westinghouse Electric Corporation under the trade name of P2000. In cases when the steam generating system 26 as well as the turbine 10 are placed under computer control, use can be made of one or more P2000 computers or alternatively a larger computer system such as that sold by Xerox Data Systems and known as the Sigma 5. Separate computers, such as P2000 computers, can be employed for the respective steam generation and turbine control functions in the controlled plant unit and interaction is achieved by interconnecting the separate computers together through data links or other means.

The digital computer used in the DEH control system 1100 is a P2000 computer which is designed for real time process control applications. The P2000 typically uses a 16 bit word length with 2's complement, a single address and fixed word length operated in a parallel mode. All the basic DEH system functions are performed with a 16,000 word (16K), 3 microsecond magnetic core memory. The integral magnetic core memory can be expanded to 65,000 words (65K).

The equipment interfacing with the computer 210 includes a contact interrupt system 124 which scans contacts representing the status of various plant and equipment conditions in plant wiring 1126. The status contacts might typically be contacts of mercury wetted relays (not shown) which operate by energization circuits (not shown) capable of sensing the predetermined conditions associated with the various system devices. Data from status contacts is used in interlock logic functioning and control for other programs, protection analog system functioning, programmed monitoring and logging and demand logging, etc.

Operator's panel buttons 1130 transmit digital information to the computer 2010. The operator's panel buttons 1130 can set a load reference, a pulse pressure, megawatt output, speed, etc.

In addition, interfacing with plant instrumentation 1118 is provided by an analog input system 1116. The analog input system 1116 samples analog signals at a predetermined rate from predetermined input channels and converts the signals sampled to digital values for entry into the computer 210. The analog signals sensed in the plant instrumentation 1118 represent parameters including the impulse chamber pressure, the megawatt power, the valve positions of the throttle valves TV1 through TV4 and the governor valves GV1 through GV8 and the interceptor valve IV, throttle pressure, steam flow, various steam temperatures, miscellaneous equipment operating temperature, generator hydrogen cooling pressure and temperature, etc. A detailed list of all parameters is provided in Appendix 1. Such parameters include process parameters which are sensed or controlled in the process (turbine or plant) and other variables which are defined for use in the programmed computer operation. Interfacing from external systems such as an automatic dispatch system is controlled through the operator's panel buttons 1130.

A conventional programmer's console and tape reader 218 is provided for various purposes including program entry into the central processor 212 and the memory 214 thereof. A logging typewriter 1146 is provided for logging printouts of various monitored parameters as well as alarms generated by an automatic turbine startup system (ATS) which includes program system blocks 1140, 1142, 1144 (FIG. 6) in the DEH control system 1100. A trend recorder 1147 continuously records predetermined parameters of the system. An interrupt system 124 is provided for controlling the input and output transfer of information between the digital computer 210 and the input/output equipment. The digital computer 210 acts on interrupt from the interrupt system 124 in accordance with an executive program. Interrupt signals from the interrupt system 124 stop the digital computer 210 by interrupting a program in operation. The interrupt signals are serviced immediately.

Output interfacing is provided by contacts 1128 for the computer 210. The contacts 1128 operate status display lamps, and they operate in conjunction with a conventional analog/output system and a valve position control output system comprising a throttle valve control system 220 and a governor valve control system 222. A manual control system is coupled to the valve position control output system 220 and is operable therewith to provide manual turbine control during computer shut-down. The throttle and governor valve control systems 220 and 222 correspond to the valve position controls 50 and 52 and the actuators 42 and 44 in FIG. 1. Generally, the manual control system is similar to those disclosed in prior U.S. Pat. No. 3,552,872 by T. Giras et al and U.S. Pat. No. 3,741,246 by A. Braytenbah, both assigned to the present assignee.

Digital output data from the computer 210 is first converted to analog signals in the analog output system 224 and then transmitted to the valve control system 220 and 222. Analog signals are also applied to auxiliary devices and systems, not shown, and interceptor valve systems, not shown.

C. SUBSYSTEMS EXTERNAL TO THE DEH COMPUTER

Figure 3A:
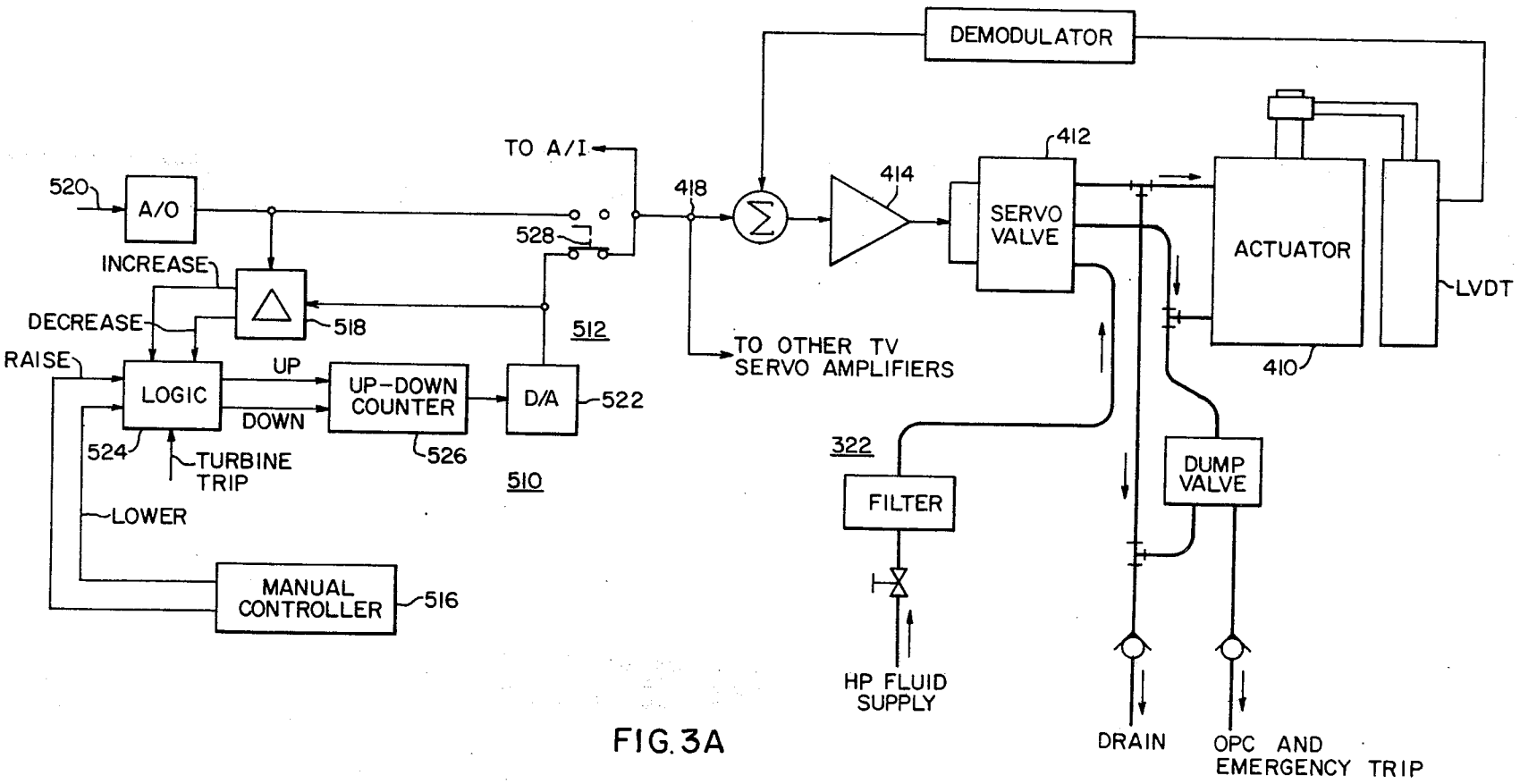
FIGS. 3A, 3B and 3C show a schematic diagram of a hybrid interface between a manual backup system and the digital computer connected with the servo system controlling the valve actuators.
Figure 3B:
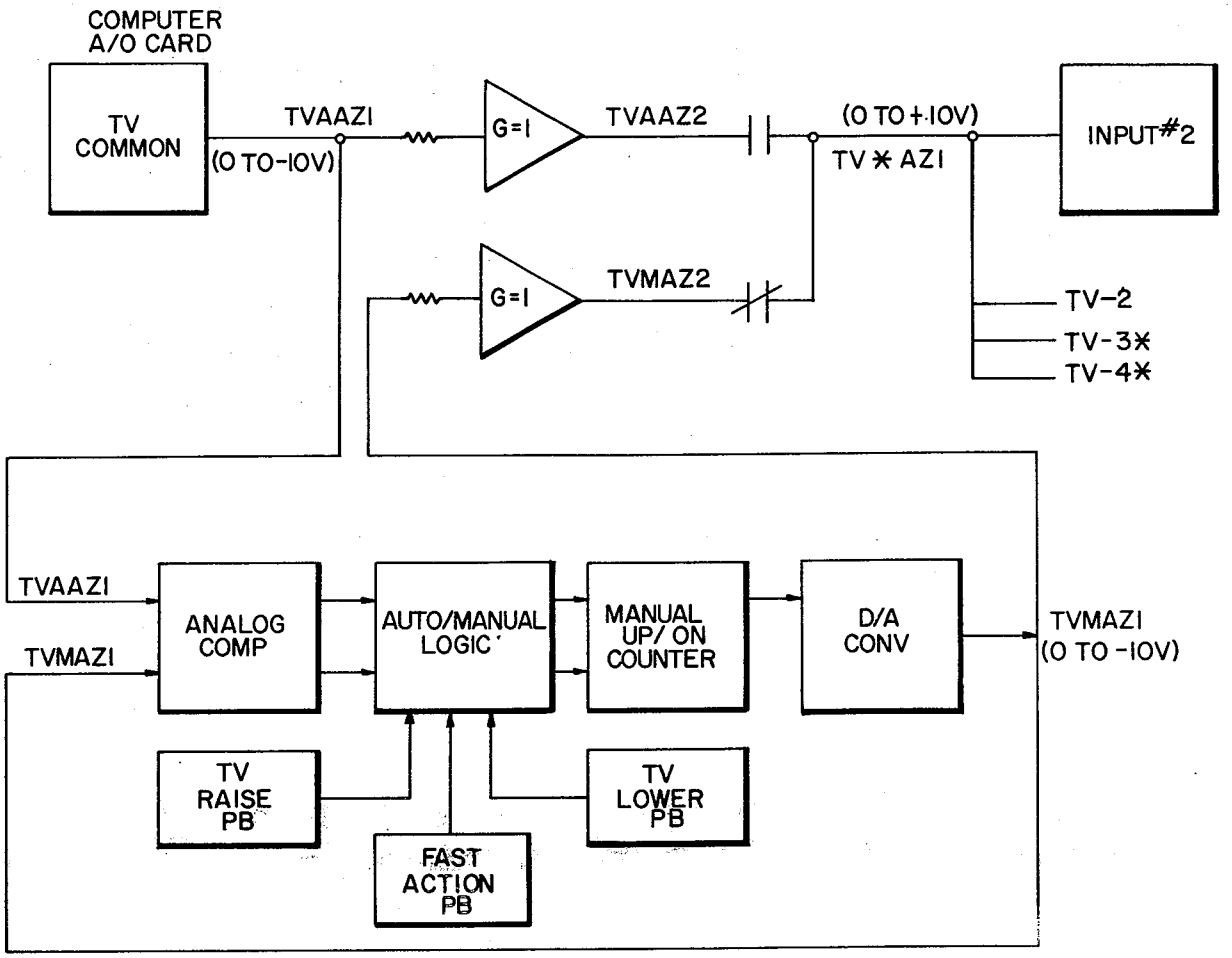
Figure 3C:
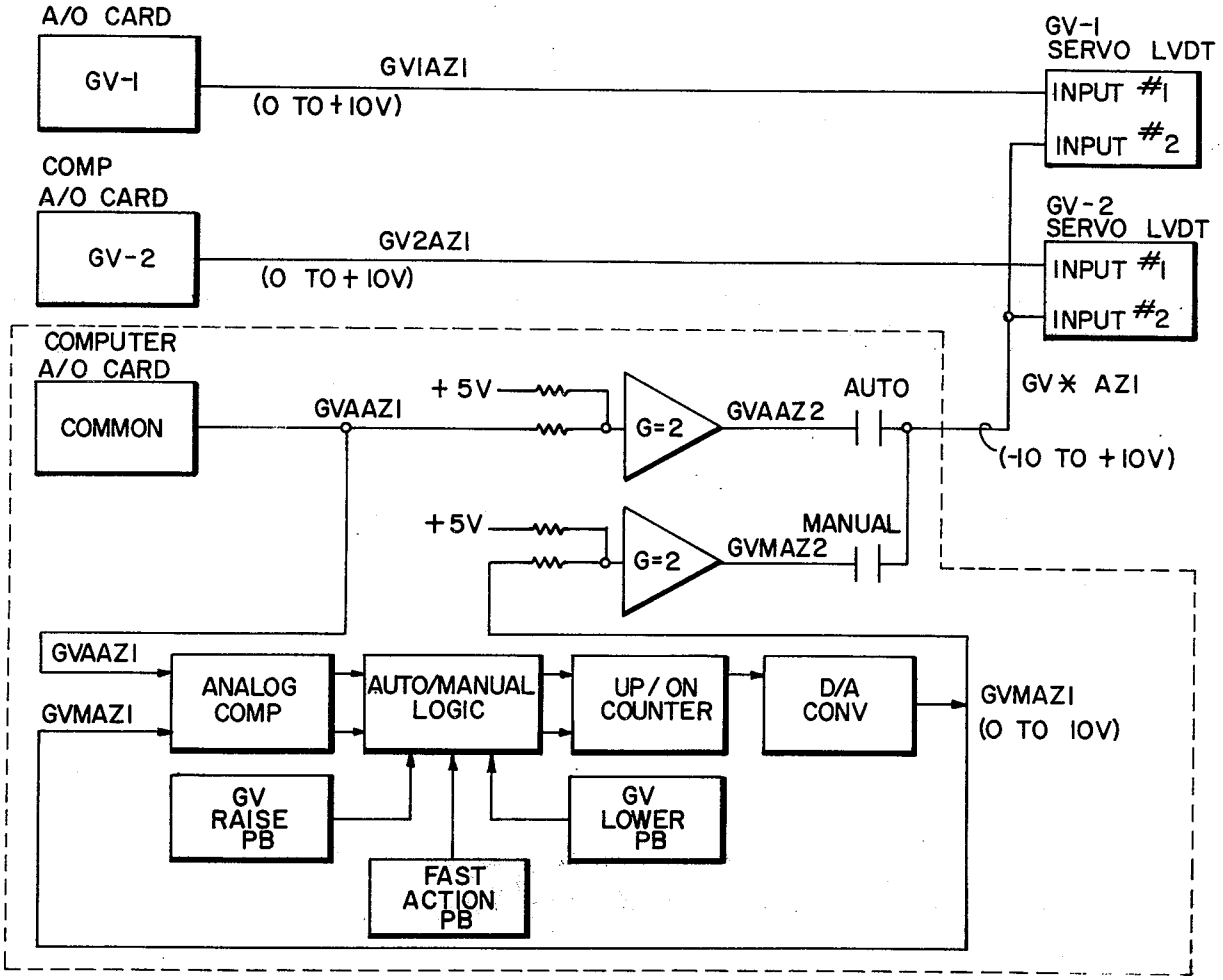

Making reference now to FIGS. 3A–3C, a hardwired digital/analog system forms a part of the DEH control system 1100 (FIG. 2). Structurally, it embraces elements which are included in the blocks 50, 52, 42 and 44 of FIG. 1 as well as additional elements. A hybrid interface 510 is included as a part of the hardwired system. The hybrid interface 510 is connected to actuator system servoamplifiers 414 for the various steam valves which in turn are connected to a manual controller 516, an overspeed protection controller, not shown, and redundant DC power supplies, not shown.

A controller shown in FIG. 3A is employed for throttle valve TV1–TV4 control in the TV control system 50 of FIG. 1. The governor valves GV1–GV8 are controlled in an analogous fashion by the GV control system 52.

While the steam turbine is controlled by the digital computer 210, the hardwired system 511 tracks single valve analog outputs 520 from the digital computer 210. A comparator 518 compares a signal from a digital-to-analog converter 522 of the manual system with the signal 520 from the digital computer 210. A signal from the comparator 518 controls a logic system 524 such that the logic system 524 runs an up-down counter 526 to the point where the output of the converter 522 is equal to the output signal 520 from the digital computer 210. Should the hardwired system 511 fail to track the signal 520 from the digital computer 210 a monitor light will flash on the operator's panel.

When the DEH control system reverts to the control of the backup manual controller 516 as a result of an operator selection or due to a contingency condition, such as loss of power on the automatic digital computer 210, or a stoppage of a function in the digital computer 210, or a loss of a speed channel in the wide range speed control all as described in greater detail infra, the input of the valve actuation system 322 is switched by switches 528 from the automatic controllers in the blocks 50, 52 (FIG. 1) or 220, 222 (FIG. 2) to the control of the manual controller 516. Bumpless transfer is thereby accomplished between the digital computer 210 and the manual controller 516.

Similarly, tracking is provided in the computer 210 for switching bumplessly from manual to automatic turbine control. As previously indicated, the presently disclosed hybrid structural arrangement of software and hardware elements is the preferred arrangement for the provision of improved turbine and plant operation and control with backup capability. However, other hybrid arrangements can be implemented within the field of application of the invention.

D. DEH PROGRAM SYSTEM

DEH Program System Organization, DEH Control Loops And Control Task Program

With reference now to FIG. 4, an overall generalized control system of this invention is shown in block diagram form. The digital electrohydraulic (DEH) control system 1100 operates valve actuators 1012 for the turbine 10. The digital electrohydraulic control system 1100 comprises a digital computer 1014, corresponding to, and it is the digital computer 210 in FIG. 2 interconnected with a hardwired analog backup control system 1016. The digital computer 1014 and the backup control system 1016 are connected to an electronic servo system 1018 corresponding to blocks 220 and 222, in FIG. 2. The digital computer control system 1014 and the analog backup system 1016 track each other during turbine operations in the event it becomes necessary or desirable to make a bumpless transfer of control from a digital computer controlled automatic mode of operation to a manual analog backup mode or from the manual mode to the digital automatic mode.

In order to provide plant and turbine monitor and control functions and to provide operator interface functions, the DEH computer 1014 is programmed with a system of task and task support programs. The program system is organized efficiently and economically to achieve the end operating functions. Control functions are achieved by control loops which structurally include both hardware and software elements, with the software elements being included in the computer program system. Elements of the program system are considered herein to a level of detail sufficient to reach an understanding of the invention. More functional detail on various programs is presented in Appendix 2. Further, a detailed listing of a DEH system program substantially conforming to the description presented herein is presented in Appendix 3 in symbolic and machine language. Most of the listing is compiled by a P2000 compiler from instructions written in Fortran IV. A detailed dictionary of system parameters is presented in Appendix 1, and a detailed computer input-/output signal list is presented in Appendix 4. Appendix 5 mainly provides additional hardware information related to the hardwired system previously considered as part of the DEH control system.

As previously discussed, a primary function of the digital electrohydraulic (DEH) system 1100 is to automatically position the turbine throttle valves TV1 through TV4 and the governor valves GV1 through GV8 at all times to maintain turbine speed and/or load. A special periodically executed program designated the CONTROL task is utilized by the P2000 computer along with other programs to be described in greater detail subsequently herein.

With reference now to FIG. 5, a functional control loop diagram in its preferred form includes the CONTROL task or program 1020 which is executed in the computer 1010. Inputs representing demand and rate provide the desired turbine operating setpoints. The demand is typically either the target speed in specified revolutions per minute of the turbine systems during startup or shutdown operations or the target load in megawatts of electrical output to be produced by the generating system 16 during load operations. The demand enters the block diagram configuration of FIG. 5 at the input 1050 of a compare block 1052.

The rate input either in specified RPM per minute or specified megawatts per minute, depending upon which input is to be used in the demand function, is applied to an integrator block 1054. The rate inputs in RPM and megawatts of loading per minute are established to limit the buildup of stresses in the rotor of the turbine-generator 10. An error output of the compare block 1052 is applied to the integrator block 1054. In generating the error output the demand value is compared with a reference corresponding to the present turbine operating setpoint in the compare block 1052. The reference value is representative of the setpoint RPM applied to the turbine system or the setpoint generator megawatts output, depending upon whether the turbine generating system is in the speed mode of operation or the load mode of operation. The error output is applied to the integrator 1054 so that a negative error drives the integrator 1054 in one sense and a positive error drives it in the opposite sense. The polarity error normally drives the integrator 1054 until the reference and the demand are equal or if desired until they bear some other predetermined relationship with each other. The rate input to the integrator 1054 varies the rate of integration, i.e. the rate at which the reference or the turbine operating set-point moves toward the entered demand.

Demand and rate input signals can be entered by a human operator from a keyboard. Inputs for rate and demand can also be generated or selected by automatic synchronizing equipment, by automatic dispatching system equipment external to the computer, by another computer automatic turbine startup program or by a boiler control system. The inputs for demand and rate in automatic synchronizing and boiler control modes are preferably discrete pulses. However, time control pulse widths or continuous analog input signals may also be utilized. In the automatic startup mode, the turbine acceleration is controlled as a function of detected turbine operating conditions including rotor thermal stress. Similarly, loading rate can be controlled as a function of detected turbine operating conditions.

The output from the integrator 1054 is applied to a breaker decision block 1060. The breaker decision block 1060 checks the state of the main generator circuit breaker 17 and whether speed control or load control is to be used. The breaker block 1060 them makes a decision as to the use of the reference value. The decision made by the breaker block 1060 is placed at the earliest possible point in the control task 1020 thereby reducing computational time and subsequently the duty cycle required by the control task 1020. If the main generator circuit breaker 17 is open whereby the tubine system is in wide range speed control the reference is applied to the compare block 1062 and compared with the actual turbine generator speed in a feedback type control loop. A speed error value from the compare block 1062 is fed to a proportional plus reset controller block 1068, to be described in greater detail later herein. The proportional plus reset controller 1068 provides an integrating function in the control task 1060 which reduces the speed error signal to zero. In the prior art, speed control systems limited to proportional controllers are unable to reduce a speed error signal to zero. During manual operation an offset in the required setpoint is no longer required in order to maintain the turbine speed at a predetermined value. Great accuracy and precision of turbine speed whereby the turbine speed is held within one RPM over tens of minutes is also accomplished. The accuracy of speed is so high that the turbine 10 can be manually synchronized to the power line without an external synchronizer typically required. An output from the proportional plus reset controller block 1068 is then processed for external actuation and positioning of the appropriate throttle and/or governor valves.

If the main generator circuit breaker 17 is closed, the CONTROL task 1020 advances from the breaker block 1060 to a summer 1072 where the REFERENCE acts as a feedforward setpoint in a combined feedforward-feedback load control system. If the main generator circuit breaker 17 is closed, the turbine generator system 10 is being loaded by the electrical network connected thereto.

In the control task 1020 of the DEH system 1100 utilizes the summer 1072 to compare the reference value with the output of speed loop 1310 in order to keep the speed correction independent of load. A multiplier function has a sensitivity to varying load which is objectionable in the speed loop 1310.

During the load mode of operation the DEMAND represents the specified loading in MW of the generator 16 which is to be held at a predetermined value by the DEH system 1100. However, the actual load will be modified by any deviations in system frequency in accordance with a predetermined regulation value to provide for frequency participation, a rated speed value in box 1074 is compared in box 1078 with a "two signal" speed value represented by box 1076. The two signal speed system provides high turbine operating reliability to be described infra herein. An output from the compare function 1078 is fed through a function 1080 which is similar to a proportional controller which converts the speed error value in accordance with the regulation value. The speed error from the proportional controller 1080 is combined with the feedforward megawatt reference, i.e., the speed error and the megawatt reference are summed in summation function or box 1072 to generate a combined speed compensated reference signal.

The speed compensated load reference is compared with actual megawatts in a compare box or function 1082. The resultant error is then run through a proportional plus reset controller represented by program box 1084 to generate a feedback megawatt trim.

The feedforward speed compensated reference is trimmed by the megawatt feedback error multiplicatively to correct load mismatch, i.e., they are multiplied together in the feedforward turbine reference path by multiplication function 1086. Multiplication is utilized as a safety feature such that if one signal e.g., MW should fail a large value would not result which could cause an overspeed condition but instead the DEH system 1100 would switch to a manual mode. The resulting speed compensated and megawatt trimmed reference serves as an impulse pressure setpoint in an impulse pressure controller and it is compared with a feedback impulse chamber pressure representation from input 1088. The difference between the feedforward reference and the impulse pressure is developed by a comparator function 1090, and the error output therefrom functions in a feedback impulse pressure control loop. Thus, the impulse pressure error is applied to a proportional plus reset controller function 1092.

During load control the megawatt loop comprising in part blocks 1082 and 1084 may be switched out of service leaving the speed loop 1310 and an impulse pressure loop operation in the DEH system 1100.

Impulse pressure responds very quickly to changes of load and steam flow and therefore provides a signal with minimum lag which smooths the output response of the turbine generator 10 because the lag dynamics and subsequent transient response is minimized. The impulse pressure input may be switched in and out from the compare function 1090. An alternative embodiment embracing feedforward control with impulse pressure feedback trim is applicable.

Between block 1092 and the governor valves GV1–GV8 a valve characterization function for the purpose of linearizing the response of the values is interposed. The valve characterization function described in detail in Appendix III infra herein is utilized in both automatic modes and manual modes of operation of the DEH system 1100. The output of the proportional plus reset controller function 1092 is then ultimately coupled to the governor valves GV1–GV8 through electrohydraulic position control loops implemented by equipment considered elsewhere herein. The proportional plus reset controller output 1092 causes positioning of the governor valves GV1–GV8 in load control to achieve the desired megawatt demand while compensation is made for speed, megawatt and impulse pressure deviations from desired setpoints.

Figure 6:
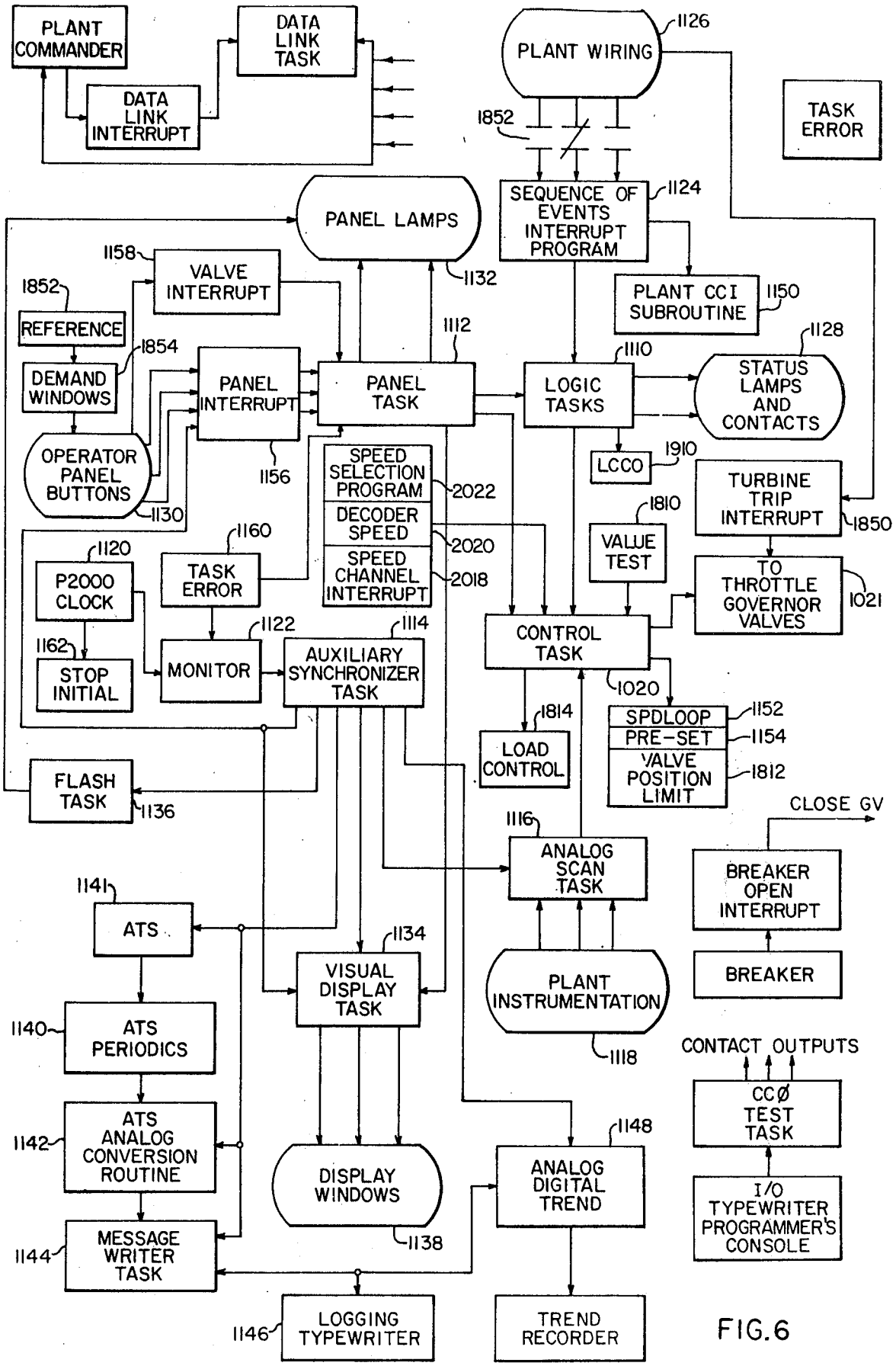
FIG. 6 shows a block diagram of the programs and subroutines of the digital Electro Hydraulic and the automatic turbine startup and monitoring program in accordance with the principles of the invention.

Making reference to FIG. 6, the control program 1020 is shown with interconnections to other programs in the program system employed in the Digital Electro Hydraulic (DEH) system 1100. The periodically executed program 1020 receives data from a logic task 1110 where mode and other decisions which affect the control program are made, a panel task 1112 where operator inputs may be determined to affect the control program, an auxiliary synchronizer program 1114 and an analog scan program 1116 which processes input process data. The analog scan task 1116 receives data from plant instrumentation 1118 external to the computer as considered elsewhere herein, in the form of pressures, temperatures, speeds, etc. and converts such data to proper form for use by other programs. Generally, the auxiliary synchronizer program 1114 measures time for certain important events and it periodically bids or runs the control and other programs. An extremely accurate clock function 1120 operates through a monitor program 1122 to run the auxiliary synchronizer program 1114.

The monitor program or executive package 1122 also provides for controlling certain input/output operations of the computer and, more generally, it schedules the use of the computer to the various programs in accordance with assigned priorities. For more detail on the P2000 computer system and its executive package, reference is made to Appendix 4. In the appendix description, the executive package is described as including analog scan and contact closure input routines, whereas these routines are considered as programs external to the executive package in this part of the disclosure.

The logic task 1110 is fed from outputs of a contact interrupt or sequence of events program 1124 which monitors contact variables in the power plant 1126. The contact parameters include those which represent breaker state, turbine auto stop, tripped/latched state interrogation data states, etc. Bids from the interrupt program 1124 are requested with and queued for execution by the executive program 1111. The control program 1110 also receives data from the panel task 1112 and transmits data to status lamps and output contacts 1123. The panel task 1112 receives data instruction based on supervision signals from the operator panel buttons 1130 and transmits data to panel lamps 1132 and to the control program 1020. The auxiliary synchronizer program 1114 synchronizes through the executive program 1111 the bidding of the control program 1020, the analog scan program 1116, a visual display task 1134 and a flask task 1136. The visual display task transmits data to display windows 1138.

The control program 1020 receives numerical quantities representing process variables from the analog scan program 1116. As already generally considered, the control program 1020 utilizes the values of the various feedback variables including turbine speed, impulse pressure and megawatt output to calculate the position of the throttle valves TV1–TV4 and governor valves GV1–GV8 in the turbine system 10, thereby controlling the megawatt load and the speed of the turbine 10.

To interface the control and logic programs efficiently, the sequence of events program 1124 normally provides for the logic task 1110 contact status updating on demand rather than periodically. The logic task 1110 computes all logical states according to predeter-

FLASH TASK LAMP COMBINATIONS

| LIMIT | OLDLIMIT | Action |
|---|---|---|
| 0 | 0 | Do Nothing |
| 0 | 1 | Turn Light Off |
| 1 | 0 | Turn Light On |
| 1 | 1 | Turn Light Off |

After the proper action is taken by the FLASH task, the OLDLIMIT array is then updated to agree with the current LIMIT array for the next pass through the task ½ sec later.

A third array called CCOFLAG is also maintained by the FLASH task in order to set contact outputs when a limiting condition exists. The contact outputs are not set and reset regularly (as are the flashing lights) but rather the contacts are set and remain on as long as the flashing condition exists. When the flashing condition ceases the contacts are reset. A table of combinations illustrating this action follows:

FLASH TASK CONTACT COMBINATIONS

| LIMIT | CCOFLAG | Action |
|---|---|---|
| 0 | 0 | Do Nothing |
| 0 | 1 | Reset Contact |
| 1 | 0 | Set Contact |
| 1 | 1 | Do Nothing |

It should be noted that only the first five flash conditions listed above have contact outputs associated with them; the remaining four simply flash Operator's Panel lights.

The control of the operation of the DEH control system 1100 is greatly facilitated for the operator by the novel layout of the operator's panel 1130, the flashing and warning capabilities thereof, and the interface provided with the turbine control and monitor functions through the pushbutton switches. In addition, simulated turbine operation is provided by the DEH system for operator training or other purposes through the operation of the appropriate panel switches during turbine down time. Further, it is noteworthy that manual and automatic operator controls are at the same panel location for good operator interface under all operating conditions. More detail on the functioning of the panel pushbuttons is presented in Appendix 2 and elsewhere in the description of the DEH programs herein.

Figure 7:
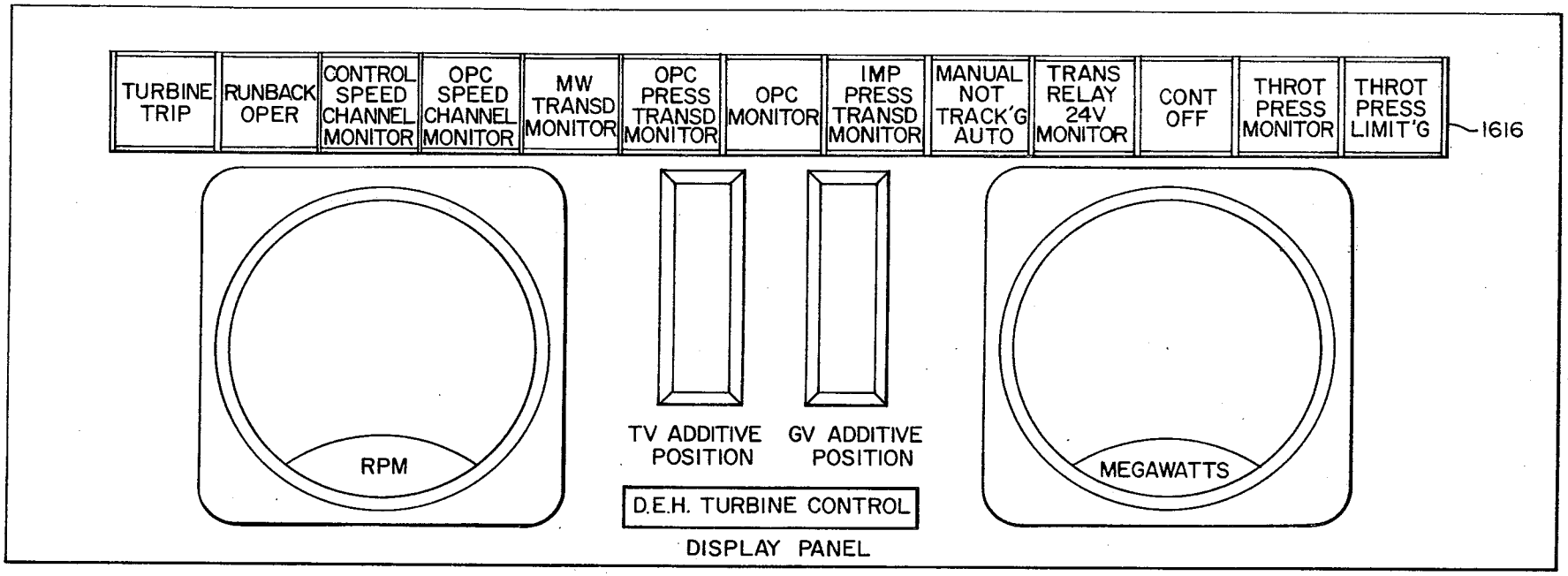
FIG. 7 shows a view of a part of an operator's control panel which is operable in accordance with the principles of the invention.
Figure 8:
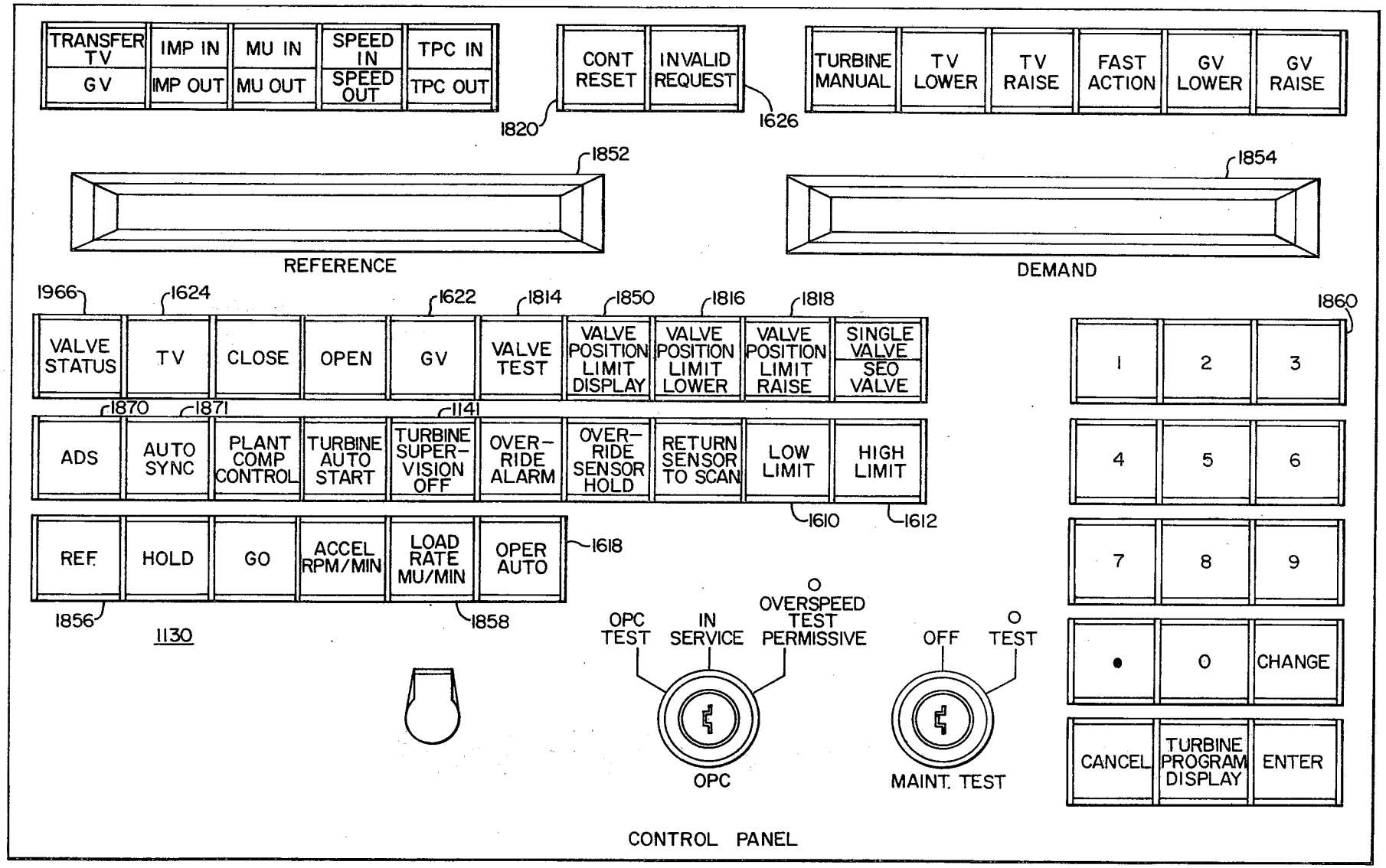
FIG. 8 shows a view of a part of the operator's control panel which is operable in accordance with the principles of the invention.
Figure 9:
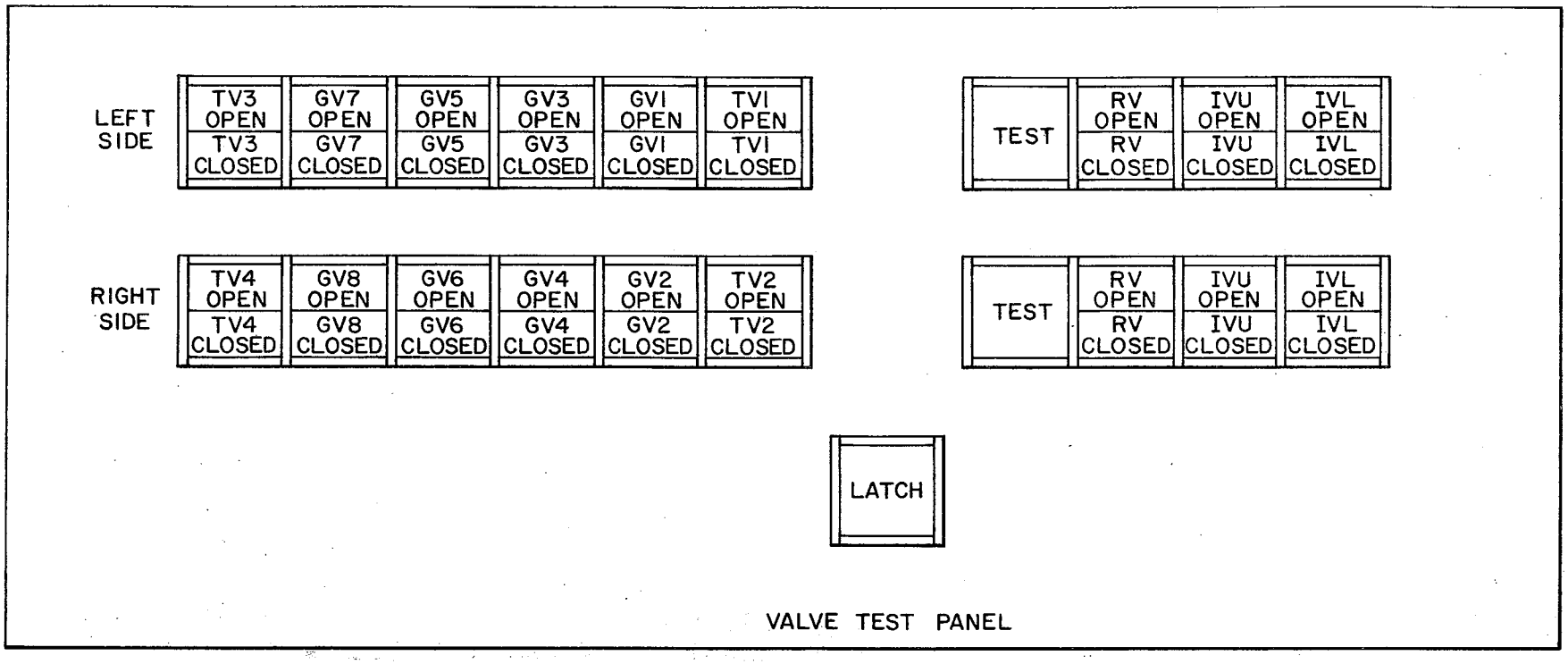
FIG. 9 shows a view of a portion of the operator's control panel which is operable in accordance with the principles of the invention.
Figure 10:
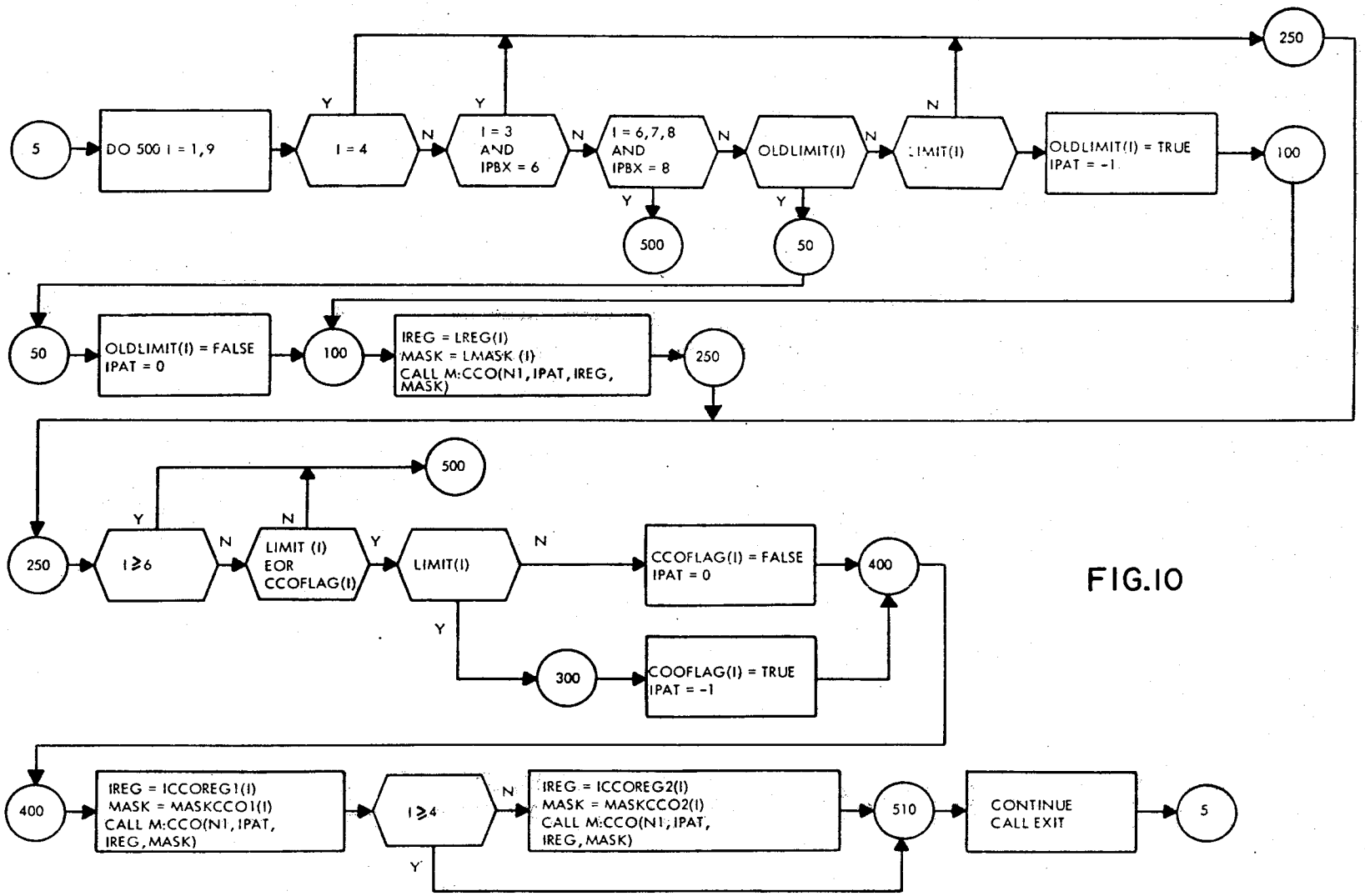
FIG. 10 shows a flow chart of a flash task which is operable in accordance with the principles of the invention.

In addition the layout of the panel 1130 of FIGS. 7, 8 and 9 is unique and very efficient from operation and operator interface considerations. The control of the DEH system 1100 by the buttons of the panel 1130 and the software programs thereto provides improved operation of the computer 210 and turbine generator 10.

Software details of the panel 1130 interface are available in the appendices 3, 4, 5 and 6.

PANEL INTERRUPT PROGRAM

The PANEL INTERRUPT program responds to Operator's Panel pushbutton requests by decoding the pushbutton indentification and bidding the PANEL task to cavry out the appropriate response. The PANEL INTERRUPT program is initiated by the Monitor interrupt handler.

The DEH turbine control system is designed to provide maximum flexibility to plant personnel in performing their function of operating the turbine. This flexibility is evidenced by an Operator's Panel with an array of pushbuttons arranged in functional groups, and an internal software organization which responds immediately to pushbutton requests by the operator. The heart of this instant response is the interrupt capability of the DEH control system.

Pressing any panel pushbutton activates a diode-decoding network which identifies the pushbutton, sets a group of six contacts to an appropriate coded pattern, and generates an interrupt to the computer. The Monitor interrupt handler responds within microseconds and runs the PANEL INTERRUPT program, which does a demand contact input scan of the special panel pushbutton contacts and bids the PANEL task to carry out the function requested by the operator.

VISUAL DISPLAY PROGRAM

Visual display of numerical information which resides in memory has been a traditional function of control computer systems. This feature provides communication between the operator and the controller, with both display and changing of internal information usually available. Continuous display of a quantity provides visual indication of trends, patterns and dynamic response of control system variables; periodically updated values of the displayed quantity are entered into the windows so that fast changes may readily be observed by operating and technical personnel.

The DEH control system has provision for visual display of six important control quantities through dedicated individual pushbuttons. In addition, complete valve status (i.e., position) may be displayed through a group of appropriate pushbuttons; all remaining control system variables, parameters or constants may be displayed through another pushbutton, in conjunction with keyboard-entered dictionary addresses which select the desired quantity for display.

Figure 11:
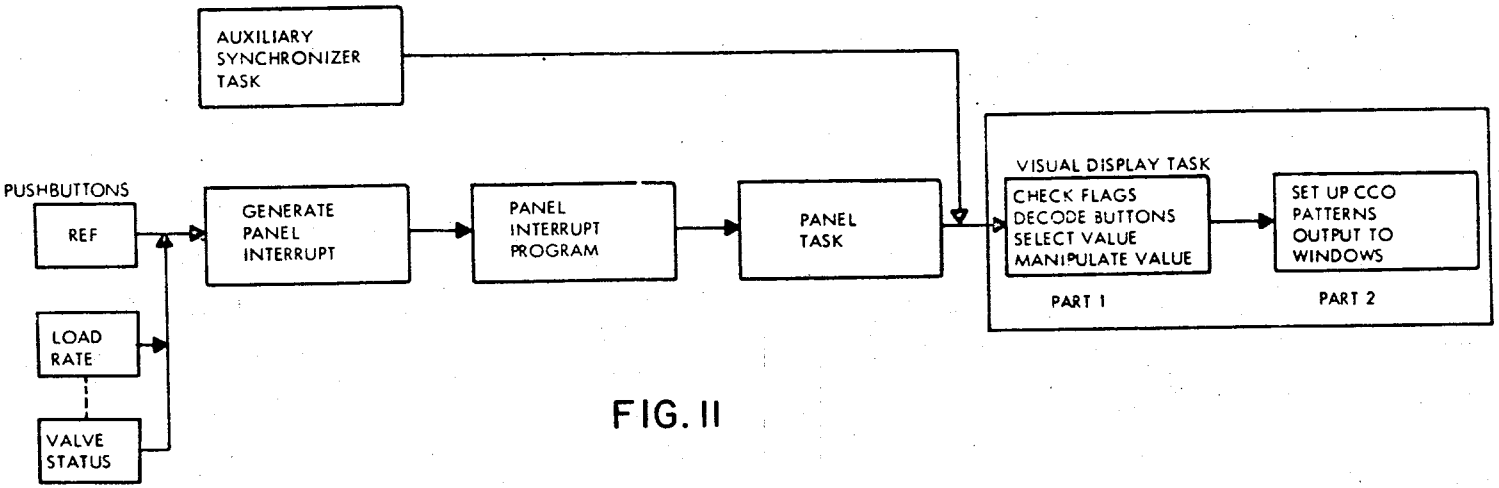
FIG. 11 is a block diagram of a visual display system which is operable in accordance with the principles of the invention.
Figure 12:
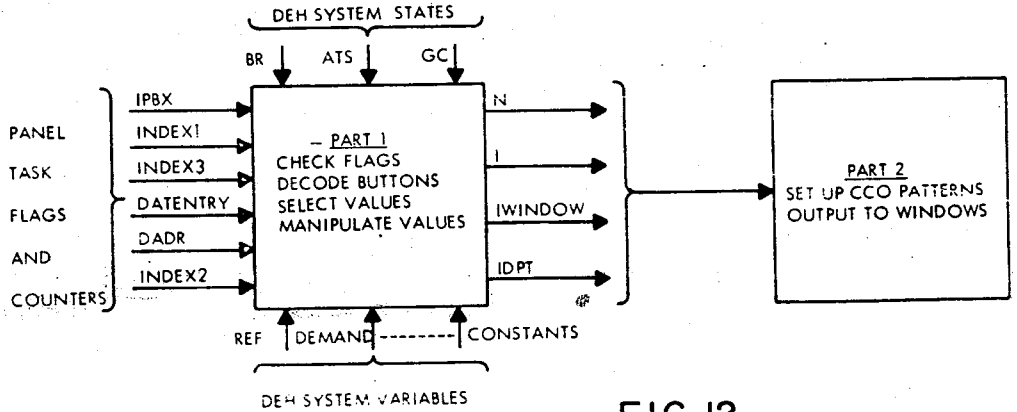
FIG. 12 is a block diagram of the execution of a two-part visual display function which is operable in accordance with the principles of the invention.

The visual display program 1134 as shown in FIG. 6 is connected with the panel interrupt program 1156 and the auxiliary synchronizer program 1114. The visual display program 1134 controls the display windows 1138 with a reference window 1852 and a demand window 1854. The demand window 1854 and the reference window 1852 are also shown in FIG. 8 as part of the operator's panel 1130. By pressing an appropriate button such as the reference button 1856 a reference value will be displayed in the reference window 1852 and a demand value will be displayed in the demand window 1854. Similarly, for example, if a valve position limit display button 1858 is pressed a valve position limit value will be displayed in the reference window 1852 and the corresponding valve variable being limited is displayed in the demand window 1854. Upon pressing the load rate button 1858 the load rate will be displayed in the reference window 1852. In addition, a keyboard 1860 has the capability through an appropriate program to select virtually any parameter or constant in the DEH system 1100 and display that parameter in the reference window 1852 and the demand window 1854. In FIG. 11 a block diagram of the visual display program system is shown. FIG. 12 shows a block diagram of the execution of a two-part visual display function.

LOGIC TASK

Figure 13:
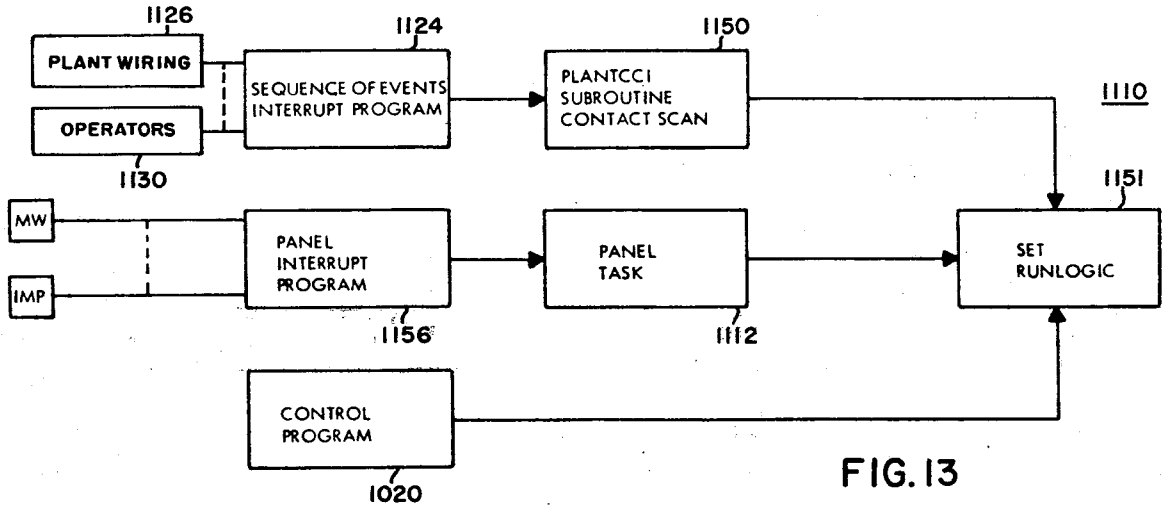
FIG. 13 is a block diagram of conditions which cause initiation of a logic program which is operable in accordance with the principles of the invention.

The LOGIC task determines the operational status of the DEH turbine control system from information provided by the plant, the operator, and other DEH programs. Referring now to FIG. 13, a block diagram repmined conditions and transmits this data to the control program 1020 where this information is utilized in determining the positioning control action for the throttle valves TV1–TV4, and the governor valves GV1–GV8. The logic task 1110 also controls the state of various lamps and relay type contact outputs in a predetermined manner. panel. Therefore a special FLASH program is part of the DEH system. Its function is to monitor and detect such contingency conditions, and flash the appropriate lamp to alert the operator to the state.

Another important partof the DEH system is the OPERATOR's PANEL program. The operator communicates through the panel with the DEH control programs by means of various buttons which have assigned functions. When any button is pressed, a special interrupt is generated; this interrupt triggers a PANEL INTERRUPT program which decodes the button pressed, and then bids the PANEL task. The PANEL program processes the button and takes the proper action, which usually means manipulating some panel lamps, as well as passing on the button information to both the LOGIC and the CONTROL tasks.

The Operator's Panel also has two sets of display windows which allow display of all turbine program parameters, variables, and constants. A visual display task presents this information in the windows at the request of the operator through various dedicated display buttons and a numerical keyboard. The visual display values are periodically updated in the windows as the quantity changes.

Certain important turbine operating conditions are communicated to the DEH operator by way of flashing lamps on the panel. Therefore a special FLASH progress is part of the DEH system. Its function is to monitor and detect such contingency conditions; and flash the appropriate lamp to alert the operator to the state.

OPERATOR'S PANEL AND FLASH PROGRAM

Referring now to FIGS. 7, 8 and 9, the control panel 1130 for the digital electrohydraulic system 1100 is shown in detail. Specified functions have control panel buttons which flash in order to attract the attention of an operator. The FLASH task has two functions: it flashes appropriate lights to alert the operator to various important conditions in the DEH system, and it sets contact outputs to pass these same conditions to the Analog Backup and Boiler Control Systems. The FLASH task is on priority level 5 and is bid by the AUX SYNC task every ½ sec.

The concept behind the FLASH task is that flashing will attract the operator's attention much more quickly than simply maintaining a steady on condition. Most of the flashing lights indicate contingency conditions; a few indicate such things as invalid keyboard entries or that the DEH system is ready to go on automatic control. The flashing frequency is set at ½ sec on and ½ sec off as long as the condition exists. At the termination of the flashing condition, the corresponding lights and contacts are turned off.

A total of nine conditions are continually monitored for flashing by the FLASH task. These are listed below with a brief description of each.

| | | |
|---|---|---|
| 1. Reference Low Limit | — | The turbine load reference is being limited by the low load limit. |
| 2. Reference High Limit | — | The turbine load reference is being limited by the high load limit. |
| 3. Valve Position Limit | — | The turbine governor valve output is being limited by the valve position limit. |
| 4. Throttle Pressure Limit | — | The turbine load reference is being run back because throttle pressure is below set point. No light is flashed in this case but a contact output is set during the throttle pressure limiting. |
| 5. DEH Ready for Automatic | — | The DEH control system has tracked the manual backup system and is ready to go on automatic control. |
| 6. Valve Status Contingency | — | While on automatic control, the DEH system has detected a valve LVDT position not in agreement with its corresponding analog output. |
| 7. Governor Valve Contingency | — | A governor valve LVDT position is not in agreement with its analog output. |
| 8. Throttle Valve Contingency | — | A throttle valve LVDT position is not in agreement with its analog output. |
| 9. Invalid Request | — | An invalid keyboard entry has been made. |

-continued

| | | |
|---|---|---|
| | | limit. |
| 2. Reference High Limit | — | The turbine load reference is being limited by the high load limit. |
| 3. Valve Position Limit | — | The turbine governor valve output is being limited by the valve position limit. |
| 4. Throttle Pressure Limit | — | The turbine load reference is being run back because throttle pressure is below set point. No light is flashed in this case but a contact output is set during the throttle pressure limiting. |
| 5. DEH Ready for Automatic | — | The DEH control system has tracked the manual backup system and is ready to go on automatic control. |
| 6. Valve Status Contingency | — | While on automatic control, the DEH system has detected a valve LVDT position not in agreement with its corresponding analog output. |
| 7. Governor Valve Contingency | — | A governor valve LVDT position is not in agreement with its analog output. |
| 8. Throttle Valve Contingency | — | A throttle valve LVDT position is not in agreement with its analog output. |
| 9. Invalid Request | — | An invalid keyboard entry has been made. |

A total of nine conditions are continually monitored for flashing by the FLASH task. These are listed below with a brief description of each.

| | | |
|---|---|---|
| 1. Reference Low Limit | — | The turbine load reference is being limited by the low load limit. |
| 2. Reference High Limit | — | The turbine load reference is being limited by the high load limit. |
| 3. Valve Position Limit | — | The turbine governor valve output is being limited by the valve position limit. |
| 4. Throttle Pressure Limit | — | The turbine load reference is being run back because throttle pressure is below set point. No light is flashed in this case but a contact output is set during the throttle pressure limiting. |
| 5. DEH Ready for Automatic | — | The DEH control system has tracked the manual backup system and is ready to go on automatic control. |
| 6. Valve Status Contingency | — | While on automatic control, the DEH system has detected a valve LVDT position not in agreement with its corresponding analog output. |
| 7. Governor Valve Contingency | — | A governor valve LVDT position is not in agreement with its analog output. |
| 8. Throttle Valve Contingency | — | A throttle valve LVDT position is not in agreement with its analog output. |
| 9. Invalid Request | — | An invalid keyboard entry has been made. |

Figure 14:
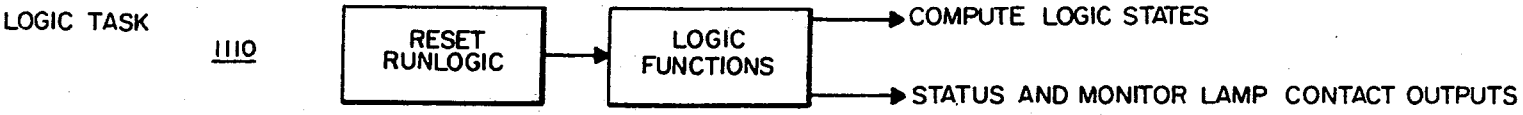
FIG. 14 is a simplified block diagram of a portion of the logic function which is operable in accordance with the principles of the invention.
Figure 15:
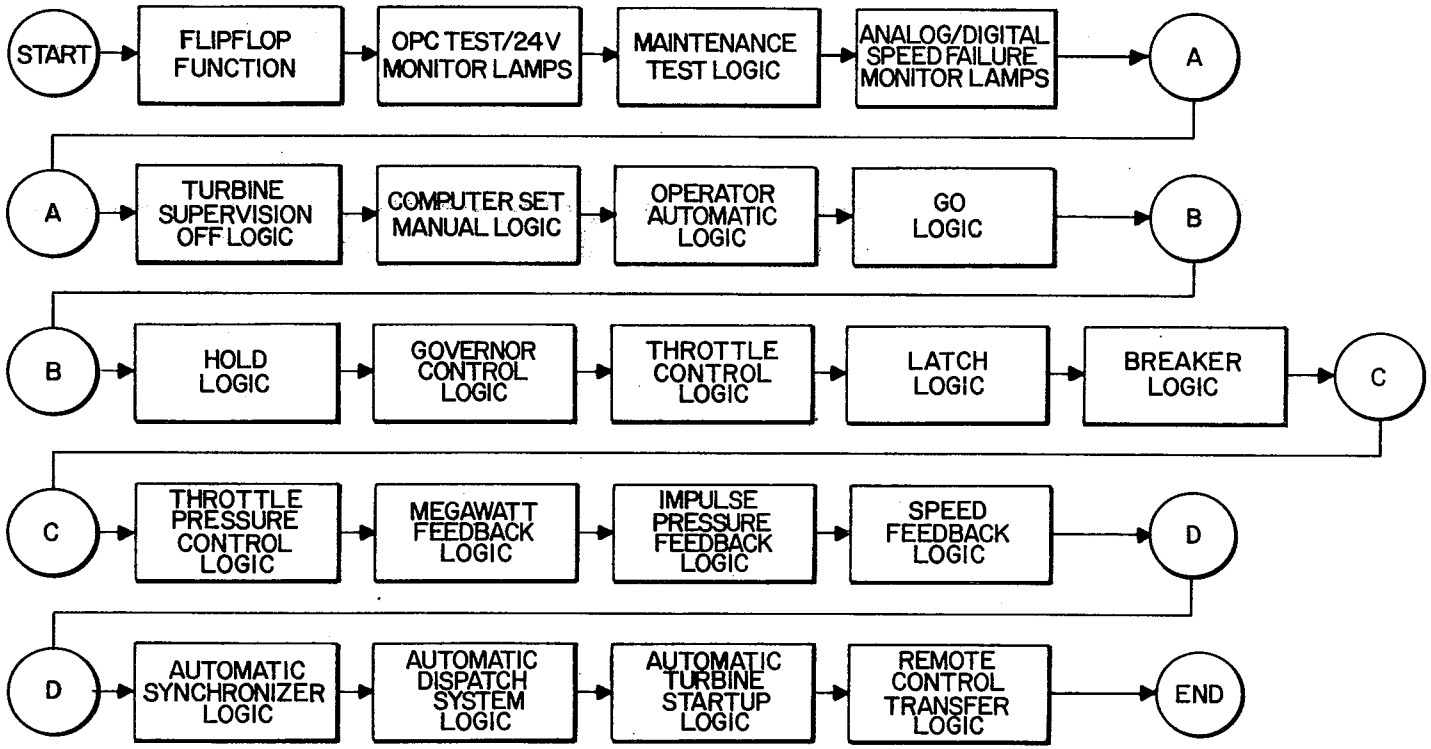
FIG. 15 is a block diagram of the logic program which is operable in accordance with the principles of the invention.
Figure 16:
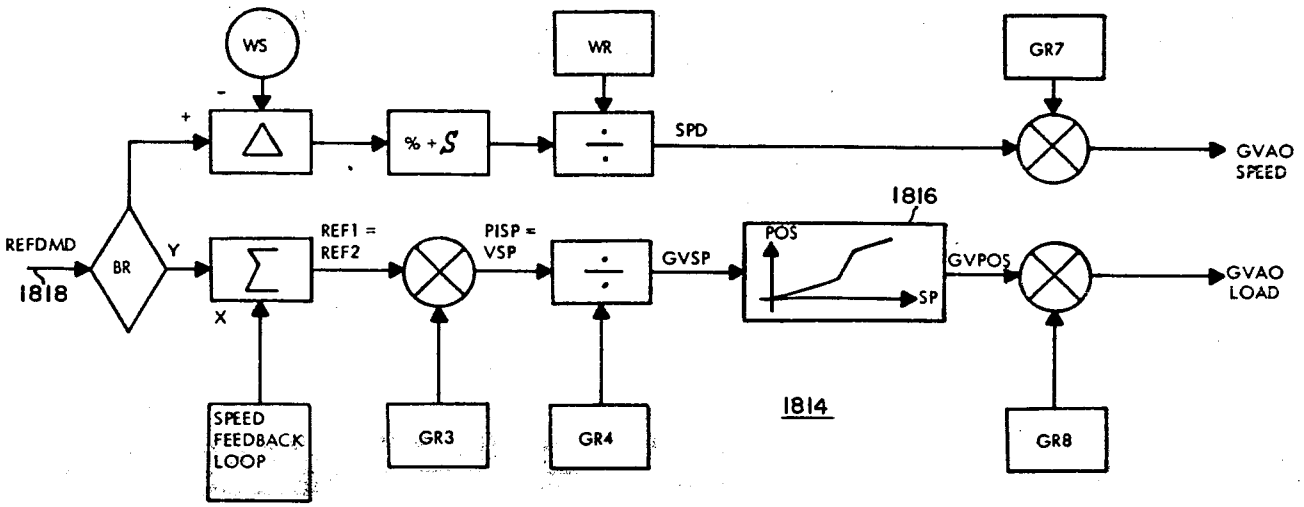
FIG. 16 is a block diagram of a load control system which is operable in accordance with the principles of the invention.

In order to determine whether to flash a light or to suppress flashing, the FLASH task maintains two arrays in core memory. One of these is called LIMIT and contains the current value of the nine limiting or flashing conditions listed above, as they are set by various other DEH programs. The second array is called OLD-LIMIT and is an image of the immediate past value of the LIMIT array. These two arrays are examined every ½ sec by the FLASH task according to the following table of combinations:

resenting the operation of the logic task 1110 is shown. A contact input from the plant wiring 1126 triggers the sequence of events or interrupt program 1124 which calls upon the plant contact closure input subroutine 1150 which in turn requests that the logic program 1110 be executed by the setting of a flag called RUNLOGIC 1151 in the logic program 1110. The logic program 1110 is also run by the panel interrupt program 1156 which calls upon the panel task program 1112 to run the logic program 1110 in response to panel button operations. The control task program 1020 in performing its various computations and decisions will sometimes request the logic program 1110 to run in order to update conditions in the control system. In FIG. 14, the functioning of the logic program 1110 is shown. FIG. 15 shows a more explicit block diagram of the logic program 1110.

The mechanism for actual execution of the LOGIC program is provided by the AUX SYNC task, which runs every 1/10 sec and carries out the scheduled and demand bidding of various tasks in the DEH system. AUX SYNC checks the state of the RUNLOGIC flag and, if it is set, bids the LOGIC task immediately. Thus, the maximum response time for LOGIC requests is 1/10 sec; on the average the response will be much faster than this.

In order to allow immediate rerunning of the LOGIC task should system conditions require, the LOGIC program first resets RUNLOGIC. Thus any other program may then set RUNLOGIC and request a bid which will be carried out by the AUX SYNC program within 1/10 sec. There are two major results of the LOGIC task: the computation of all logic states necessary for proper operation of the DEH system, and the processing of all status and monitor lamp contact outputs to inform the plant control system and operating personnel of the state of the DEH system.

The logic program 1110 controls a series of tests which determine the readiness and operability of the DEH system 1100. One of these tests is that for the overspeed protection controller which is part of the analog backup portion of the hardwired system 1016 shown in FIG. 4. Generally, the logic program 1110 is structured from a plurality of subroutines which provide the varying logic functions for other programs in the DEH program system, and the various logic subroutines are all sequentially executed each time the logic program is run.

AUTOMATIC DISPATCH LOGIC

During the process of operating a turbine on automatic load control, the normal method of changing load is by entering new values of load demand from the keyboard, as described in the operating instructions. Then by using the GO and HOLD pushbuttons in conjunction with the load rate pushbutton, the operator may supervise the loading on the turbine which is acutally carried out by the DEH system of control programs. This will result in the desired load being supplied to the power system by the turbine/generator.

Figure 17:
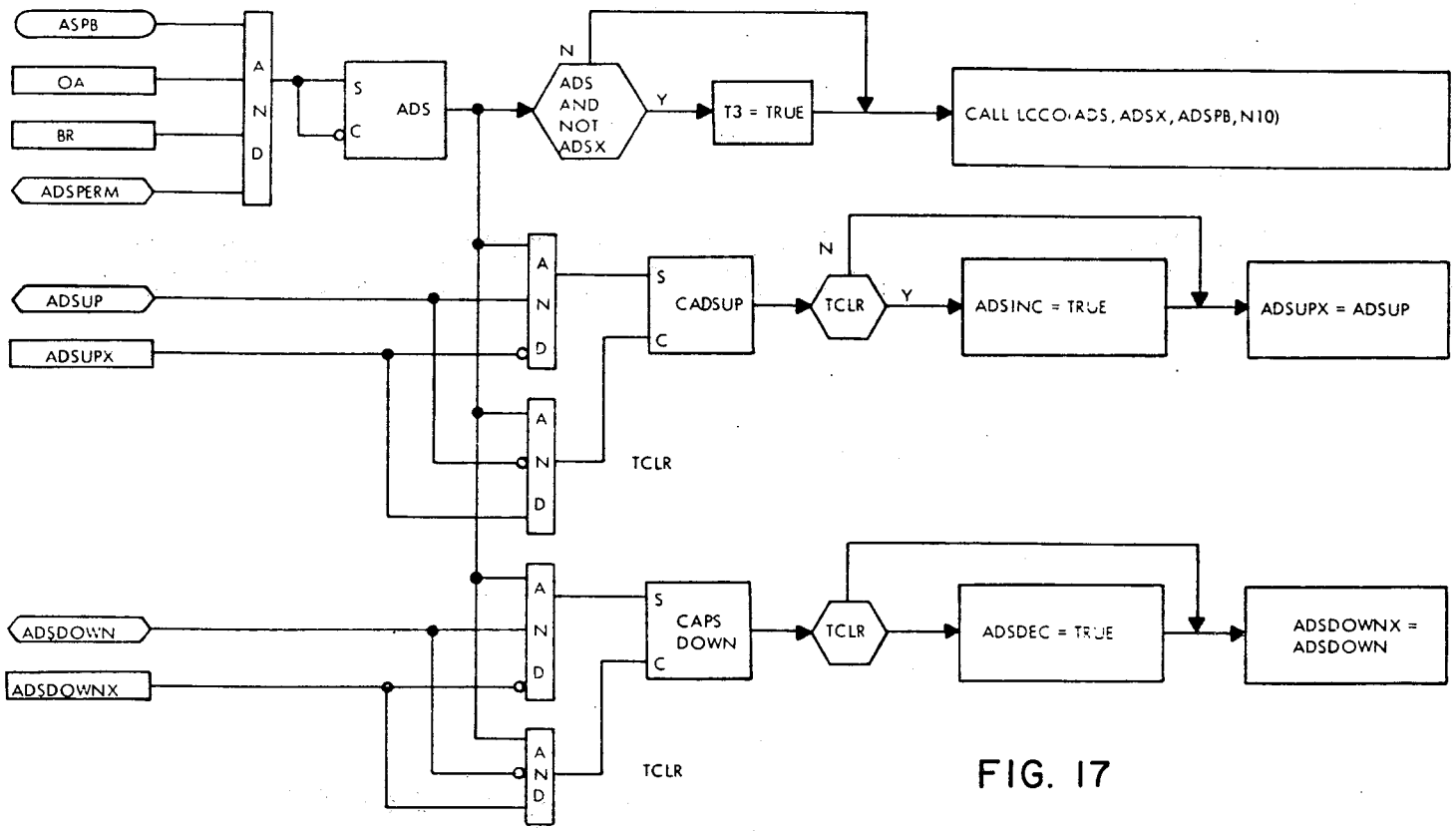
FIG. 17 is a flow chart of an automatic dispatch logic program which is operable in accordance with the principles of the invention.

Another method of supervising load on the turbine is through use of a remote automatic dispatching system. By turning over supervision of the turbine reference to an ADS operating mode, which provides raise and lower pulses whose width determines the requested load change, the DEH control system allows the turbine loading to be coordinated by a central dispatching office which can allocate total utility load on an economic basis to all units in the power system. Provision has been made in the DEH system to allow selection of the automatic dispatch mode through a pushbutton 1870 (FIG. 8) on the operator's panel; in addition, the ADS mode may be rejected by simply pressing the operator automatic pushbutton on the panel. The automatic dispatch logic program detects those conditions concerned with ADS, and sets all DEH states accordingly. A flow chart for the automatic dispatch logic program is shown in FIG. 17. It is triggered into operation on demand for automatic dispatch in order to interface the remote data with the DEH system.

AUTOMATIC TURBINE STARTUP (ATS) LOGIC

Modern methods of starting up turbines and accelerating to synchronous speed require careful monitoring of all turbine metal temperatures and vibrations to assure that safe conditions exist for continued acceleration. Until recently, these conditions have been observed by plant operators visually on various panel instruments. However, all of the important variables are rarely available from the plant instrumentation, and even if they were, the operator can not always be depended upon to make the right decision at a critical time. In addition to these factors, it is impossible to instrument the internal rotor metal temperatures, which are extremely important for indicating potentially excessive mechanical stresses.

To improve the performance at startup, automatic turbine accelerating programs have been written and placed under computer control. Such programs monitor large numbers of analog input signals representing all conceivable turbine variables, and from this information the program makes decisions on how and when to accelerate the unit. In addition, these programs numerically solve the complex heat distribution equations which describe temperature variations in the critical rotor metal parts. From these thermal computations it is possible to predict mechanical stresses and strains, and then to automatically take the proper action in the acceleration of the turbine.

The DEH system has such an automatic turbine startup program available as an optional item. Besides supervising the acceleration as described above, the program provides various messges printed on a typewriter to keep the operator informed as to the turbine acceleration progress. In addition, a group of monitor lamps are operated to indicate key points in the startup stages and to indicate alarm or contingency conditions. The automatic turbine startup logic program detects those conditions concerned with this DEH feature and sets all logical states accordingly.

REMOTE TRANSFER LOGIC

In the DEH turbine control system philosophy, the operator has overall authority in a control system hierarchy which has three general states: manual operation, operator automatic control, and remote automatic control. The manual operating mode is a contingency state which is used only when the computer is not available, as when the software control system is being tuned or modified. The operator automatic mode is the normal operating state during which speed/load demand and all other operating data are entered and displayed from the keyboard by the operator. Remote automatic control modes are those in which speed/load demand and rate are supervised from a source outside the basic DEH system.

Figure 18:
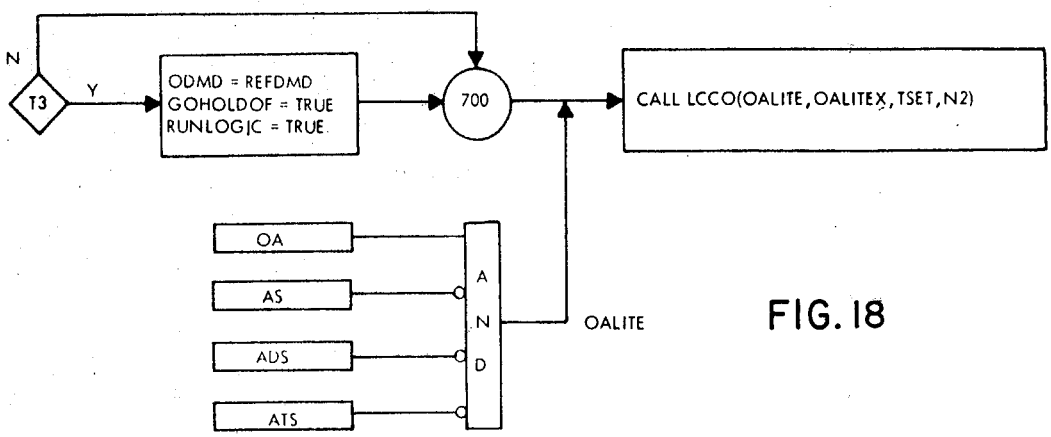
FIG. 18 is a flow chart of a remote transfer logic subroutine which is operable in accordance with the principles of the invention.

In order to allow the DEH system 1100 to provide for automatic turbine operation from an independent source or a remote location, a remote transfer logic porgram shown in flow chart form in FIG. 18 is provided. In the preferred embodiment of the DEH system 1100, the available remote modes place the DEH system under control of the external automatic synchronizer system, the external automatic dispatching system or the automatic turbine startup system which is implemented within the DEH computer. An operator has the capability of choosing whichever mode is permissible and desired at a particular moment.

PANEL TASK

The DEH Operator's Panel is the focal point of turbine operation; it has been designed to make use of the latest digital techniques to provide maximum operational capability. The Operator's Panel provides the primary method of communicating information and control action between the operator and the DEH Control System. This is accomplished through a group of pushbuttons and a keyboard (which together initiate a number of diverse actions), and two digital displays (which provide the operator with visual indication of internal DEH system numerical values).

when pressed, any of the buttons on the Operator's Panel provide momentary action during which a normally-open contact is connected to an electronic diode matrix. Operation of a button energizes a common computer interrupt for the Operator's Panel and applies voltage to a unique combination of 6 contact inputs assigned as a pushbutton decoder. The diode matrix may be used to identify up to 60 pushbuttons. When a button is pressed, the associated interrupt is read within 64 $\mu$ sec, and the corresponding contact inputs scanned and stored in computer memory as a bit pattern for further processing.

Each of the buttons on the panel are backlighted. When a button is pressed and appropriate logical conditions exist, the lamp is turned on to acknowledge to the operator that the action he initiated has been carried out. Should the proper logical conditions not be set, the lamp is not turned on. This informs the operator that the action he requested cannot be carried out.

A few of the buttons are of the digital push-push type which when pushed once initiate an action, and when pushed again suppress that action. Some of these buttons also contain a split lens which indicates one action in the upper half of the lamp and another (usually opposite) action in the lower lens. In addition, certain button backlights are flashed under particular operating circumstances and conditions.

The buttons and keys on the Operator's Panel may be grouped in broad functional groups according to the type of action associated with each set of buttons. A brief description of these groups follows:

1. CONTROL SYSTEM SWITCHING - These buttons alter the configuration of the DEH Control System by switching in or out certain control functions. Examples are throttle pressure control and impulse pressure control.

2. DISPLAY/CHANGE DEH SYSTEM PARAMETERS - These buttons allow the operator to visually display and change important parameters which affect the operation of the DEH system. Examples are the speed and load demand, high and low load limits, speed and load rate settings, and control system tuning parameters.

3. OPERATING MODE SELECTION - This group of buttons provides the operator with the ability to select the turbine operating mode. Examples are permitting an Automatic Synchronizer or an Automatic Dispatch System to set the turbine reference, or selecting local operator automatic control of the turbine (which includes hold/go action).

4. VALUE STATUS/TESTING/LIMITING - This group of buttons allows value status information display, throttle/governor valve testing, and valve position limit adjustment.

5. AUTOMATIC TURBINE STARTUP - This group of buttons is used in conjunction with a special DEH program which continuously monitors important turbine variables, and which also may start up and accelerate the turbine during wide-range speed control.

6. MANUAL OPERATION - These buttons allow the operator to manually control the position of the turbine valves from the Operator's Panel. The DEH PANEL task has no direct connection with this group of buttons.

7. KEYBOARD ACTIVITY - These buttons and keys allow numerical data to be input to the DEH system. Such information may include requests for numerical values via the display windows, or may adjust system parameters for optimum performance.

Figure 19:
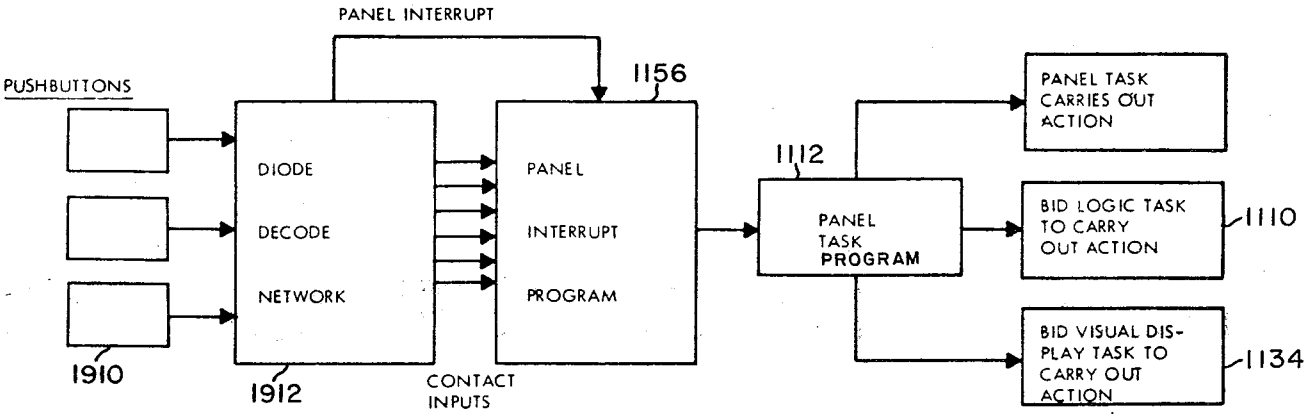
FIG. 19 is a block diagram showing a panel task interaction function which is operable in accordance with the principles of the invention.
Figure 20:
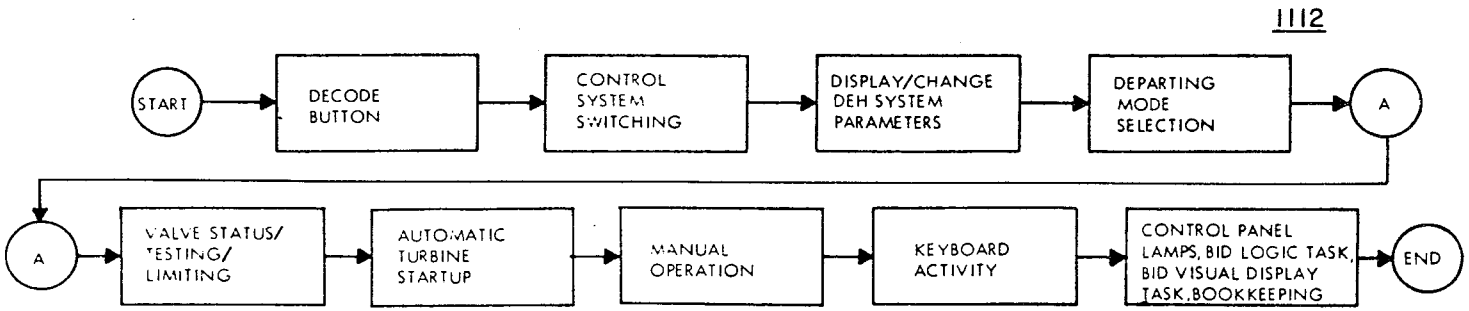
FIG. 20 is a block diagram of a panel program which is operable in accordance with the principles of the invention.

The panel task 1112 responds to the buttons pressed on the operator's panel 1130 by an operator of the DEH control system 1100. The control panel 1130 is shown in FIGS. 7 and 8. Referring now to FIGS. 19 and 20, the interactions of the panel task 1112 are shown in greater detail. Pushbuttons 1110 are decoded in a diode decoding network 1912 which generates contact inputs to activate the panel interrupt program 1156. The panel interrupt program scans the contact inputs and bids the panel task 1112 whereby, the pressed button is decoded and either the panel task 1112 carries out the desired action or the logic task 1110 is bid or the visual display task 1134 is called to carry out the desired command.

CONTROL PROGRAM

Automatic control of turbine speed and load requires a complex, interacting feedback control system capable of compensating for dynamic conditions in the power system, the boiler and the turbine-generator. Impulse chamber pressure and shaft speed from the turbine, megawatts from the generator, and throttle pressure from the boiler are used in the controlled operation of the turbine.

In addition to the primary control features discussed above, the DEH system also contains provisions for high and low load limits, value position limit, and throttle pressure limit; each of these can be adjusted from the Operator's Panel. A number of auxiliary functions are also available which improve the overall turbine performance and the capabilities of the DEH system. Brief descriptions of these follow:

1. Value position limit adjustment from the Operator's Panel.

2. Value testing from the Operator's Panel.

3. Speed signal selection from alternate independent sources.

4. Automatic instantaneous, and bumpless operating-mode selection from the Operator's Panel.

5. A continuous value position monitor and contingency-alert function for the operator during automatic control.

6. A digital simulation and training feature which allows use of the Operator's Panel and most of the DEH system at any time on manual control, without affecting the turbine output or value position. This powerful aid is used for operator and engineer training, simulation studies, control system tuning or adjustment, and for demonstration purposes.

In order to achieve these objectives, the CONTROL task is provided with analog inputs representing the various important quantities to be controlled, and also is supplied with contact inputs and system logical states.

Figure 21:
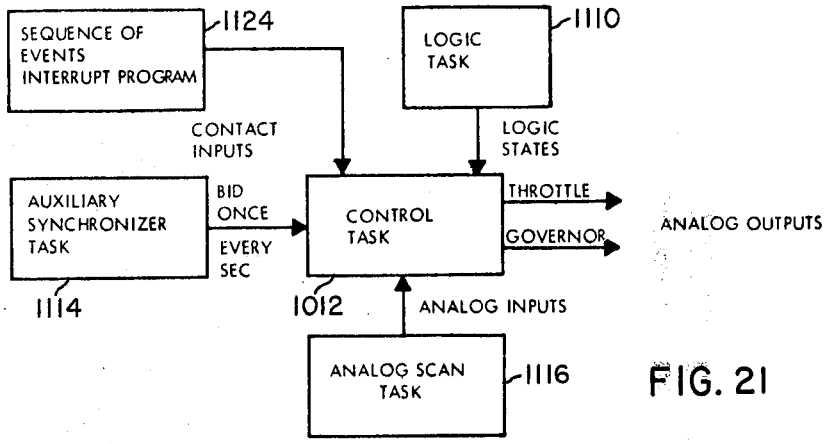
FIG. 21 is a block diagram showing a control task interface which is operable in accordance with the principles of the invention.
Figure 22:
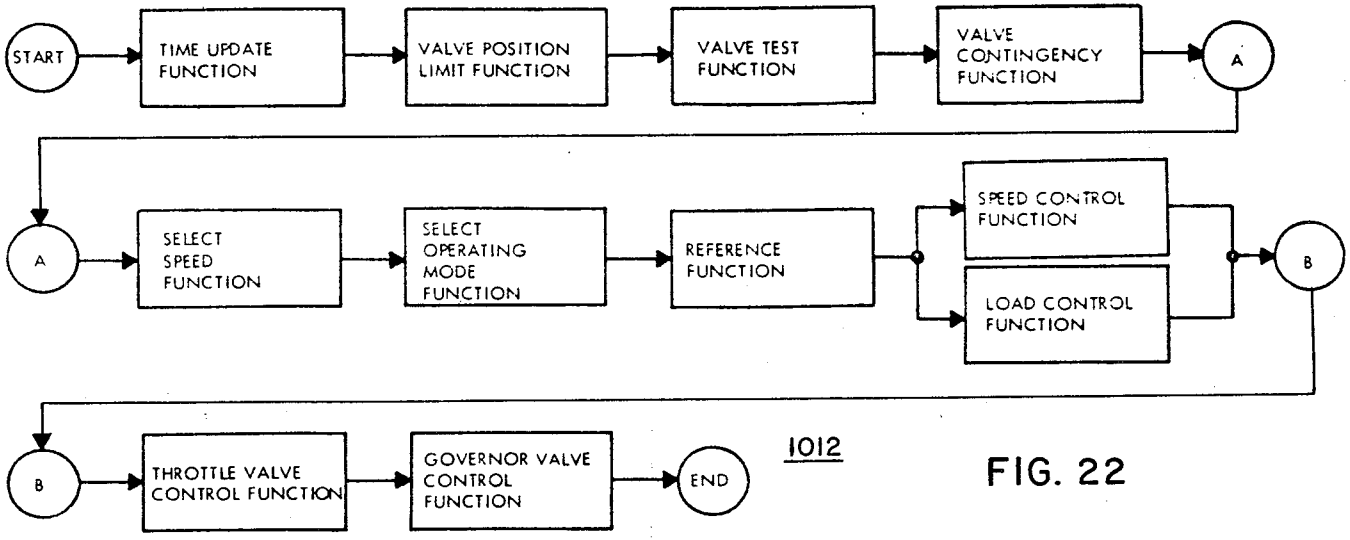
FIG. 22 is a block diagram showing a control program which is operable in accordance with the principles of the invention.

The control program 1012 related programs are shown in greater detail in FIG. 21. In the computer program system, the control program 1012 is interconnected with the analog scan program 1116, the auxiliary sync program 1114, the sequence of events interrupt program 1124 and the logic task 1110. FIG. 22 shows a block diagram of the control program 1012. The control program 1012 accepts data from the analog scan program 1116, the sequence of events interrupt program 1124 and is controlled in certain respects by the logic program 1110 and the auxiliary synchronizing program 1114. The control program 1012, upon receiving appropriate inputs, computes the throttle valve TV1–TV4 and the governor valve GV1–GV8 outputs needed to satisfy speed or load demand.

The control program 1012 of the DEH control system 1100 functions, in the preferred embodiment, under three modes of DEH system control. The modes are manual, where the valves GV1–GV8 and TV1–TV4 are positioned manually through the hardwired control system and the DEH control computer tracks in preparation for an automatic mode of control. The second mode of control is the operator automatic mode, where the valves GV1–GV8 and TV1–TV4 are positioned automatically by the DEH computer in response to a demand signal entered from the keyboard 1130, of FIG. 8. The third mode of control is remote automatic mode, where the valves GV1–GV8 and TV1–TV4 are positioned automatically as in the operator automatic mode but use the automatic turbine startup program 1141 or an automatic synchronizer or an automatic dispatch system for setting the demand valve.

SELECT OPERATING MODE FUNCTION

Input demand values of speed, load, rate of change of speed, and rate of change of load are fed to the DEH control system 1100 from various sources and transferred bumplessly from one source to another. Each of these sources has its own independent mode of operation and provides a demand or rate signal to the control program 1020. The control task 1020 responds to the input demand signals and generates outputs which ultimately move the throttle valves TV1 through TV4 and/or the governor valves GV1 through GV8.

With the breaker 17 open and the turbine 10 in speed control, the following modes of operation may be selected:

1. Automatic synchronizer mode — pulse type contact input for adjusting the turbine speed reference and speed demand and moving the turbine 10 to synchronizing speed and phase.

2. Automatic turbine startup program mode — provides turbine speed demand and rate.

3. Operator automatic mode — speed, demand and rate of change of speed entered from the keyboard 1860 on the operator's panel 1130 shown in FIG. 8.

4. Maintenance test mode — speed demand and rate of change of speed are entered by an operator from the keyboard 1860 on the operator's control panel 1130 of FIG. 8 while the DEH system 1100 is being used as a simulator or trainer.

5. Manual tracking mode — the speed demand and rate of change of speed are internally computed by the DEH system 1100 and set to track the manual analog back-up system 1016 as shown in FIG. 4 in preparation for a bumpless transfer to the operator automatic mode of control.

With the breaker 17 closed and the turbine 10 in the level mode control, the following modes of operation may be selected:

1. Throttle pressure limiting mode — a contingent mode in which the turbine load reference is run back or decreased at a predetermined rate to a predetermined, minimum value as long as a predetermined condition exists.

2. Run-back mode — a contingency mode in which the load reference is run back or decreased at a predetermined rate as long as a predetermined condition exists.

3. Automatic dispatch system mode — pulse type contact inputs are supplied from an automatic dispatch system to adjust turbine load reference and demand when the automatic dispatch system button 1870 on the operator's panel 1130 is depressed.

4. Operator automatic mode — the load demand and the load rate are entered from the keyboard 1830 on the control panel 1130 in FIG. 8.

5. Maintenance test mode — load demand and load rate are entered from the keyboard 1860 of the control panel 1130 in FIG. 8 while the DEH system 1100 is being used as a simulator or trainer.

6. Manual tracking mode — the load demand and rate are internally computed by the DEH system 1100 and set to track the manual analog back-up system 1016 preparatory to a bumpless transfer to the operator automatic mode of control.

The select operating mode function responds immediately to turbine demand and rate inputs from the appropriate source as described above. This program determines which operating mode is currently in control by performing various logical and numerical decisions, and then retrieves from selected storage locations the correct values for demand and rate. These are then passed on to the succeeding DEH control programs for further processing and ultimate positioning of the valves. The select operating mode function also accommodates switching between operating modes, accepting new inputs and adapting the DEH system to the new state in a bumpless transfer of control.

Various contact inputs are required for raise and lower pulses, manual operation, maintenance test, and so forth; these are handled by the SEQUENCE OF EVENTS interrupt program and the PLANTCCI subroutine, which performs a contact input scan. In addition, certain panel pushbuttons affect the operating mode selection; these are handled by the PANEL INTERRUPT program and the PANEL task, which decode and classify the pushbuttons pressed. The LOGIC task then checks all permissive conditions and current control system status, and computes the appropriate logical states for interpretation by the CONTROL task and the SELECT OPERATING MODE program.

Figure 23:
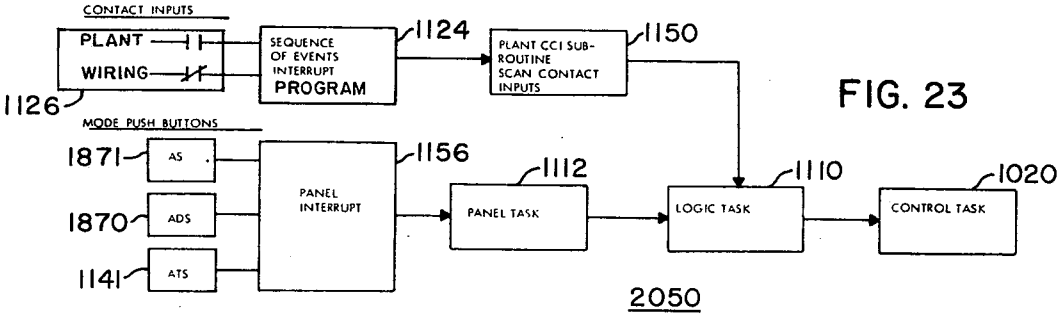
FIG. 23 shows a block diagram of an operating mode selection function which is operable in accordance with the principles of the invention.

Referring now to FIG. 23, a block diagram is shown illustrating the select operating mode function 2050.

Contact inputs from plant wiring 1126 activate the sequence of events interrupt program 1124 which calls the plant contact input subroutine 1150, to scan the plant wiring 1126 for contact inputs. Mode pushbuttons such as automatic turbine startup 1141, automatic dispatch system 1170 and automatic synchronizer 1871 activate the panel interrupt program 1156 which calls the panel program 1112 for classification and which in turn calls upon the logic program 1110 to compute the logic states involved. The logic program 1110 calls the control program 1020 to select the operating mode in that program.

Figure 24A:
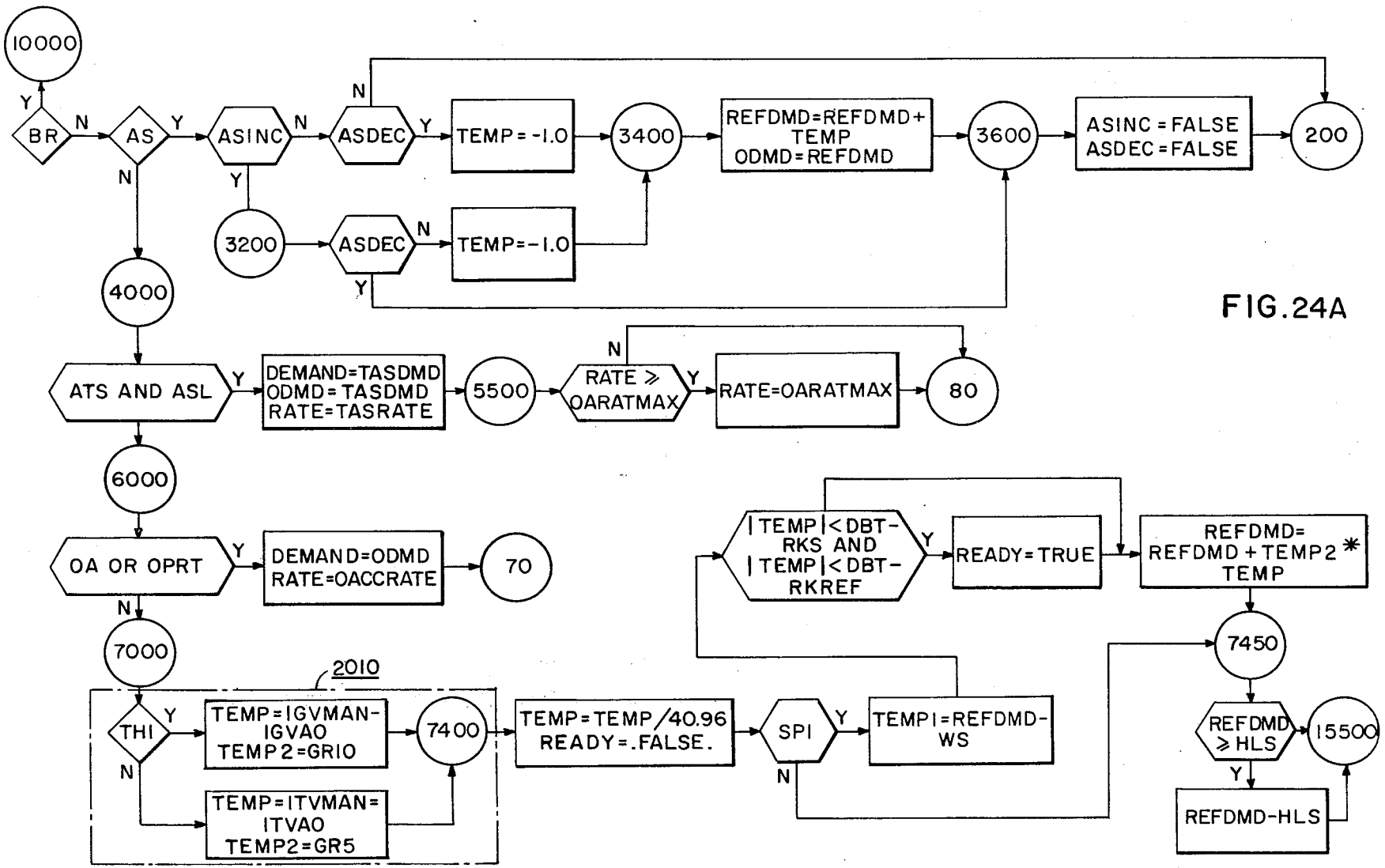
FIGS. 24A and 24B show a flow chart of a select operating mode function which is operable in accordance with the principles of the invention.
Figure 24B:
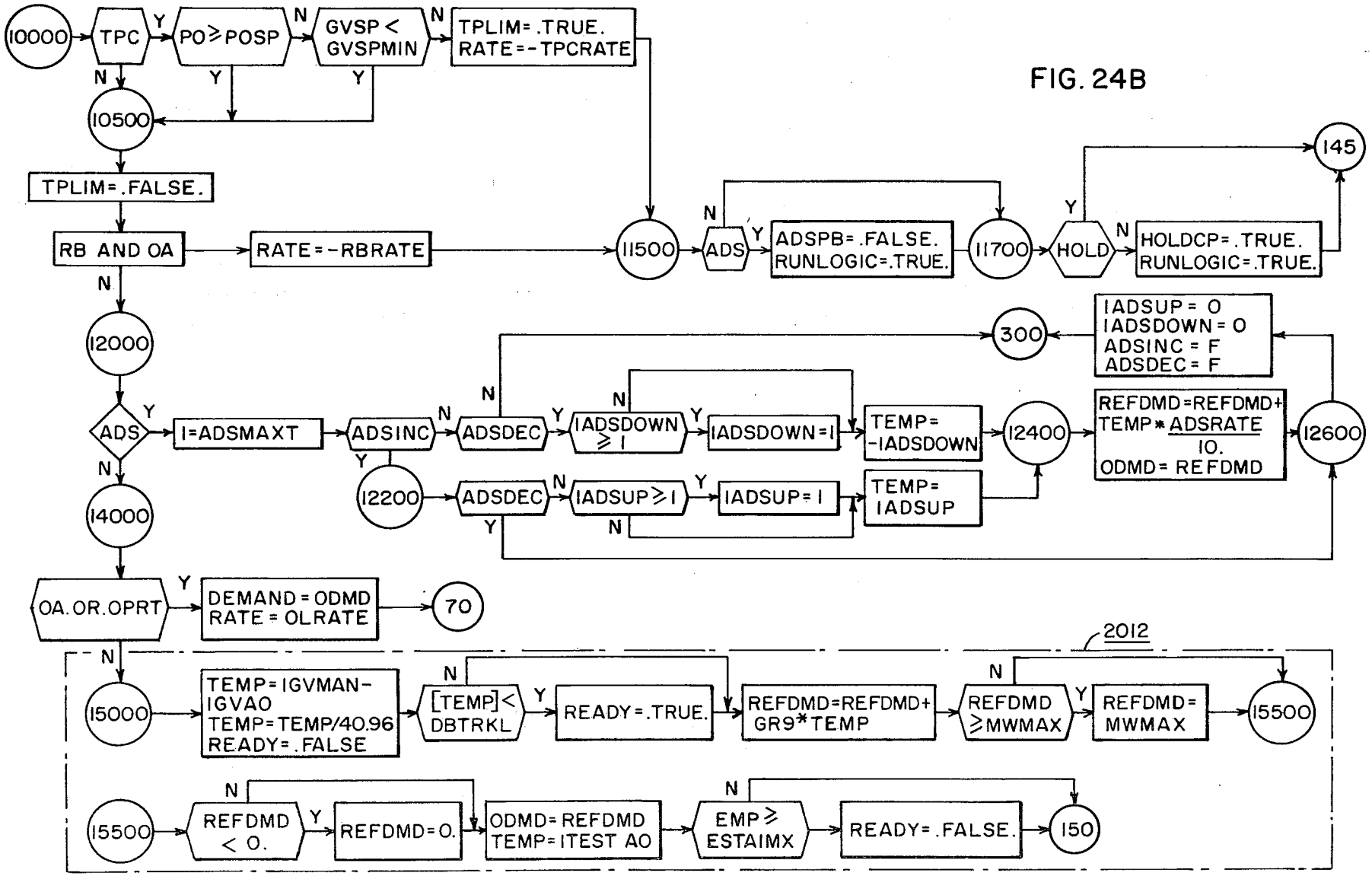

In FIGS. 24A and 24B a flow chart of the select operating mode logic is shown. As one example of mode selection referring to a path 2023, after a statement 7000, provisions are made for a bumpless transfer from an automatic or test mode to an operator mode. The bumpless transfer is accomplished by comparing the computer outputs and the operator mode output signals for the governor valve GV1–GV4 positions. The DEH system 1110 inhibits any transfer until the error between the transferring output and the output transferred is within a predetermined deadband (DBTRKS). Bumpless transfer is accomplished by the DEH control system 1100 by comparing output from one mode of control of the governor valves GV and the throttle valves TV and the same output from another output mode controlling the same parameters. The flow chart of FIGS. 24*a* and 24B shows mode selection for a complete operating system. In a hardwired or analog control system, the analog parameter output, to be transferred to must continuously track the parameter output to be transferred from. This tracking method is expensive and cumbersome since it has to be done continuously and requires complex hardware. However, in a digital system, such as the DEH control system 1100, the equating of the two parameter outputs need be performed only on transfer. Therefore, great economy of operation is achieved.

SPEED/LOAD REFERENCE FUNCTION

Figure 25:
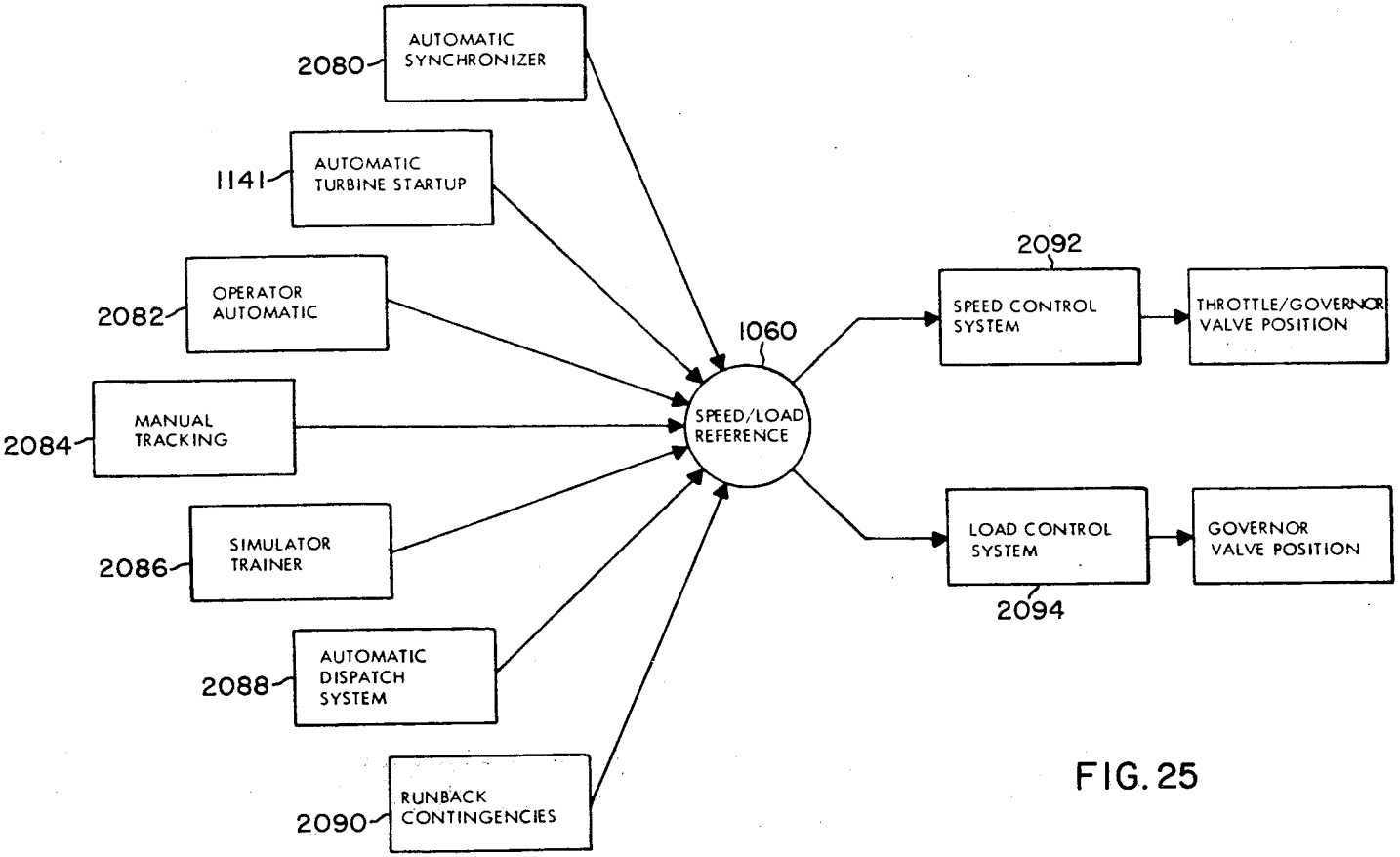
FIG. 25 shows a symbolic diagram of the use of a speed/load reference function which is operable in accordance with the principles of the invention.
Figure 26:
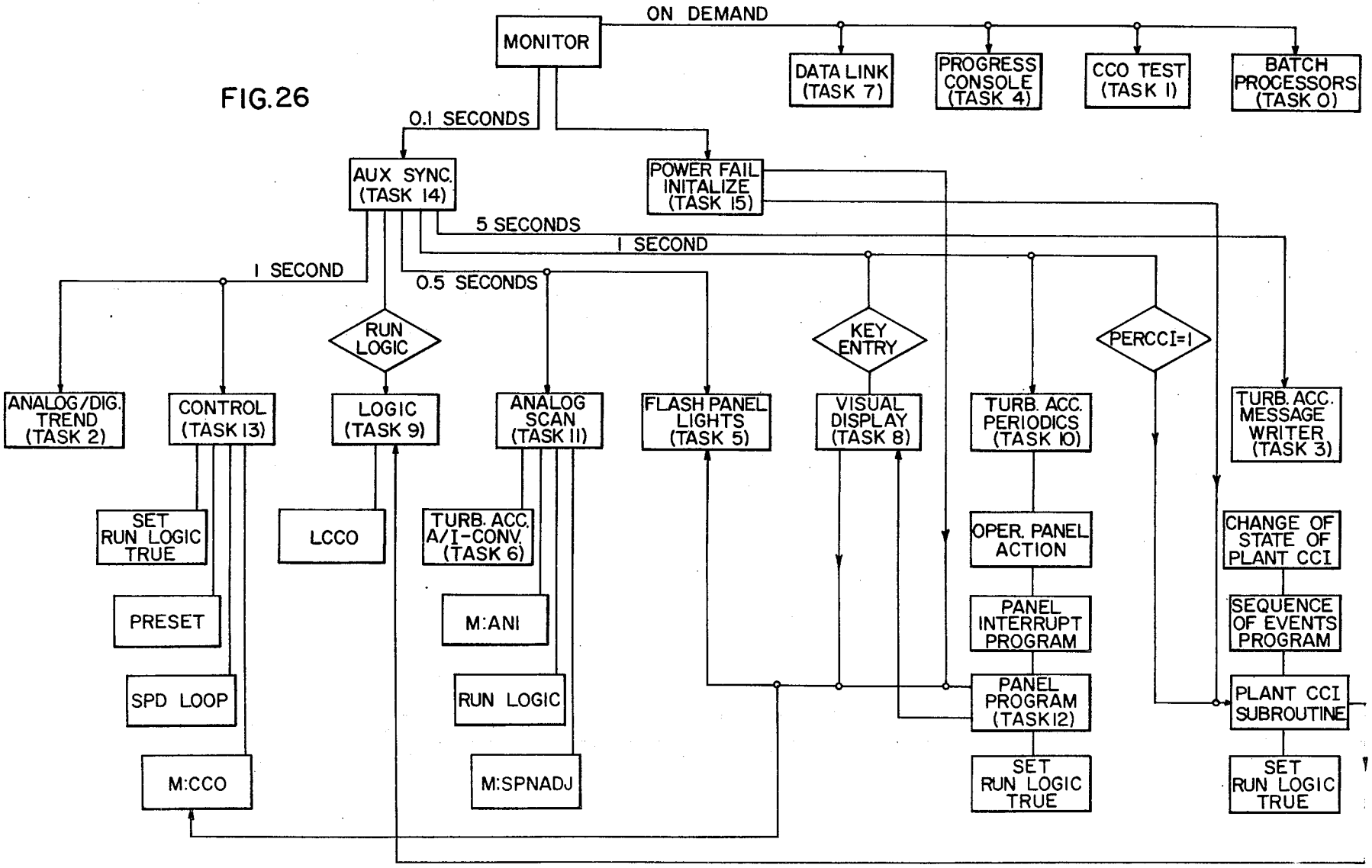
FIG. 26 shows a block diagram of the Digital Electro Hydraulic System which is operable in accordance with the principles of the invention.

In the DEH turbine controller, the speed/load reference is the central and most important variable in the entire control system. The reference serves as the junction or meeting place between the turbine speed or load demand, selected from any of the various operating modes discussed in the last section, and the Speed or Load Control System, which directs the reference through appropriate control system strategy to the turbine throttle and governor valves to supply the requested demand. FIG. 25 is a diagram which indicates the central importance of the reference in the DEH control system.

The speed/load reference function increments the internal turbine reference at the selected rate to meet the selected demand. This function is most useful when the turbine is on Operator Automatic, on the AUTOMATIC TURBINE STARTUP program, or in the Simulator/Trainer modes. This is because each of these control modes requests unique rates of change of the reference, while the remaining control modes, such as the Automatic Synchronizer and the Automatic Dispatch System, move the reference in pulses or short bursts which are carried out in one step. The Runback and Throttle Pressure contingency modes use some of the features of the reference function, but they bypass much of the subtle reference logic in their hurry to unload the turbine.

For these modes which request movement of the reference at a unique rate, the reference function must provide the controlled motion. Not only must the rate be ramped exactly, but the logic must be such that, at the correct time, the reference must be made exactly equal to the demand, with no overshoot or undershoot. In addition, the reference logic must be sensitive to the GO and HOLD lamps, if conditions dictate, by passing on to the LOGIC task the proper status information to accomplish this important visual indication feature.

The decision breaker function 1060, of FIG. 5, is identical to the speed/load reference function 1060, of FIG. 25. A software speed control subsystem 2092 of FIG. 25, corresponds to the compare function 1062, the speed reference 1066 and the proportional plus reset controller function 1068, of FIG. 5. The software load control subsystem 1094, of FIG. 25, corresponds to the rated speed reference 1074, the turbine speed 1076, the compare function 1078, the proportional controller 1080, the summing function 1972, the compare function 1082, the proportional plus reset controller function 1084, the multiplication function 1086, the compare function 1090, the impulse pressure transducer 1088 and the proportional plus reset controller 1092, of FIG. 5. The speed/load reference 1060 is controlled by, depending upon the mode, and automatic synchronizer 1080, the automatic turbine starter program 1141, and operator automatic mode 1082, a manual tracking mode 2084, a simulator/trainer 2086, an automatic dispatch system 2088, or a run-back contingency load 2090. Each of these modes increments the speed/load reference function 1060 at a selected rate to meet a selected demand. A typical demand/reference rate is shown in demand.

DEH DATALINK

A DEH DATALINK shown in FIG. 6 allows the DEH control system 1100 to communicate with other computers such as a plant computer. In the preferred embodiment, the communication is initiated by the other computer, the plant computer. The DEH DATALINK waits for requests to send or receive information. In the operation of the DEH DATALINK any core location can be interrogated and numerous setpoint values can be changed. The format of the DATALINK is such that information as to a starting address in the memory 214, and a code indicating the number of words to be interrogated or changed. The following eight-bit control words are used for DATALINK transmission and reception.

| CONTROL-WORD SYMBOL | 8-BIT PATTERN | HEXADECIMAL AQUIVALENT | Meaning |
|---|---|---|---|
| DAT | $0011\ 1010_2$ | $3A_{16}$ | DATA Transmission Mode |
| SPT | $00111011_2$ | $3B_{16}$ | SETPOINT-Transmission Mode |
| ACK | $00000110_2$ | $06_{16}$ | ACKNOWLEDGE-Word |
| NAK | $10010101_2$ | $G5_{16}$ | NOT ACKNOWLEDGE Work |
| ENQ | $00000101_2$ | $05_{16}$ | ENQUIRY to DEH |
| ETX | $00000011_2$ | $03_{16}$ | END of Message |
| STX | $10000010_2$ | $82_{16}$ | ANSWER from DEH |
| CSF | $10010110_2$ | $96_{16}$ | CHECKSUM |

-continued

| CONTROL-WORD SYMBOL | 8-BIT PATTERN | HEXADECIMAL AQUIVALENT | Meaning |
|---|---|---|---|
| SAF | $10010111_2$ | $97_{16}$ | Failure SETPOINT ADDRESS |
| SVF | $10011000_2$ | $98_{16}$ | Failure SETPOINT VALUE Failure |

For an absolute starting address in core to transmission words are used indicating the number of transmission words in one transmission. In the sequencing charts 8-bit numbers are represented by the following symbols:

| | |
|---|---|
| ADD | First half of absolute core address |
| REF | Second half of absolute core address |
| WDS | Number of transmission words |
| W1, W2, ..... | Transmitted information |
| LIC | Checksum |

The checksum is the binary sum of all 8-bit numbers of a data transmission with any remainder truncated. The hardware for the DEH DATALINK is operated asynchronously. A message can be transmitted at any time for the plant computer. The interrupt program 1124 is provided so that the plant computer can be serviced immediately.

In the DATALINK between two computers, a modem transmission system, available through the Bell Telephone Company, provides for data transmission. The sequence of events interrupt program 1124 directs the computer 210 to execute one or more instructions in a sequence thereby interrupting any program running in the computer 210. When the interrupt program 1124 has finished, the computer 210 returns to complete the program which it was previously executing.

A DATALINK task shuttles any received data words into an input buffer in the memory 214 and thereby through the action of the central processor 212 generates the checksum which is compared with a received checksum. The data from the DEH system is transmitted in a checksum calculated at both the plant computer and the DEH computer 210. If a mistake is found an alarm interrupt is generated and a control word indicating an error is sent back and no further action is taken. The plant computer or requesting computer must then send the same message again for a second reply. If the interrupt program receives a proper message request, a DEH DATALINK task is energized again. A complete program of the DATALINK System is to be found in the appendices.

E. ANALOG BACKUP SYSTEM

The analog backup portion of the DEH Control System provides a second means, independent of the digital portion, of controlling the turbine valves. In the event of a failure in the digital portion, or during certain maintenance modes of operation, the Analog Backup System generates the signals necessary to control the valves, and thus the turbine.

While the digital portion of the control system is in service and in control of the turbine (the Operator Automatic mode), the analog system tracks the digital control signals. If the digital portion fails, or manual operation is selected, the DEH Control System transfers to the Analog Backup System without a change in valve position (bumpless transfer). When the analog portion is supplying the control signals (the Turbine Manual mode), the operator controls valve position using the manual pushbuttons on the Operator B Panel.

In addition to tracking and positioning capabilities, the Analog Backup System provides protection circuits. This protection capability is used during contingency conditions, and duplicates similar protection provided by the digital portion of the DEH Control System. Thus, the operator is provided with an effective means of operating the turbine during a contingency condition or during maintenance or testing of the system.

Modes Of Operation

In the Turbine Manual mode of operation, the operator controls the turbine using the Analog Backup System. The mode of operation (Operator Automatic or Turbine Manual) of the DEH Control System is determined by the state of a flip-flop (the Turbine Manual flip-flop). When this flip-flop is reset, the Analog Backup System is controlling the turbine (Turbine Manual mode). When the Turbine Manual flip-flop is set, the Digital Controller is controlling the turbine (Operator Automatic mode) and the Analog Backup System is tracking the Digital System.

If the Analog Backup System is in control, the operator must press the OPER AUTO button on the Operator B Panel to transfer to the Operator Automatic mode of operation (flip-flop is set). At the same time, however, a permissive generated by the digitial portion must be maintained. If an internal failure in the digital portion causes the permissive to be absent, the DEH Control System remains in Turbine Manual even if the OPER AUTO button is pressed.

The Turbine Manual flip-flop can be reset (the DEH Control System goes from the Operator Automatic to the Turbine Manual mode) in several ways. If the operator presses the TURBINE MANUAL button on the Operator B Panel, th DEH Control System is placed in the Turbine Manual mode. Also, a contact closure generated by the digital portion (indicating a failure in the digital portion) causes the system to be placed in the Turbine Manual mode. In the event of a power supply failure in the digital portion, a contact closure is generated which resets the Turbine Manual flip-flop (Turbine Manual mode).

LOGIC TASK

Operation Automatic Logic

The state of manual or automatic operation of the DEH system is actually determined by circuitry in the analog backup system, and the DEH programs simply respond to these states. When the DEH system is in manual control, the analog backup system ignores the computer output signals and positions the valves according to its up/down counter circuitry. Conversely, when the DEH system is in automatic control, the analog backup system uses the computer outputs to position the valves and adjusts its up/down counter to track the computer outputs.

When transfer is made to manual, either by pushbutton or computer request, the analog backup system opens contacts carrying the computer outputs to the valves and simultaneously closes contacts carrying backup system outputs to the valves. In addition, a contact input is sent to the DEH system LOGIC task indicating manual operation. When transfer is made to automatic control by pressing the OPERATOR AUTOMATIC pushbutton, and assuming that the computer system is tracked and ready for automatic, the analog backuo system opens contacts carrying its own signals to the valves and simultaneously closes contacts carrying the computer outputs to the valves. The operator automatic logic thus merely updates internal computer variables to the state of manual or automatic control as determined by the backup system.

In updating the DEH system programs to the existing control state, the internal operator automatic variable (OA) is set to the logical inverse of the manual contact input represented by TM. Then a decision is made to determine if the system has just been switched to automatic by comparing OA and its last value (OAX). If automatic has just occurred, ready tracking flags are reset; if not, no action is taken. In either case, the last value (OAX) is set to the current automatic state (OA) for use in the next bid of the LOGIC task.

Go Logic

When the DEH system is on operator automatic control, the turbine speed/load (DEMAND) is entered from the keyboard. The operator then may allow the turbine reference to adjust to the demand by pressing the GO pushbutton. When the operator does this, the GO lamp is turned on and logical states are set to begin moving the reference in the CONTROL task. When the reference equals the demand, the GO lamp is turned off. The GO logic detects the various conditions affecting the GO state and sets the status and lamp accordingly.

The GO pushbutton (GOPB), which is updated by the PANEL task, is the set signal for the GO flip-flop. The reset or clear signal, which will override the set signal, can occur from a number of different conditions as follows: the HOLD pushbutton (HOLDPB) as updated by the PANEL task, a computed hold condition (HOLDCP) as set by the CONTROL or LOGIC tasks, the DEH system not being in operator automatic control (OA) or in the maintenance test condition (OPRT) (during which the system may be used as a simulator/trainer), or the condition in which the reference has reached the demand and the CONTROL task sets the GOHOLDOF state to clear the GO lamp.

Hold Logic

When the DEH system is an operator automatic control, the turbine speed/load (DEMAND) is entered from the keyboard. The operator may then inhibit the turbine reference from adjusting to the demand by pressing the HOLD pushbutton. When the operator does this, the HOLD lamp is turned on and logical states are set to prohibit the reference from moving in the CONTROL task. The HOLD logic detects the various conditions affecting the HOLD state and sets the status and lamp accordingly.

The HOLD pushbutton state (HOLDPB), which is set by the PANEL task, or the hold state (HOLDCP) computed by the CONTROL or LOGIC tasks, acts as the set signal for the HOLD flip-flop. The reset or clear signal, which will override the set signal, can occur from a number of different conditions as follows: the DEH system not being on operator automatic control (OA) or in the maintenance test condition (OPRT) (during which the system may be used as a simulator/trainer), the GO flip-flop being set and thus overriding the HOLD state, or the condition in which the reference has reached the demand and the CONTROL task sets the GOHOLDOF state to clear the HOLD lamp. The HOLD logic program then resets the computed hold state (HOLDCP) and the GOHOLDOF state, so that they may be used in future decisions by the CONTROL and LOGIC tasks.

Governor Control Logic

Control of turbine steam flow with the governor valves is required during speed and load control. Normally governor control is initiated when the turbine has been accelerated by near synchronous speed, after which the unit is brought up to synchronous speed, synchronized and then loaded with the governor valves as the normal mode of operation.

The governor control logic detects turbine latch and unlatching conditions, transfer from throttle valve to governor valve control, and manual operation of the governor valves. When any of these conditions occur, the governor logic must align the DEH system to the appropriate governor control state.

The governor control flip-flop (GC) may be set by a number of conditions, the most common of which occurs on automatic control when the operator presses the transfer TV/GV pushbutton (TRPB). Assuming that the governor valves are at their maximum open position as indicated by GVMAX and that the automatic turbine startup mode (ATS) is not selected, then the governor flip-flop will be set. An alternate path for setting this flip-flop occurs if the automatic turbine startup program (ATS) requests transfer via the logical variable ATSTRPB. In addition, when the throttle valves reach about 90 percent position, a contact input (THI) is activated by the analog backup system, and this contact sets the GC flip-flop. This last case occurs when the turbine is a manual control. Finally, the governor control flip-flop is reset when the turbine latch contact input (ASL) is released.

Following the GC flip-flop, a decision is made to determine if the system has just switched to governor control by comparing GC with its last state (GCX). If transfer has just occurred, the turbine speed (WS) at this instant is saved as WSTRANS, the speed at throttle/governor valve transfer. This value is used in the CONTROL task for a special valve position control logic decision. The last operation in the governor control program is to call the LCCO subroutine to update the GC lamp.

Throttle Valve Control Logic

Control of turbine steam flow with the throttle valves is required when the turbine is initially rolled and during speed control up to the point of transfer to governor valve control. After this the throttle valves are kept wide open during normal operation. The throttle control logic detects turbine latch and unlatching conditions, transfer from throttle to governor valve control, and manual operation of the throttle valves. When any of these conditions occur the throttle logic must then align the DEH system to the appropriate throttle control state.

The throttle control state (TC) is simply the logical inverse of the governor control state (GC) when the turbine is latched. However, the throttle control lamp flipflop (TCLITE) may be set by either TC or by manual operation (TM) while the throttle valves are below 90 percent open as indicated by the contact input (THI) not being set. The TCLITE flip-flop is reset by the contact input (THI) indicating throttle valves wide open or by the turbine latch contact input (ASL) not set.

The throttle control logic also indicates that the transfer from throttle to governor valve state (TRTVGV) is underway when governor control (GC) exists but the throttle valves are not yet wide open. In addition, the transfer complete state (TRCOM) is set when the throttle valves are wide open on governor control as indicated by THI. Finally, the program sets various contact outputs to pass this information on to the plant and operating personnel by calling the LCCO subroutine.

Turbine Latch Logic

Before the turbine can be rolled and accelerated, it must be mechanically latched; this means the hydraulic fluid system must be prepared to move the throttle and governor valves, and a series of safety features as described in the turbine instruction book must be satisfied. After the turbine is latched, if unlatching should occur at any future time during speed or load control, then the control system must trip the turbine and close all valves immediately. The turbine latch logic detects latching or unlatching, and instantly sets the turbine reference and the control system to the proper states. A decision is made to determine if the turbine has just unlatched by comparing the current latch state (ASL) with the last state (ASLX). If unlatched has just occurred, then the DEH turbine reference given by REFDMD, the demand given by ODMD, and the speed integral controller given by RESSPD are immediately reset to zero. If the turbine has not unlatched, then a decision is made to determine if the turbine has just latched by a similar comparison of ASL and ASLX. If the unit has just latched, the DEH reference (REFDMD) and demand (ODMD) are set to the existing speed so that the control system may "catch the unit on the fly" should it be decelerating. The speed integral controller (RESSPD) is set to a zero value, from which point the control system will act to control the throttle valves.

AUTOMATIC DISPATCH LOGIC

The automatic dispatch flip-flop (ADS) may be set by the automatic dispatch button (ADSPB), which is updated by the PANEL program, providing the unit is on automatic control (OA), the breaker (BR) is closed, and the automatic dispatch permissive contact input (ADSPERM) is set. Otherwise the ADS flip-flop will be reset. Decisions then are made to determine if the ADS flip-flop has just come on. If ADS just came on, the temporary variable (T3) is set to indicate a remote control transfer for later logic programs. Then a call is made to the LCCO subroutine to set the ADS lamp to the correct state; arguments in the call consist of the current state of ADS, the last state (ADSX), the automatic dispatch button (ADSPB) which must be aligned with the ADS flip-flop, and a pointer (N10) to a table of contact output words and bits which define connection to the ADS lamp.

Additional decisions must be made in the ADS logic program, when the ADS mode has been selected, to detect whether the ADS equipment is sending raise or lower pulses to the DEH system. Thus if the leading edge of the ADSUP contact input pulse has just come on, then a flip-flop (CADSUP) is set to start a counter which is handled by the AUX SYNC program. As long as CADSUP is set the AUX SYNC will count in 1/10 sec increments, thus determining the length of time the raise pulse is on. When the trailing edge of the ADSUP contact input pulse is detected, this means the raise contact has been released; this then resets the CADSUP flip-flop and the AUX SYNC program will stop counting. Finally, a logical state (ADSINC) is set so that the CONTROL task may raise the turbine reference by an amount proportional to the CADSUP counter. Identical checks and logical decisions are made with respect to the ADS lower contact input (ADSDOWN), after which last values of both ADSUPX and ADSDOWNX are updated with the current state of ADSUP and ADSDOWN in preparation for future bids of the LOGIC task.

REMOTE TRANSFER LOGIC

To transfer from operator automatic to a remote mode, the operator simply presses the appropriate pushbutton on the Operator's Panel. Then, assuming all permissive conditions as described elsewhere in this writeup are satisfied, the new mode will be selcted with a bumpless transfer in which the turbine valves remain at the existing position. In addition, a lamp behind the pushbutton selected will be turned on and the lamp for the previous mode will be turned off. Conversely, in order to return from any remote mode to operator automatic, the operator simply presses the OPER AUTO pushbutton. The remote transfer logic program detects operating mode changes and updates the panel lamps according.

As shown in FIG. 18, the temporary logical variable (T3), which has been updated in earlier portions of the logic program, is checked to determine if any remote state has been selected. If so, the operator demand (ODMD) is set equal to the current reference (REFDMD), the logical flags are set to run the LOGIC task again to set the appropriate conditions in the DEH system. Then the status of the operator automatic lamp (OALITE) is determined since a remote control mode selection must result in turning off this lamp. Finally, a call to the LCCO subroutine is made to place this lamp in the proper state.

PANEL TASK

The PANEL task is assigned priority level $C_{16}(12_{10})$ and is bid by the PANEL INTERRUPT program when a button is pressed.

FIG. 20 shows a block diagram of the major functions performed by the PANEL task. These include executing each of the button group functions discussed above, as well as additional decisions, checks, and bookkeeping necessary to properly perform the action requested by the operator.

Button Decode

The BUTTON DECODE program examines the button identification (IPB) provided by the PANEL INTERRUPT program, and transfers to the proper location in the PANEL task to carry out the action required by this button. The program also does some bookkeeping checks necessary to keep the panel lamps in the correct state. A total of 54 buttons can be decoded in the current version of the DEH PANEL task.

The identification of the last button (IPBX), which had been pressed and which has associated with it a visual display mode lamp, is stored in a temporary integer location (JJ) for later use in turning off the last lamp. Then the current button identification (IPB) is checked to determine if it represents the ENTER pushbutton; if so, a special logical variable ENTERB is reset for later use should the ENTER button be pressed two or more consecutive times. This has been found to be a rather common operator error and is flashed as an invalid request. The program then simply executes a FORTRAN computed GO TO statement and transfers to the appropriate portion of the PANEL task.

Control System Switching

There are six buttons on the Operator's Panel which may switch control states of the DEH system. A brief description of each follows:

1. TRANSFER TV/GV - This button initiates a transfer from throttle valve to governor valve control during wide-range speed operation. The pushbutton has a split lens. When control is on the throttle valves, the upper half of the lens is backlighted. When the button is pressed, to transfer control, the entire lens is backlighted. At the completion of the transfer, only the bottom half of the lens remains on. Once the DEH system is on governor control, it stays in this mode until the turbine is tripped and relatched. At this time, it is again in throttle valve control.

2. IMPULSE PRESSURE FEEDBACK IN/OUT - This is a pushpush button with split lens. It places the impulse pressure feedback loop in or out of service, with appropriate backlighting of the button lens.

3. MEGAWATT FEEDBACK IN/OUT - This is a push-push button with split lens. It places the megawatt feedback loop in or out of service, with appropriate backlighting of the button lens.

4. SPEED FEEDBACK IN/OUT - This split lens button places the speed feedback loop in service in the DEH system. Normally the speed loop is always in service; however, when the DEH CONTROL task detects a speed channel failure condition in which all speed input signals are unreliable, the speed feedback loop is disabled and the speed channel monitor lamps turned on. When the speed inputs become reliable, the monitor lamps are turned off, thus indicating to the operator that he may place the speed feedback loop back in service. As long as the speed signals are reliable, the operator cannot take the speed loop out of service.

5. THROTTLE PRESSURE CONTROL IN/OUT - This is a pushpush button with split lens which places the throttle pressure controller in or out of service, with appropriate backlighting of the lens.

6. CONTROLLER RESET - The button restores the DEH system to an active operating state after the computer has been stopped due to a power failure or hardware/software maintenance.

The logical variable TRPB is set when the TRANSFER TV/GV button is pressed. The impulse pressure, megawatt, and throttle pressure logical states (IPIPB, MWIPB and TRCPB respectively) are set to the logical inverse of their previous state when the corresponding buttons are pressed. This is the mechanism which provides the push-push nature of these buttons. The logical variable SPIPB is set when the speed feedback button is pressed. Finally, each of these buttons initiate a bid for the LOGIC task by setting the RUNLOGIC variable prior to exit from the PANEL task.

The CONTROLLER RESET button is handled somewhat differently. The state CRESETPB is set by the STOP/INITIALIZE task, which does cleanup and initialization after a computer stop condition. Then CRESETPB is checked; if it is not set, the computer has been running, and thus the button pressed is ignored. If CRESETPB is set, this means the computer had been stopped; CRESETPB is reset and the lamp behind the button is turned off. In addition, the PANEL task effectively presses the speed feedback button by setting the logical state SPIPB. This is done so that the DEH system restarts after a power failure or other computer stop condition with the speed feedback loop in service. The LOGIC task is requested to run by setting the RUNLOGIC state. The REFERENCE display button is also effectively pressed so that the display windows always start out in the same mode after a stop condition on the computer.

Display/Change DEH System Parameters

Eight buttons allow the operator to display or change various DEH system parameters. Six of these buttons are dedicated to the display or change of a single important parameter for each button. The remaining two buttons provide the ability to display or change a group of DEH system variables from each button. In addition, two special buttons (GO and HOLD) are intimately associated with one of the dedicated display/change buttons, and thus are also included in this discussion.

Before listing each of these buttons, a brief description of the display window mechanism is given. The DEH Operator B Panel contains two digital displays which are provided with five windows each. The left display, labeled REFERENCE, has two major functions. It either presents numerical information which currently exists in computer memory for the six dedicated buttons mentioned above, or it accepts address inputs from the keyboard for the two buttons assigned to display or change groups of DEH system variables. The right display, labeled DEMAND, also has two major functions. It either accepts keyboard inputs in preparation for changing any of the currently existing numerical information in computer memory for the six dedicated buttons mentioned above, or it presents currently existing information in computer memory for the two buttons assigned to display or change groups of DEH system variables.

Of the five windows in each digital display, the leftmost is reserved for mnemonic characters. These characters combine to form a short message identifying the numerical quantity in the remaining four windows. The following table lists the 11 available messages and an explanation of each. The four right windows in each display provide the numerical digits 0 through 9 and a decimal point where appropriate.

MNEMONIC CHARACTER DEFINITION

| Message | Explanation |
|---|---|
| MW | Megawatt Symbol for Load Control |
| SPEED | Speed Symbol for Speed Control |
| % VALVE POSITION | Percent Valve Position for Valve Status |
| RPM/MIN | Acceleration Rate |
| MW/MIN | Load Rate |
| SYS PAR | General DEH System Parameter |
| IMP PRESS % | Impulse Pressure in Percent For Load Control |
| PRESS | General Pressure Variable |
| TEMP | General Temperature Variable |
| VALVE NO. | Valve Identification for Valve Status |
| – | Algebraic Negative Quantity |

A brief description of the eight buttons associated with display/change as well as the GO and HOLD buttons, follows:

1. REFERENCE - This button initiates a display or change of the DEH reference and demand for speed or load operation. When the turbine is on operator automatic control, new demand values may be entered from the keyboard. However, when the turbine is in a remote operating mode such as automatic synchronizer, dispatch or ACCELERATION program, the demand cannot be changed from the keyboard. Any attempt to do so is flashed as an invalid request.

2. ACCELERATION RATE - This button initiates as display or change of the acceleration rate used on wide-range speed operation. When the turbine is on operator automatic control, this value is entered by the operator, and may be changed from the keyboard. However, when the turbine is being accelerated by an AUTOMATIC STARTUP program, the displayed value is the rate selected by this program and cannot be changed from the keyboard. Any attempt to do so is flashed as an invalid request.

3. LOAD RATE - This button initiates a display or change of the load rate used on operator automatic control. This value may be displayed or changed at any time.

4. LOW LIMIT - This button is an optional feature which initiates a display or change of the low load limit used on all automatic load control modes. This value may be displayed or changed at any time.

5. HIGH LIMIT - This button is an optional feature which initiates a display or change of the high load limit used on all automatic load control modes. This value may be changed at any time.

Each of these buttons have high or low limits, whichever is appropriate, associated with them when changes are to be made in the values discussed above. Violation of these limits from a keyboard entry is flashed as an invalid request and the entry is ignored. More details of these limits are discussed in a later section where the KEYBOARD program is described.

6. VALVE POSITION LIMIT - This button initiates a display of the governor valve position limit and the quantity being limited. Change or adjustment of the valve position limit is accomplished by raise/lower buttons (described in a later section where the valve buttons are discussed. Any attempt to enter values from the keyboard in this display mode is flashed as an invalid request.

7. VALVE STATUS - This button initiates a display of the status (position) of the turbine throttle and governor valves. Thus, this button is associated with a group of DEH system variables. A description of the steps necessary to carry out this display function is given in later paragraphs (where the valve buttons are discussed).

8. TURBINE PROGRAM DISPLAY - This button initiates a display or change of any DEH system parameter not otherwise addressable with one of the unique buttons described above. These variables include pressures, temperatures, control system tuning constants, and calculated quantities in all parts of the DEH system. A dictionary is provided so that the address of such quantities may be entered from the keyboard. Further discussion of these points is given in later paragraphs where the keyboard is described.

9. GO - This button initiates a special DEH CONTROL program to adjust the turbine reference. The program ultimately positions the valves on operator automatic control. The reference then moves at the appropriate load or acceleration rate until the reference and demand are equal. The updated reference value is continually displayed in the REFERENCE windows so that the operator may observe it changing to meet the demand, which is displayed in the DEMAND windows.

10. HOLD - This button interrupts the reference adjustment process described above, and holds the reference at the value existing at the moment the HOLD button is pressed. In order to continue the adjustment process on the reference, the operator must press the GO button.

A brief description of the steps necessary to display or change any of the first six variables discussed above follows; description of cases 7 and 8 are withheld until a later section. When the operator wishes to display or change any of the DEH dedicated system parameters, he must execute a sequence of steps which result in the desired action. The steps are listed as follows:

1. The operator presses the appropriate button; the DEH programs display the current value of the parameter in the reference windows while the demand windows are cleared to allow for possible keyboard entry.

2. If the operator wishes only to observe the parameter value, then he does nothing else. The value remains in the reference windows until some new button is pressed.

3. If the operator wishes to change the parameter, he types in on the keyboard the new value which he desires. This is displayed in the DEMAND windows, but will not yet be entered into the DEH programs.

4. If the operator is satisfied with the new value as it appears in the demand windows, he may enter the new quantity into the DEH operating system by pressing the ENTER button. The ENTER button is described in more detail in a later section on the keyboard.

5. If for any reason the operator is not satisfied with the value as it appears in the demand windows, he may press the CANCEL button. The CANCEL button will be described in more detail in a later section on the keyboard. This removes the number from the DEMAND windows and allows the operator to begin a new sequence for the parameter.

6. Assuming that the operator is satisfied with the number and that he presses the ENTER button, the new value of the parameter appears in the REFERENCE window and the DEMAND window is cleared. This is an acknowledgment that the DEH programs have accepted the number and are using the new value from that point on.

7. IF for any reason the numerical value entered into the DEH system violates preprogrammed conditions (such as high limits less than low limits), the entire operation is aborted and the INVALID REQUEST lamp is flashed.

The above description of data manipulation is modified somewhat when the operator wishes to display or change the turbine reference and demand. Both of these quantities are displayed when the reference button is pressed. During wide-range speed control, the left REFERENCE display contains the turbine speed reference value, while the right DEMAND display contains the turbine speed demand. During load control the REFERENCE display contains the turbine load reference while the demand display contains the turbine load demand.

Since the reference and demand control the turbine valves directly, it is essential that the operator have a unique handle on these quantities so that he may start or stop reference changes quickly and easily. This is accomplished by use of the GO and HOLD buttons in conjunction with the reference button. The GO and HOLD buttons control two reference states in the DEH system, which indicate whether the reference and demand are equal or unequal. When these quantities are equal, both the GO and HOLD backlights are off. When these quantities are unequal, either the GO or the HOLD lamp is on. If the GO light is turned on, the reference is changing to meet the demand value at the selected rate. Should the operator wish to stop the reference adjustment process, he simply presses the HOLD button. The HOLD button then backlights and holds the reference at its current value. When the operator wishes to start the reference moving again, he must press the GO button, which then backlights and enables the reference to adjust to the proper value.

The sequence of steps for displaying or changing the reference follows:

1. The operator presses the reference button. The DEH programs display the current value of reference in the left windows and the current value of demand in the right windows.

2. If the operator wishes to change the demand, he types the new value on the keyboard. This is displayed in the DEMAND windows, but is not yet entered into the DEH programs.

3. If the operator is satisfied with the new value, he presses the ENTER button. This places the new demand value in the DEH programs and turns the HOLD lamp, assuming that the new demand satisfies certain limit checks to be described shortly. If these conditions are not met, the INVALID REQUEST lamp is flashed, the new value is ignored, and the original value is returned to the DEMAND windows.

4. If the operator is not satisfied with the new value (set in Step 3), he simply presses the CANCEL button. The DEH programs then ignore this value and return the original value to the DEMAND windows.

5. If a new demand is finally entered and the HOLD lamp comes on, the operator may start the reference adjusting to this new demand by pressing the GO button. The HOLD lamp is turned off, the GO lamp is turned on, and the reference begins to move at the selected rate toward the demand.

6. At any time, the operator may inhibit the reference adjustment by pressing the HOLD button. He may then restart the reference adjustment by pressing the GO button.

7. When the reference finally equals the demand both the GO and HOLD lamps will be turned off.

Each of the eight display buttons set the integer pointer (IPBX) to its assigned value and the appropriate panel lamps are turned off and on. IPBX is then checked by the VISUAL DISPLAY task, which selects the numerical values from computer memory and displays then in the windows.

The TURBINE PROGRAM DISPLAY button also resets a few logical states in preparation for keyboard entries. These are discussed in later paragraphs on the keyboard description. The remote control modes AS, ADS and ATS for the Automatic Synchronizer, Dispatch System and TURBINE STARTUP program are checked, along with the manual control state (TM) if the maintenance test switch (OPRT) is not set. All of these modes exclude the possibility of the GO and HOLD buttons being active, so these buttons are ignored in these states and the PANEL program simply exits. However on operator automatic control, the HOLD button state (HOLDPB) is set, or the GO button state (GOPB) is set. In the latter case, HOLDPB is also reset. The LOGIC task is requested to run by setting the RUNLOGIC variable, and the program then exits.

Operating Mode Selection

There are five buttons which may be used to select the turbine operating mode. When any of these are pressed, they initiate major operating changes in the DEH Control System, assuming the proper conditions exist for the mode selected. A brief description of these buttons follows:

1. OPERATOR AUTOMATIC (OPER AUTO) - This button places the turbine in automatic control with the operator providing all demand, rate, and set point information from the keyboard. If the turbine had been previously in manual control, the OPER AUTO lamp must be flashing to indicate that the DEH system is ready to accept automatic control; otherwise pressing the OPER AUTO button is ignored. If the turbine had been in one of the remote control modes listed below, then pressing the OPER AUTO button rejects the remote and returns automatic control to the operator.

2. AUXILIARY SYNCHRONIZER (AUTO SYNC) - This button allows automatic synchronizing equipment to synchronize the turbine generator with the power system by indexing the speed demand and reference with raise/lower pulses, in the form of contact inputs.

3. AUTOMATIC DISPATCHING SYSTEM (ADS) - This button allows automatic dispatching equipment to operate the turbine generator by setting the load demand and reference. A number of dispatching options are available, including raise/lower pulses, raise/lower pulse-width modulation, and analog input values to set the reference.

4. AUTOMATIC TURBINE STARTUP (TURBINE AUTO START) - This button allows a special computer program to automatically start up and accelerate the turbine during wide-range speed control. The program may reside in the DEH computer or it may exist in another computer in the plant or at a remote location.

5. COMPUTER DATA LINK (COMP DATA LINK) - This optional button allows another computer, either in the plant or at a remote location, to provide all demand, rate, and set point information to the DEH system.

The OPER AUTO button resets the remote mode button states (ASPB, ADSPB AND AUTOSTAR) for Automatic Synchronizer, the Automatic Dispatch System, and the AUTOMATIC TURBINE STARTUP program, respectively. Since the operator automatic state (OA) is merely the logical inverse of the turbine manual state (TM), the PANEL task cannot actually set OA, but can only request the LOGIC task to run, by setting the RUNLOGIC variable. The LOGIC program then determines whether or not operator automatic is accepted by the manual backup system.

The remote buttons set their corresponding pushbutton states after which RUNLOGIC is set. As in the case of operator automatic, the LOGIC task then determines if the requested mode will be accepted.

The data link button is handled somewhat differently; this is a push-push button whose state (DLINK) is given the logical inverse of its previous value at statement 14. The new state is then interrogated in order to determine whether to turn the button backlight on or off, after which the program exits.

Keyboard Activity

There are fourteen buttons associated with keyboard activity on the DEH Operator's Panel. Of this total, eleven are numerical keys; these include the integers 0 through 9 and a decimal point. Three additional buttons are available for use with the keyboard to aid in data display or change. A brief description of these buttons follows:

1. NUMERICAL BUTTONS 0 THROUGH 9 - When the operator keys in numbers of these buttons, the corresponding values are displayed in the reference or demand windows, whichever are appropriate, for the function being performed. The values move from right to left in the windows as new keys are pressed, and both leading and trailing zeros are always displayed. If more than four numerical keys are pressed, the left-most value in the windows is lost as the new value is entered in the right-most window, and the remaining values shift left one position.

2. DECIMAL POINT BUTTON - When the decimal point key is pressed, the PANEL program retains this information but does not yet display it. When the next numerical key is pressed, both the value and the decimal point appear in the right-most window. The decimal point is positioned in the lower left-hand corner of the window position. Should additional numerical keys be pressed, the decimal point moves one position to the left with the number with which it was originally entered. Should the decimal point be shifted out of the left-most window it is lost, and a new point may be entered.

3. ENTER - When this button is pressed, the PANEL program enters the value residing in the reference or demand windows, whichever is appropriate, into core memory and performs the correct action requested by the keyboard activity. This action may consist of visual display, parameter change, or intermediate steps in a sequence of operations as described in preceding sections.

4. CANCEL - When this button is pressed, the PANEL program clears both the reference and demand windows, deletes any intermediate values in computer memory, and aborts the entire sequence of operations which was canceled. The operator may then begin a new sequence of steps.

5. CHANGE - This button indicates a sequence of operations necessary to alter numerical values residing in the DEH system memory. The steps necessary to change parameters are described earlier.

The decimal point key and keys 0–9 are serviced to check the validity of the requested entry and to set the entry if it is valid. Among other checks, a check is made on the integer IPBX, which represents the visual display and change button which has been previously pressed. If this value equals 2, thus indicating the acceleration rate button has been pressed, and the Automatic Turbine Startup mode (ATS) is in control, all keyboard buttons are invalid. During the ATS mode the acceleration rate is controlled by the startup program, and thus may be visually displayed but cannot be changed from the keyboard.

Should the ATS state be satisfied, the pointer IPBX is checked to determine if it is equal to 6; if so, the keyboard entry is flashed as invalid because this represents the valve position limit display mode, which cannot use the keyboard. If this situation is all right, the valve test button state (VTESTPB) is checked; should VTESTPB be set and the valve being tested NVTEST is non-zero, the keyboard entry is invalid. This is because NVTEST indicates that some valve has already been selected for test, thus implying that no further keyboard activity is necessary.

Finally, some special tests are made if IPBX equals 1; this means the reference display mode has been selected. If this is the case, all remote control modes such as Automatic Synchronizer (AS), Automatic Dispatch System (ADS), and Automatic Turbine Startup (ATS), imply that the keyboard cannot be used during reference display. Thus these result in the INVALID REQUEST lamp being flashed. In addition, should the turbine be on manual control (TM) or unlatched (NOT ASL), and not in the maintenance test mode (OPRT), then keyboard activity is also invalid during reference display. All of these cases are invalid for keyboard entry because the turbine demand and reference are set by the remote mode or the manual tracking system. The only time that the operator may use the keyboard in the reference display mode is during operator automatic control or during the maintenance test condition in which the DEH system is being used as a simulator and trainer.

Should all of these tests be passed properly, the logical state KEYENTRY is set and the numerical value in location KEY is checked. This is the keyboard button which has just been pressed, and must lie between 0 and 9 inclusive; otherwise, the entry is flashed as invalid. For a valid value of KEY, the program then places the new number in its proper position in the integer array (IW). This array has a place for each of the four window positions of the visual display and, as keyboard buttons are pressed, the entries move down one position in IW and the latest key is entered in the top position. The pointer ID maintains the proper position for each new key. Thus, if ID equals 0, this means there are no entries in the array IW. The value KEY is thus placed in the first position of IW. However, if ID is not zero, then a FORTRAN DO loop is executed to move the entries in IW down one position prior to entering the new value of key in the first position at statement 414. Then the value of the pointer ID is checked again; if it is less than 3, it is incremented by 1. If it is equal to 3, it retains that value. This is the mechanism used to accept more than four keyboard values with only the last four key entries being retained.

CONTROL TASK

General

The CONTROL task is assigned priority level $D_{16}$ ($13_{10}$) and is bid by the AUX SYNC task every 1 sec.

The CONTROL task size is 1759 words long, the data pool is 247 words long, and the header is 9 words for a required storage of 2015 locations. CONTROL is linked as a separate task and loaded into the computer through the tape reader. The core area assigned to CONTROL is (2740 to 2F3F)$_{16}$; this is $800_{16}(2048_{10})$ locations, thus allowing a few spares. The CONTROL task is organized as a series of relatively short subprograms, executed sequentially, and which address themselves to particular aspects of the general control system objectives.

Select Operating Mode Function

The SELECT OPERATING MODE program must distinguish between speed and load control by examining the state of the main generator circuit breaker. For wide-range speed control, the program flow chart is shown in FIG. 24A. The automatic synchronizer state (AS) is first interrogated; if it is the operating mode, the auto sync increase and decrease states (ASINC and ASDEC) are examined. These states are flip-flops which are controlled by the LOGIC task when the auto sync raise or lower contact inputs are set. The program carefully checks to see if both the increase and decrease states are set; if so, no action is taken. Otherwise a temporary location (TEMP) is set to +1 rpm or −1 rpm for each pass through the program during which the appropriate contact input is set. The turbine speed reference and demand are then incremented properly, the ASINC and ASDEC states are reset for the next time, and the program passes to the next stage of the CONTROL TASK.

If the automatic synchronizer is not the operating mode, then the Automatic Turbine Startup (ATS) state is interrogated at statement 4000 (FIG. 24A). If it is the operating mode, as determined by the LOGIC task, the turbine speed demand and rate are selected from this program via computer locations TASDMD and TASRATE. The rate is then checked against an absolute high limit (OARATMAX), which is a keyboard entered constant usually set at 800 rpm after which the program passes on to the next stage of the CONTROL task.

If the AUTOMATIC TURBINE STARTUP program is not the operating mode, the Operator Automatic (OA) state, and the Maintenance Test (OPRT) state are interrogated at statement 6000 (FIG. 24A). If either of these states are set, the turbine speed demand and rate are selected from the keyboard and the program proceeds to the next stage of the CONTROL task. Note that on Operator Automatic the keyboard values control the turbine, while in Maintenance Test the keyboard values simulate a turbine.

If neither Operator Automatic nor Maintenance Test is the operating mode, then the turbine is in Manual control and the SELECT OPERATING MODE program goes into the manual tracking mode at statement 7000. If the contact input (THI) is set, this means the throttle valves are wide open and the turbine is in speed governor control. Then the error between manual and computer governor valve outputs (IGVMAN and IGVAO) is multiplied by a gain factor (GR10) and saved in a temporary location. If the contact input (THI) is not set, then the turbine is in speed throttle control and the error between manual and computer throttle valve outputs (ITVMAN and ITVAO) is multiplied by a gain factor (GR5) and saved in a temporary location.

In either case, assuming the speed loop (SPI) is in service, the valve output error is checked against a speed tracking deadband (DBTRKS, which is a keyboard entered constant usually set at 1 percent) and the reference is checked against actual speed (WS) through a reference tracking deadband (DBTRKREF, which is also a keyboard entered constant usually set at 50 rpm). If both conditions are met, the READY state is set to indicate the DEH system is ready to assume automatic control. The READY state is detected by the FLASH task, which then flashes the OPER AUTO light to let the operator know that he may transfer to automatic control.

Finally, the gained valve position error in the temporary location (TEMP) is uused to increment the reference (REFDMD), which is then checked against an absolute high speed limit (HLS). This is a keyboard entered constant which is normally set at 4200 rpm. The program then transfers to statement 15500 for some final bookkeeping checks.

When the SELECT OPERATING MODE program determines that the main generator circuit breaker is closed, thus indicating the turbine is on load control, transfer is made to statement 10000 which is shown in FIG. 24B. The Throttle Pressure Control (TPC) state is interrogated; if it is in service, then the actual throttle pressure (PO) is compared against a set point (POSP), which is a keyboard entered constant usually set at about 1600 psia. If the throttle pressure (PO) is above the set point (POSP), no further action is taken. But if PO is below POSP, then the governor valve position (GVSP) as called for by the computer is checked against a minimum governor valve set point (GVSPMIN). This is a keyboard entered constant usually set at about 25 percent. If GVSP is less than GVSPMIN, no further action is taken; but if GVSP is greater than GVSPMIN, then the throttle pressure limiting state (TPLIM) is set and the reference load rate is set to runback the reference at the rate TPCRATE, which is a keyboard entered constant usually set at 200 percent per minute. The program then transfers to statement 11500 for further bookeeping computation.

If no throttle pressure contingency exists, the RUNBACK contact input (RB) is interrogated; if it is set, the load reference is runback at the rate (BBRATE, which is a keyboard entered constant set at about 100 percent per minute. Then at statement 11500 some bookkeeping details are taken care of. Thus if the Automatic Dispatch System (ADS) state has been in control when either a throttle pressure limit or runback condition occurred, this mode is rejected by resetting the automatic dispatch system pushbutton state (ADSPB) and setting the RUNLOGIC flag. Within 1/10 sec the AUX SYNC task bids the LOGIC task, which then realigns all states to the correct position. A second bookkeeping check is made at statement 11700 where the HOLD state is checked. If HOLD is reset, then it is set so that the operator has an indication of why the reference has been runback.

If no runback contingency exists, then the Automatic Dispatch System (ADS) state is interrogated at statement 1200. It it is the operating mode, the ADS increase and decrease states (ADSINC and ADSDEC) are examined. These are flip-flops which are controlled by the LOGIC task when the ADS increase and decrease contact inputs are set. The program carefully checks to see if both the increase and decrease contacts are set; if so no action is taken. Otherwise a temporary location (TEMP) is set to the ADS raise or lower pulse count (IADSUP or IADSDOWN. The AUX SYNC task keeps track of these pulse counts according to the conditions set up by the LOGIC task. However, a maximum ADS pulse-width is imposed on both the raise and lower pulses in the SELECT OPERATING MODE program by comparing their counts (IADSUP and IADSDOWN) with a limit (ADSMAXT), which is a keyboard entered constant usually set to 10 counts of 1/10 sec each (thus yielding a maximum pulse-width of 1 sec). After the pulse-width limiting action, at statement 12400 the turbine load reference and demand are incremented by an amount proportional to the pulse-width; the proportionality factor (ADSRATE) is a keyboard entered constant usually set somewhere between 1 and 10 MW per sec of pulse-width. Finally, at statement 12600, various ADS counters and states are reset prior to moving on to the next stage of the CONTROL task.

If the ADS state is not set, then the select operating mode program checks the Operator Automatic (OA) state and the Maintenance Test (OPRT) state at statement 14000. If either of these states are set, then the turbine demand and rate are accepted from the keyboard and the program proceeds to the next stage of the CONTROL task. Note that in Operator Automatic the keyboard values control the turbine, while in Maintenance Test the keyboard values simulate a turbine.

If neither Operator Automatic nor Maintenance Test is the operating mode, then the turbine is in Manual control and the SELECT OPERATING MODE program goes into the Manual Load Tracking mode at statement 1500. The error between the manual and computer governor valve outputs (IGVMAN and IGVAO) is stored in a temporary location (TEMP) and compared against a load tracking deadband (DBTRKL), which is a keyboard entered constant usually set at about 1 percent. If the outputs agree within DBTRKL, then the READY state is set to indicate the DEH system is ready to assume automatic control. The READY state is detected by the FLASH task, which then flashes the OPER AUTO light to let the operator know that he may transfer to automatic control.

The valve output error is then gain multiplied by GR9 and added to the current reference (REFDMD), which is high-limit-checked against MWMAX, a keyboard entered constant usually set to about 120 percent of rated megawatts. REFDMD is also low-limit-checked against zero, thus assuring that the tracking scheme will not windup in either direction. Finally, a last check is made to determine if a voltage exists on the test analog output lines; if so, the READY state is reset so that transfer to automatic control is inhibited until this voltage is removed. This may be done by pressing the OPEN valve test pushbutton until the lights behind the OPEN and CLOSE pushbutton go out.

Speed/Load Reference Function

The GO state is checked; if GO is off, the HOLD state is checked. If HOLD is on and the demand and reference value (REFDMD) are equal, then the logical states (GOHOLDOF and RUNLOGIC) are set. This results in the LOGIC task being bid within 1/10 sec by the AUX SYNC task, which recognizes the RUNLOGIC state. The LOGIC task then turns off the HOLD flip-flop and lamp as requested by the GOHOLDOF state.

If the GO state is set back however, than this is the signal to allow the reference to move toward the demand. The magnitude of the difference between the reference and the demand is computed and stored in a temporary location. Then the magnitude of the incremental step size taken each second by the selected rate, as discussed above, is saved in another temporary location. These two temporary quantities are then compared and if the demand/reference difference in TEMP is greater than the incremental step size in TEMP1, this means the reference must continue to move closer to the demand. However, the governor valve position limiting state (VPLIM) is checked; if it is set and the demand is above the reference, then no movement is allowed in the reference. This is because the valve position limit function is operating and refuses to allow any increase in reference because this will attempt to increase the governor valve position beyond the limit.

If there is no valve position limiting action, then the reference is incremented by the incremental rate step size and the program transfers for final exit.

Eventually the reference will approach within the allotted boundary of the demand. Then the reference program immediately sets the reference equal to the demand. Finally, the state of the breaker (BR) is interrogated; if it is set, the program transfers for the Load Control system computations, while transfer is maue for tthe Speed Control System computations if the breaker state (BR) is reset.

Speed Control Function

Logical checks are made to determine whether the speed computations should be evaluated. Thus, if the speed inputs failed and are unreliable, the the speed loop (SPI) is taken out of service, and there is no speed information by which to control the turbine. In addition, if the overspeed speed protection circuit in the Analog Backup System is operating, as indicated by the contact input (OPCOP), this closes the governor valve and thus overrides the DEH Speed Control System; consequently in this case, no speed control computations are performed.

Assuming that neither of these situations exist, the speed error is calculated. If the system is in the Simulation/Training mode, this error is the difference between the reference and simulated speed; the speed error is the difference between the reference and actual speed in all other cases. Following this error computation, a decision is made as to whether the turbine is on governor or throttle control. Appropriate calls are then made to the PRESET subroutine to evaluate the proportional-plus-reset controller action for the throttle or governor valve. This subroutine takes care of evaluating the controller algorithm and the high/low limit checks to eliminate reset windup.

Load Control Function

As in the Speed Control System, all parameters in the Load Control System are keyboard entered constants, which may be tuned or adjusted in the Maintenance Test mode. As always, changes of this type require transfer to manual control for the adjustment, after which the DEH system will track and permit return to automatic control.

A check is first made to determine if a change has occurred in the throttle pressure limit state (TPLIM); if so the LOGIC task aligns all status variables accordingly. The LOAD CONTROL program next checks the speed transducer failure state (SPTF). If there is no failure, the speed feedback loop is evaluated with a call to the SPDLOOP subroutine; if there is a speed transducer failure, the speed feedback loop is bypassed and the speed compensation factor (X) is set to zero. Whichever is the case, the factor (X) is summed with the turbine load reference (REFDMD) to form the speed compensated load reference (REF1). A low-limit-check against zero is performed on REFI to keep it from going negative, which is possible should a turbine overspeed condition result.

The state of the megawatt feedback loop (MWI) is checked; if the loop is out of service, the speed/-megawatt compensated load reference (REF2) is simply set equal to the speed compensated load reference (REFI). But if the megawatt loop is in service, the megawatt error is computed and ranged to a per unit value by using the ranging gain (GR2), which is normally set at rated turbine generator megawatts. Then the PRESET subroutine is called to evaluate the magwatt proportional-plus-reset controller, including high/low limit checking. The result of this computation is the megawatt trim factor (Y), which is then applied to the speed compensated load reference (REFI) in a product relationship to form the speed/megawatt corrected load reference (REF2).

The speed/megawatt compensated load reference (REF2) is converted to an impulse pressure set point (PISP) by use of ranging gain (GR3). The state of the impulse pressure feedback loop (IPI) is then interrogated; if it is out of service the governor valve set point (VSP) is simply set equal to the impulse pressure set point (PISP) is psi. But if the impulse pressure loop is in service, then the impulse pressure error is computed and used as the driving signal for the proportional-plus-reset controller, which is evaluated by a call to the PRESET subroutine; this also does the high/low limit checking.

Finally, the governor valve set point (VSP) in psi is converted to a governor valve set point from 0 to 100 percent by use of the ranging gain (GR4), which is normally set at rated impulse pressure. The program then transfers to the final stages of the CONTROL task which actually compute the throttle and governor valve outputs.

DEH DIGITAL TREND UPDATE PROCEDURE

The digital trend feature provides the ability to print up to 19 DEH system variables. These quantities may be printed at one time, or they may be printed periodically at a controllable rate by setting certain constants from the keyboard. A brief description of the entry procedure follows:

1. Press the TURBINE PROGRAM DISPLAY button, which then backlights. 2. Key in address 3364 and press the ENTER button. The address appears in the left windows and a numerical value of 0000, 1.000, or 2.000 appears in the right windows, depending on the previous state of the digital trend. 3. Press the CHANGE button; the button backlights and the right windows are cleared. 4. Key in one of the following numerical values, depending on the desired results as listed.

o 0 - Suppress the digital trend o 1 - Print the digital trend values one time o 2 - Print the digital trend values periodically at the frequency to be described below 5. Press the ENTER button. The CHANGE lamp goes out and the digital trend requested in Step 4 is carried out.

If a periodic trend has been requested, the time in seconds between printing of the values must be entered as follows:

1. Press the TURBINE PROGRAM DISPLAY button, which then backlights. 2. Key in address 3365 and press the ENTER button. The address appears in the left windows and the current value of the digital trend frequency appears in the right windows. 3. To alter the trend frequency, press the CHANGE button. The button then backlights and the right windows are cleared. 4. Key in the new digital trend frequency, in seconds, which will appear in the right windows. 5. Press the ENTER button. The CHANGE lamp goes out and the digital trend frequency requested is carried out.

A note on the frequency of the digital trend is appropriate. The IBM 735 typewritter prints out the 19 values requested, including real time and the address of each value, in about 40 sec. Therefore, this represents the minimum trend frequency; actually the frequency should be kept somewhere in the 120–300 sec range, which is about 2–5 min, or longer. However, it is not necessary to trend all 19 quantities which are available. If fewer quantities are trended, the frequency may be increased somewhat. Good practice would indicate 60 sec, (1 min) as the fastest trend frequency attempted.

The addresses of the 19, or less, quantities to be trended must be entered from the keyboard. The following presents the computer locations which must be given the addresses of the DEH quantities to be trended. In order to alter the variables in the digital trend, the following procedure must be carried out.

1. Press the TURBINE PROGRAM DISPLAY button, which then backlights.

2. Key in the trend location to be altered, as indicated in the following table. As an example, if the fourth variable is to be changed, then key in the number 3369; this appears in the left windows.

3. Press the ENTER button. The current value of the DEH quantity being trended in the fourth column will appear in the right windows.

4. Press the CHANGE button. The button backlights and the right windows are cleared.

5. Key in the address of the new DEH quantity to be trended in the fourth column. 6. Press the ENTER button. The CHANGE lamp is turned off and the new variable appears in the next print of the trend in column 4.

DEH TREND ADDRESSES

| Trend Column | Computer Location | DEH VARIABLE ADDRESS |
|---|---|---|
| 1 | 3366 | ADR1 |
| 2 | 3367 | ADR2 |
| 3 | 3368 | ADR3 |
| 4 | 3369 | ADR4 |
| 5 | 3370 | ADR5 |
| 6 | 3371 | ADR6 |
| 7 | 3372 | ADR7 |
| 8 | 3373 | ADR8 |
| 9 | 3374 | ADR9 |
| 10 | 3375 | ADR10 |
| 11 | 3376 | ADR11 |
| 12 | 3377 | ADR12 |
| 13 | 3378 | ADR13 |
| 14 | 3379 | ADR14 |
| 15 | 3380 | ADR15 |
| 16 | 3381 | ADR16 |
| 17 | 3382 | ADR17 |
| 18 | 3383 | ADR18 |

-continued

DEH TREND ADDRESSES

| Trend Column | Computer Location | DEH VARIABLE ADDRESS |
|---|---|---|
| 19 | 3384 | ADR19 |

APPENDIX VIII

Printout of Data Link Program in Fortran Language, etc.

```
CJOB X    2,5 PASEMANN              DEH DATA LINK
C
C                DR ALARM(OVERRUN) INTERRUPT PROGRAM
C
      INTEGER ICNT,INP,INFL
C
      LOGICAL ENDFL
C
      COMMON /INPB/INP(10)
C
      EQUIVALENCE (INP(7),ENDFL),(INP(9),ICNT),(INP(10),INFL)
C
      DATA N7/7/
C
C     ONLY WHILE INPUTTING A MESSAGE AN ALARM ZEROES INPUTCOUNT
C     AND THE ERROR MESSAGE NAK IS OUTPUT
C
      IF (ENDFL) GOTO 1000
      INFL=2
      CALL MSIN(N7)
C
      ICNT=0
C
      ENDFL=.TRUE.
C
1000  JMP      *2/3
C
      END

       ORIGIN= 3CF0
      SD,INPB,0EC4-0ECD
      LD
       AREA USED 3CF0-*3D0D
      UN
       NONE
      MP
       INPB     = 0EC4-*0ECD
      LB
       3CF0= 3D09 0AFF 1210 2E06 F201 7502 2C03 120B
       3CF8= AE09 EDE4 0001 1207 3E08 2C04 AE06 710F
       3D00= EDE7 7201 0EC4 0000 0000 0000 0000 0000
       3D08= 0000 0000 0007 3CFE 0002 FFFF **** ****
      PP
      XT
```

```
0001: CJOB X7002,5 PASEMANN              DEH DATA LINK
0002: C
0003: C                DR ALARM(OVERRUN) INTERRUPT PROGRAM
0004: C
0005:       INTEGER ICNT,INP,INFL
0006: C
0007:       LOGICAL ENDFL
0008: C
0009:       COMMON /INPB/INP(10)
0010: C
0011:       EQUIVALENCE (INP(7),ENDFL),(INP(9),ICNT),(INP(10),INFL)
0012: C
0013:       DATA N7/7/
0014: C
0015: C     ONLY WHILE INPUTTING A MESSAGE AN ALARM ZEROES INPUTCOUNT
0016: C     AND THE ERROR MESSAGE NAK IS OUTPUT
0017: C
0018:       IF (ENDFL) GOTO 1000
    0000    0000                        DAT   X'0000'
    0001    0AFF  08 2 FF               LDB   $+X'FFFF'
```

–Continued

```
    0002    1200  10 2 00          LDC   $+X'0000'
    0003    2E06  28 6 06          LDA   ENDFL ,C
    0004    F200  F0 2 00          ZJP   $+X'0000'
    0005    7502  70 5 02          JMP  *)1000 ,B
0019:       INFL=2
0020:       CALL M:IN(N7)
   0003+B   0002
    0006    2C03  28 4 03          LDA  =X'0002' ,B
    0007    1205  10 2 05          LDC   $+X'0005'
    0008    AE09  A8 6 09          STA   INFL,C
0021: C
0022:       ICNT=0
0023: C
0024:       ENDFL=.TRUE.
0025: C
    0009    EDE4  E8 5 E4          SST  *M:IN,B
    000A    0001                   ADL   N7
    000B    1204  10 2 04          LDC   $+X'0004'
    000C    3E08  38 6 08          STZ   ICNT,C
   0004+B   FFFF
    000D    2C04  28 4 04          LDA  =X'FFFF' ,B
    000E    AE06  A8 6 06          STA   ENDFL ,C
0026: S1000 JMP      *223
    000F    71DF  70 1 DF   )1000  JMP  *X'FFDF'
0027: C
0028:       END
    0010    EDE7  E8 5 E7          SST  *EXIT,B
                                    LPL
    0011    7200  70 2 00          JMP   $+X'0000'
    0012    0000                   DAT   X'0000'
    0000    0019                   ADL   X'0019'
  EXT M:IN
  EXT EXIT
  VAR ICNT  0008 IN INPB
  ARR INP   0000 IN INPB
  VAR INFL  0009 IN INPB
  VAR ENDFL   0006 IN INPB
  VAR N7  0001 IN DP
PROGRAM SIZE: 0025    DATA POOL SIZE: 0005    ERROR COUNT:  0000
```

```
CJOB X7002,5 PASEMANN            DER DATA LINK
C
C
C          DATALINK - DR INTERRUPT PROGRAM
C
      INTEGER INP,COSY,INPUT,CCKS,ICNT,ICOMP,ETXSY,ENDSY,DATSY
C
      LOGICAL ENDFL,ACCFL
C
      COMMON /SYMB/COSY(10)
      COMMON /INPB/INP(10)
C
      EQUIVALENCE (INP(6),ICOMP),(INP(7),ENDFL),(INP(8),ACCFL)
     1, (INP(9),ICNT),(INP(10),INFL),(COSY(1),DATSY)
     2,(COSY(5),ENDSY),(COSY(6),ETXSY),(COSY(7),STXSY)
C
      DATA N7/7/
C
C          INPUT FROM DR-CARD
C
S     IOA       145
S     STA       INPUT
C
C     IS THIS FIRST INPUT ?
C
      IF(ICNT.NE.0) GO TO 30
C
C     CHECK IF DL IS READ  TO ACCEPT NE  INPUTS
C
      IF (.NOT.ACCFL) GOTO 100
C
```

—Continued

```
C     PROCESS FIRST INPUT
C
      INXCNT=0
      ENDFL=.FALSE.
      CCKS=0
      INFL=0
C
      IF (INPUT.EQ.DATSY)  GOTO 1000
      GOTO 100
C
C     IS THIS SECOND INPUT ?
C
 30   IF(ICNT .GT. 1) GOTO 40
C
C     PROCESS SECOND INPUT
C
      IF(INPUT.EQ.ENQSY) GOTO 1000
      GOTO 100
C
C     IS THIS SIXTH INPUT ?
C
 40   IF(ICNT.GE.6) GOTO 60
C
C     PUT INPUT IN BUFFER
C
      INP(ICNT+1)=INPUT
C
C     CALCULATE CHECKSUM
C
S     LDA       CCKS
S     EOR       INPUT
S     STA       CCKS
      GOTO 1000
C
C     CHECK IF LAST TWO TRANSMISSIONS ETX AND CCKS ARE ALL RIGHT
C
 60   IF (ICNT.EQ.6)  GOTO 70
C
      IF (INPUT.EQ.ETXSY)  GOTO 1000
      GOTO 100
C     CHECK IF THIS IS CHECKSUM IF,BID DL-TASK
C
 70   IF ( INPUT .EQ. CCKS) GOTO 900
C
C     SET UP ERROR INDICATION FOR OTHER COMPUTER
C
      INFL=3
      GOTO 101
C
C     THE EXIT IN CASE OF ANY ERRORS,THE INPUTCOUNTER IS ZERLED
C     SET UP ERROR INDICATION FOR OTHER COMPUTER
C
 100  INFL=2
 101  ICNT=-1
      ACCFL=.TRUE.
C
      GOTO 800
C
C     EXIT AFTER COMPLETE INPUT
C
 900  ACCFL=.FALSE.
      INFL=1
C
C     FINAL EXIT DL TASK IS BID
 800  CALL M:IN(N7)
C
C     SET FLAGS
C
      INP(49)=1
      ENDFL=.TRUE.
C
```

—Continued

```
C       INCREMENT INPUT-COMPLETION COUNTER
C
        ICOMP=ICOMP+1
C
C       REGULAR EXIT THE INPUT-COUNTER IS INCREMETED
C
 1000   ICNT=ICNT+1
C
C       CHECK IF TOO MANY INPUTS
C
        IMXCNT=IMXCNT-1
        IF (IMXCNT.EQ.0) GOTO 100
C
C       EXIT INTERRUPT PROGRAM
C
S       JMP      *223
C
        END


        ORIGIN= 3DE0
       SD,INPB,0EC4-0ECD
       SD,SYMB,0EBA-0EC3
       LD
        AREA USED 3DE0-*3E6C
       UN
        NONE
       MP
        INPB     = 0EC4-*0ECD
        SYMB     = 0EBA-*0EC3
       LB
        3DE0= 3E55 0AFF 8891 AC02 1258 2E08 F201 7504
        3DE8= 1254 2E07 5405 F201 7506 2C08 AC07 2C09
        3DF0= 124C AE06 3C03 3E09 2C02 1248 4E00 F201
        3DF8= 7201 750A 7506 1241 2E08 6805 F202 BA01
        3E00= 7503 2C02 1238 4E04 F201 7201 750A 7506
        3E08= 1234 2E08 4C0C BA01 7500 122F 2E08 4220
        3E10= AC0E 2C02 AD0E 2C03 5402 AC03 750A 1225
        3E18= 2E08 4C0F F201 7201 7510 2C02 121F 4E05
        3E20= F201 7201 750A 7506 2C02 4C03 F201 7201
        3E28= 7511 2C12 1214 AE09 7513 2C14 120E AE09
        3E30= 2C09 120B AE08 2C15 AE07 7516 2C09 1205
        3E38= AE07 2C17 AE09 7202 0EC4 0EBA EDE4 0001
        3E40= 2C17 12FB AE30 2C15 AE06 6605 12F6 6608
        3E48= 6C07 2C07 F201 7201 72E0 71DF EDE7 0000
        3E50= 0000 0000 0000 0000 0000 0000 0007 0000
        3E58= 0000 3DFA FFFF 3E2C 0000 0008 0000 3E45
        3E60= 3E07 0005 3E16 0000 0006 3E23 3E35 0003
        3E68= 3E2F 0002 FFFF 3E3D 0001 **** **** ****
       PP
       XT

0001: CJOB X7002,5 PASEMANN            DEH DATA LINK
0002: C
0003: C
0004: C          DATALINK - DR INTERRUPT PROGRAM
0005: C
0006:       INTEGER INP,COSY,INPUT,CCKS,ICNT,ICOMP,ETXSY,ENQSY,DATSY
0007: C
0008:       LOGICAL ENDFL,ACCFL
0009: C
0010:       COMMON /SYMB/COSY(10)
0011:       COMMON /INPB/INP(10)
0012: C
0013:       EQUIVALENCE (INP(6),ICOMP),(INP(7),ENDFL),(INP(8),ACCFL)
0014:      1, (INP(9),ICNT),(INP(10),INFL),(COSY(1),DATSY)
0015:      2,(COSY(5),ENQSY),(COSY(6),ETXSY),(COSY(7),STXSY)
0016: C
0017:       DATA N7/7/
0018: C
0019: C          INPUT FROM DR-CARD
0020: C
```

—Continued

```
0021: S      IOA       145
    0000     0000                        DAT   X'0000'
    0001     0AFF  08 2 FF               LDB   $+X'FFFF'
    0002     8891  88 0 91               IOA   X'FF91'
0022: S      STA       INPUT
    0003     AC02  A8 4 02               STA   INPUT ,B
0023: C
0024: C      IS THIS FIRST INPUT ?
0025: C
0026:        IF(ICNT.NE.0) GO TO 30
    0004     1200  10 2 00               LDC   $+X'0000'
    0005     2E08  28 6 08               LDA   ICNT,C
    0006     F200  F0 2 00               ZJP   $+X'0000'
0027: C
0028: C      CHECK IF DL IS READY TO ACCEPT NEW INPUTS
0029: C
    0007     7504  70 5 04               JMP  *)30 ,B
0030:        IF (.NOT.ACCFL) GOTO 100
    0008     1204  10 2 04               LDC   $+X'0004'
    0009     2E07  28 6 07               LDA   ACCFL ,C
    0005+B   FFFF
    000A     5405  50 4 05               EOR  =X'FFFF' ,B
    000B     F200  F0 2 00               ZJP   $+X'0000'
0031: C
0032: C      PROCESS FIRST INPUT
0033: C
    000C     7506  70 5 06               JMP  *)100,B
0034:        IMXCNT=8
0035:        ENDFL=.FALSE.
0036:        CCKS=0
0037:        INFL=0
0038: C
0039:        IF (INPUT.EQ.DATSY)  GOTO 1000
    0008+B   0008
    000D     2C08  28 4 08               LDA  =X'0008' ,B
    000E     AC07  A8 4 07               STA   IMXCNT,B
    0009+B   0000
    000F     2C09  28 4 09               LDA  =X'0000' ,B
    0010     1208  10 2 08               LDC   $+X'0008'
    0011     AE06  A8 6 06               STA   ENDFL ,C
    0012     3C03  38 4 03               STZ   CCKS,B
    0013     3E09  38 6 09               STZ   INFL,C
    0014     2C02  28 4 02               LDA   INPUT ,B
    0015     1200  10 2 00               LDC   $+X'0000'
    0016     4E00  48 6 00               SUB   DATSY ,C
    0017     F201  F0 2 01               ZJP   $+X'0001'
    0018     7200  70 2 00               JMP   $+X'0000'
    0019     750A  70 5 0A               JMP  *)1000 ,B
0040:        GOTO 100
0041: C
0042: C      IS THIS SECOND INPUT ?
0043: C
    001A     7506  70 5 06               JMP  *)100,B
0044:  30    IF(ICNT .GT. 1) GOTO 40
    001B     120B  10 2 0B    )30        LDC   $+X'000B'
    001C     2E08  28 6 08               LDA   ICNT,C
    001D     6805  68 0 05               DCR   X'0005'
    001E     F200  F0 2 00               ZJP   $+X'0000'
    001F     BA01  B8 2 01               NJP   $+X'0001'
0045: C
0046: C      PROCESS SECOND INPUT
0047: C
    0020     750B  70 5 0B               JMP  *)40 ,B
0048:        IF(INPUT.EQ.ENDSY) GOTO 1000
    0021     2C02  28 4 02               LDA   INPUT ,B
    0022     120D  10 2 0D               LDC   $+X'000D'
    0023     4E04  48 6 04               SUB   ENDSY ,C
    0024     F201  F0 2 01               ZJP   $+X'0001'
    0025     7200  70 2 00               JMP   $+X'0000'
    0026     750A  70 5 0A               JMP  *)1000 ,B
0049:        GOTO 100
0050: C
```

—Continued

```
0051: C      IS THIS SIXTH INPUT ?
0052: C
   0027      7506  70 5 06            JMP  *)100,B
0053:  40    IF(ICNT.GE.5) GOTO 60
   0028      120D  10 2 0D   )40      LDC   $+X'000D'
   0029      2E08  28 6 08            LDA   ICNT,C
   000C+B    0005
   002A      4C0C  48 4 0C            SUB  =X'0005' ,B
   002B      BA00  B8 2 00            NJP   $+X'0000'
0054: C
0055: C      PUT INPUT IN BUFFER
0056: C
   002C      750D  70 5 0D            JMP  *)60 ,B
0057:        INP(ICNT+1)=INPUT
0058: C
0059: C      CALCULATE CHECKSUM
0060: C
0061: S      LDA       CCKS
   002D      1205  10 2 05            LDC   $+X'0005'
   002E      2E08  28 6 08            LDA   ICNT,C
   002F      4202  40 2 02            ADD  =X'0000'
   0030      AC0E  A8 4 0E            STA   #AIA,B
   0031      2C02  28 4 02            LDA   INPUT ,B
   0032      AD0E  A8 5 0E            STA  *#AIA,B
   0033      2C03  28 4 03            LDA   CCKS,B
0062: S      EOR       INPUT
   0034      5402  50 4 02            EOR   INPUT ,B
0063: S      STA       CCKS
   0035      AC03  A8 4 03            STA   CCKS,B
0064:        GOTO 1000
0065: C
0066: C      CHECK IF LAST TWO TRANSMISSIONS ETX AND CCKS ARE ALL RIGHT
0067: C
   0036      750A  70 5 0A            JMP  *)1000 ,B
0068:  60    IF (ICNT.EQ.6)  GOTO 70
   0037      1208  10 2 08   )60      LDC   $+X'0008'
   0038      2E08  28 6 08            LDA   ICNT,C
   000F+B    0006
   0039      4C0F  48 4 0F            SUB  =X'0006' ,B
   003A      F201  F0 2 01            ZJP   $+X'0001'
   003B      7200  70 2 00            JMP   $+X'0000'
0069: C
   003C      7510  70 5 10            JMP  *)70 ,B
0070:        IF (INPUT.EQ.ETXSY)  GOTO 1000
   003D      2C02  28 4 02            LDA   INPUT ,B
   003E      121C  10 2 1C            LDC   $+X'001C'
   003F      4E05  48 6 05            SUB   ETXSY ,C
   0040      F201  F0 2 01            ZJP   $+X'0001'
   0041      7200  70 2 00            JMP   $+X'0000'
   0042      750A  70 5 0A            JMP  *)1000 ,B
0071:        GOTO 100
0072: C      CHECK IF THIS IS CHECKSUM IF,BID DL=TASK
0073: C
   0043      7506  70 5 06            JMP  *)100,B
0074:   70   IF ( INPUT .EQ. CCKS) GOTO 900
   0044      2C02  28 4 02   )70      LDA   INPUT ,B
   0045      4C03  48 4 03            SUB   CCKS,B
   0046      F201  F0 2 01            ZJP   $+X'0001'
   0047      7200  70 2 00            JMP   $+X'0000'
0075: C
0076: C      SET UP ERROR INDICATION FOR OTHER COMPUTER
0077: C
   0048      7511  70 5 11            JMP  *)900,B
0078:        INFL=3
0079:        GOTO 101
   0012+B    0003
   0049      2C12  28 4 12            LDA  =X'0003' ,B
   004A      1213  10 2 13            LDC   $+X'0013'
   004B      AE09  A8 6 09            STA   INFL,C
0080: C
```

—Continued

```
0081: C      THE EXIT IN CASE OF ANY ERRORS,THE INPUTCOUNTER IS ZEROED
0082: C      SET UP ERROR INDICATION FOR OTHER COMPUTER
0083: C
    004C     7513  70 5 13          JMP  *)101,B
0084:  100   INFL=2
    0014+B   0002            )100
    004D     2C14  28 4 14          LDA  =X'0002' ,B
    004E     1204  10 2 04          LDC   $+X'0004'
    004F     AE09  A8 6 09          STA   INFL,C
0085:  101   ICNT=-1
0086:        ACCFL=.TRUE.
0087: C
0088:        GOTO 800
    0050     2C05  28 4 05          LDA  =X'FFFF' ,B
    0051     1203  10 2 03          LDC   $+X'0003'
    0052     AE08  A8 6 08          STA   ICNT,C
    0015+B   FFFF
    0053     2C15  28 4 15          LDA  =X'FFFF' ,B
    0054     AE07  A8 6 07          STA   ACCFL ,C
0089: C
0090: C      EXIT AFTER COMPLETE INPUT
0091: C
    0055     7516  70 5 16          JMP  *)800,B
0092:  900   ACCFL=.FALSE.
0093:        INFL=1
0094: C
0095: C      FINAL EXIT DL TASK IS BID
    0056     2C09  28 4 09          LDA  =X'0000' ,B
    0057     1206  10 2 06          LDC   $+X'0006'
    0058     AE07  A8 6 07          STA   ACCFL ,C
    0017+B   0001
    0059     2C17  28 4 17          LDA  =X'0001' ,B
    005A     AE09  A8 6 09          STA   INFL,C

                                     LPL
    005B     7200  70 2 00          JMP   $+X'0000'
    005C     0000                   DAT   X'0000'
    005D     0000                   DAT   X'0000'
0096:  800   CALL M:IN(N7)
0097: C
0098: C      SET FLAGS
0099: C
0100:        INP(49)=1
0101:        ENDFL=.TRUE.
0102: C
0103: C      INCREMENT INPUT-COMPLETION COUNTER
0104: C
0105:        ICOMP=ICOMP+1
0106: C
0107: C      REGULAR EXIT THE INPUT-COUNTER IS INCREMETED
0108: C
    005E     EDE4  E8 5 E4          SST  *M:IN,B
    005F     0001                   ADL   N7
    0060     2C17  28 4 17          LDA  =X'0001' ,B
    0061     12FB  10 2 FB          LDC   $+X'FFFB'
    0062     AE30  A8 6 30          STA   INP ,C
    0063     2C15  28 4 15          LDA  =X'FFFF' ,B
    0064     AE06  A8 6 06          STA   ENDFL ,C
    0065     6605  60 6 05          INC   ICOMP ,C
0109: C 1000 ICNT=ICNT+1
0111: C      CHECK IF TOO MANY INPUTS
0112: C
0113:        IMXCNT=IMXCNT-1
0114:        IF (IMXCNT.EQ.0) GOTO 100
    0066     12F6  10 2 F6          LDC   $+X'FFF6'
    0067     6608  60 6 08          INC   ICNT,C
    0068     6C07  68 4 07          DCR   IMXCNT,B
    0069     2C07  28 4 07          LDA   IMXCNT,B
    006A     F201  F0 2 01          ZJP   $+X'0001'
    006B     7200  70 2 00          JMP   $+X'0000'
```

—Continued

```
0115: C
0116: C      EXIT INTERRUPT PROGRAM
0117: C
   006C      72E0  70 2 E0          JMP   )100
0118: S      JMP       *223
   006D      71DF  70 1 DF          JMP  *X'FFDF'
0119: C
0120:        END
   006E      EDE7  E8 5 E7          SST  *EXIT,8
   0000      0075                   ADL   X'0075'

  EXT M:IN
  EXT EXIT
  ARR INP    0000 IN INPB
  ARR COSY   0000 IN SYMB
  VAR INPUT    0002 IN DP
  VAR CCKS   0003 IN DP
  VAR ICNT   0008 IN INPB
  VAR ICOMP    0005 IN INPB
  VAR ETXSY    0005 IN SYMB
  VAR FNGSY    0004 IN SYMB
  VAR DATSY    0000 IN SYMB
  VAR ENDFL    0006 IN INPB
  VAR ACCFL    0007 IN INPB
  VAR INFL   0009 IN INPB
  VAR STXSY    0006 IN SYMB
  VAR N7   0001 IN DP
  VAR IMXCNT   0007 IN DP
  VAR #AIA   000E IN DP
PROGRAM SIZE: 0117    DATA POOL SIZE: 0024    ERROR COUNT:  0000

      CJOB X7002,5 PASEMANN            DEH DATA LINK
      C
      C            DATA LINK  DT INTERRUPT-(OUTPUT) PROGRAM
      C
            INTEGER OUT,TEMP,M,OCNT
      C
            COMMON /OUTPB/OUT(50)
      C
            EQUIVALENCE (OUT(49),OCNT),(OUT(48),M),(OUT(50),OEND)
      C
            LOGICAL OEND
      C
      C
      C     CHECK IF THIS IS LAST COMPLETION INTERRUPT
      C
            OCNT=OCNT-1
            IF (OCNT.LE.0) GOTO 1000
      C
      C     SET UP ARRAY SUBSCRIPT FOR THIS OUTPUT
      C
            M=M+1
            TEMP=OUT(M)
      S     LDA       TEMP
      S     IDA       16
            GOTO 500
      C     LAST EXIT
       1000 OEND=.TRUE.
      C
      C     REGULAR END
      C
      5500  JMP       *223
            END

            [illegible] 0E92
            SD,[illegible]PB,0ECE-0EFF
            LD
             AREA USED 0E92--0EB7
            UN
             NONE
            MP
             OUTPB    = 0ECE--0EFF
```

—Continued

```
LS
 0E90= **** **** 0EB2 0AFF 1216 6E30 2E30 F201
 0E98= B201 7502 1210 662F 2E2F 420E AC03 2D03
 0EA0= AC01 2C01 8810 7504 2C05 1205 AE31 71DF
 0EA8= EDE7 7202 0ECE 0ECD 0000 0000 0000 0000
 0EB0= 0000 0000 0000 0000 0EA3 0000 0EA6 FFFF
PP
XT

0001: LOGB X7002,5 PASEMANN              DEH DATA LINK
0002: C
0003: C            DATA LINK  DT INTERRUPT=(OUTPUT) PROGRAM
0004: C
0005:        INTEGER OUT,TEMP,M,OCNT
0006: C
0007:        COMMON /OUTPB/OUT(50)
0008: C
0009:        EQUIVALENCE (OUT(49),OCNT),(OUT(48),M),(OUT(50),(END)
0010: C
0011:        LOGICAL OEND
0012: C
0013: C
0014: C      CHECK IF THIS IS LAST COMPLETION INTERRUPT
0015: C
0016:        OCNT=OCNT-1
    0000     0000                          DAT   X'0000'
    0001     0AFF  08 2 FF                 LDB   $+X'FFFF'
0017:        IF (OCNT.LE.0) GOTO 1000
    0002     1200  10 2 00                 LDC   $+X'0000'
    0003     6E30  68 6 30                 DCR   OCNT,C
    0004     2E30  28 6 30                 LDA   OCNT,C
    0005     F201  F0 2 01                 ZJP   $+X'0001'
    0006     B200  B0 2 00                 PJP   $+X'0000'
0018: C
0019: C      SET UP ARRAY SUBSCRIPT FOR THIS OUTPUT
0020: C
    0007     7502  70 5 02                 JMP   *)1000 ,B
0021:        M=M+1
0022:        TEMP=OUT(M)
0023: S      LDA       TEMP
    0008     1206  10 2 06                 LDC   $+X'0006'
    0009     662F  60 6 2F                 INC   M ,C
    000A     2E2F  28 6 2F                 LDA   M ,C
    000B     4200  40 2 00                 ADD   =X'FFFF'
    000C     AC03  A8 4 03                 STA   #AIA,B
    000D     2D03  28 5 03                 LDA   *#AIA,B
    000E     AC01  A8 4 01                 STA   TEMP,B
    000F     2C01  28 4 01                 LDA   TEMP,B
0024: S      IOA       16
    0010     8810  88 0 10                 IOA   X'0010'
0025:        GOTO 500
0026: C      LAST EXIT
    0011     7504  70 5 04                 JMP   *)500,B
0027:  1000 OEND=.TRUE.
0028: C
0029: C      REGULAR END
0030: C
    0005+B   FFFF
    0012     2C05  28 4 05                 LDA   =X'FFFF' ,B
    0013     1208  10 2 08                 LDC   $+X'000B'
    0014     AE31  A8 6 31                 STA   OEND,C
0031: S500   JMP       *223
    0015     71DF  70 1 DF    )500         JMP   *X'FFDF'
0032:        END
    0016     EDE7  E8 5 E7                 SST   *EXIT,B

                                           LPL
    0017     7200  70 2 00                 JMP   $+X'0000'
    0018     0000                          DAT   X'0000'
    0019     FFFF                          DAT   X'FFFF'
    0000     0020                          ADL   X'0020'
```

—Continued

```
EX: EXIT
ARR OUT   0000 IN OUTPB
VAR TEMP  0001 IN DP
VAR M   002F IN OUTPB
VAR OCNT  0030 IN OUTPB
VAR OEND  0031 IN OUTPB
VAR #AIA  0003 IN DP
PROGRAM SIZE: 0032    DATA POOL SIZE: 0006    ERROR COUNT:  0000

      CJOB X7002,5 PASEMANN              DEH DATA LINK
      C
      C          DATA LINK TASK
      C
            INTEGER  INP,OUT,ADDR,CCKS,WDNO,HALF1,HALF2,HALF3
           1, DATSY,ETXSY,STXSY,CSFSY,NAKSY,COSY,MO,OCNT
      C
            LOGICAL INLOG (10),OULOG(50),ACCFL,OEND
      C
            COMMON /INPB/ INP(10)
      C
            COMMON /SYMB/ COSY(10)
      C
            COMMON /OUTPB/ OUT(50)
      C
            EQUIVALENCE (INP(1),INLOG(1)),(OUT(1),OULOG(1))
           1,(COSY(1),DATSY)
           2,(COSY(4),NAKSY),(COSY(6),ETXSY),(COSY(7),STXSY),(COSY 8),CSFSY)
           3,(INP(7),ENDFL),(INP(8),ACCFL),(INP(9),ICNT),(INP(10), NFL)
           4 ,(OUT(48),MO),(OUT(49),OCNT),(OUT(50),OEND)
      C
            DATA MASK1,MASK2 /$00FF,$FF00/
      C
      C     CHECK WHICH TYPE THE INPUT IS
      C
       5    IF (INFL.EQ.0)  GOTO 1010
            GOTO (100,500,500) ,INFL
      C
      C     CHECK IF OUTPUT IS STILL BUSY
      C
      100   IF (OEND) GOTO 105
            CALL MITD(3)
      C
      C     STOP OUTPUT AFTER TIMEDELA
      C
            OCNT=0
      C
      C     PROCESS ADDRESS AND WORD-NO FOR 'DATI'
      C
      105   HALF1=INP(3)
            HALF2=INP(4)
            HALF3=INP(5)
      C

      C     REDUCE NO OF OUTPUTS IF TOO
      C
            IF (HALF3.GT.40) HALF3=40
      C
            WDNO=HALF3/2
            ADDR=HALF1*256+HALF2
      C
      C     CALCULATE CHECKSUM OF ADDRESS AND WDNO
      C
            CCKS=0
      S     LDA       HALF3
      S     EOR       HALF2
      S     EOR       HALF1
      S     STA       CCKS
      C
            OUT(3)=HALF1
            OUT(4)=HALF2
            OUT(5)=HALF3
```

– Continued

```
C
C       PUT CONTROL-WORD IN OUTPUT-BUFFER
C
        OUT(2)=STXSY
        M=INP(5)+6
        OUT(M)=ETXSY
C
C
C       PROCESSING 'DAT' REQUEST
C
        DO 150 K=1,WDNO
        N=2*K+5
S       LDA      *ADDR
S       AND      MASK2
S       STA      HALF1
S       LDA     *ADDR
S       AND      MASK1
S       STA      HALF2
        HALF1=HALF1/256
S       LDA      CCKS
S       EOR      HALF1
S       EOR      HALF2
S       STA      CCKS
        OUT(N-1)=HALF1
        OUT(N)=HALF2
 150    ADDR=ADDR+1
C
        OUT(M+1)=CCKS
        MO=1
        OCNT=INP(5)+7
        OEND=.FALSE.
        ACCFL=.TRUE.
C
C       INITIATE 'DAT'-TRANSMISSION WITH FIRST OUTPUT
C
S       LDA      DATSY
S       IOA      16
C
        GOTO 1000
C
C       PROCESS ERROR MESSAGES
C
 500    CALL MITD(2)
        MO=1
        OCNT=1
C
        GOTO (1000,510,610) ,INFL
C
C       SEND ERROR MESSAGE
C
C
S510    LDA      NAKSY
S       IOA      16
        GOTO 1000
C
S610    LDA      CSFSY
S       IOA      16
C
C       ZERO INPUT FLAGS
C
 1000   ICNT=0
        INFL=0
C
 1010   CALL EXIT
C
        GOTO 5
C
        END
```

—Continued

```
 3D19:   3D10
LD,9
 AREA USED 3D10-*3D18
SD,SYMB,0EBA-0EC3
SD,INPB,0EC4-0ECD
SD,OUTPB,0ECE-0EFF
LD
 AREA USED 3D19-*3DDB
LS
UN
 M:TD
MP
 SDT:     = 1007
 SYMB     = 0EBA-*0EC3
 INPB     = 0EC4-*0ECD
 OUTPB    = 0ECE-*0EFF
LP
 3D10= 3D19 0000 0000 0000 0000 0000 0000 0000
 3D18= 0000 3DDC 0AFF 125B 2E09 F201 7201 7509
 3D20= 5F87 0004 3D2D 3D3D 3D5D 800A 1252 2E31
 3D28= F201 7508 EF08 000C 124C 3E30 1248 2E02
 3D30= AC06 2E03 AC07 2E04 AC08 4C0D F203 8A02
 3D38= 8000 AC03 2C08 1C0E 9805 AC05 2C06 1C0F
 3D40= F203 4407 AC03 3C04 2C08 5407 5406 AC04
 3D48= 2C06 122F AE02 2C07 AE03 2C08 AE04 122A
 3D50= 2E06 1227 AE01 1223 2E04 4411 AC10 2C10
 3D58= 4222 AC12 121F 2E05 AD12 2C14 AC13 2C13
 3D60= 4003 4416 AC15 2D03 5C02 AC06 2D03 5C01
 3D68= AC07 2C06 1C17 9805 AC06 2C04 5406 5407
 3D70= AC04 2C16 AC12 4203 AC18 7206 0EC4 1006
 3D78= 0EC8 0EBA 0ECD 0EC8 2C06 AD18 2C12 42FB
 3D80= AC19 2C07 AD19 6403 6413 2C05 4C13 B2D7
 3D88= 2C10 42EF AC12 2C04 AD12 2C14 122A AE2F
 3D90= 12E6 2E04 441A 12E5 AE30 2C1B AE31 2C1C
 3D98= 12DE AE07 12DF 2E00 8810 7510 5F64 001E
 3DA0= 2C14 1207 AE2F AE30 5FD3 0004 3DB0 3DA9
 3DA8= 3DAD 800A 12CF 2E03 8810 7510 12C5 2E07
 3DB0= 8810 12C5 3E08 3E09 8D67 751F 0000 0000
 3DB8= 0000 0000 0000 0000 0000 00FF FF00 0000
 3DC0= 0000 0000 0000 0000 0000 3D83 0ECD 3D2D
 3DC8= 0003 0028 4001 0008 0000 0006 0000 0000
 3DD0  0001 0000 0005 4008 0000 0000 0007 0005
 3DD8= FFFF 3DB0 0002 3D1A ********* **** ***
PP
XT:
```

```
0001: CJOB X7002,5 PASEMANN              DEH DATA LINK
0002: CJOB X7002,5 PASEMANN              DEH DATA LINK
0003: C
0004: C          DATA LINK TASK
0005: C
0006:       INTEGER  INP,OUT,ADDR,CCKS,WDNO,HALF1,HALF2,HALF3
0007:      1, DATSY,ETXSY,STXSY,CSFSY,NAKSY,COSY,MO,OCNT
0008: C
0009:       LOGICAL INLOG (10),OULOG(50),ACCFL,OEND
0010: C
0011:       COMMON /INPB/ INP(10)
0012: C
0013:       COMMON /SYMB/ COSY(10)
0014: C
0015:       COMMON /OUTPB/ OUT(50)
0016: C
0017:       EQUIVALENCE (INP(1),INLOG(1)),(OUT(1),OULOG(1))
0018:      1,(COSY(1),DATSY)
0019:      2,(COSY(4),NAKSY),(COSY(6),ETXSY),(COSY(7),STXSY),(COSY(8),CSFSY)
0020:      3,(INP(7),ENDFL),(INP(8),ACCFL),(INP(9),ICNT),(INP(10),INFL)
0021:      4 ,(OUT(48),MO),(OUT(49),OCNT),(OUT(50),OEND)
0022: C
0023:       DATA MASK1,MASK2 /$00FF,$FF00/
0024: C
0025: C     CHECK WHICH TYPE THE INPUT IS
0026: C
```

—Continued

```
0027:  5     IF (INFL.EQ.0)  GOTO 1010
    0000     0000                        DAT   X'0000'
    0001     0AFF  08 2 FF               LDB   $+X'FFFF'
    0002     1200  10 2 00    )5         LDC   $+X'0000'
    0003     2E09  28 6 09               LDA   INFL,C
    0004     F201  F0 2 01               ZJP   $+X'0001'
    0005     7200  70 2 00               JMP   $+X'0000'
    0006     7509  70 5 09               JMP   *)1010 ,B
0028:        GOTO (100,500,500) ,INFL
    0007     EF00  E8 7 00               SST   *GOT:,B
    0008     0004                        DAT   X'0004'
    0009     0000                        ADL   )100
    000A     0000                        ADL   )500
    000B     000A                        ADL   )500
0029: C
0030: C      CHECK IF OUTPUT IS STILL BUSY
0031: C
    000C     800A                        ADL   INFL

0032: 100    IF (OEND) GOTO 105
    000D     1200  10 2 00    )100       LDC   $+X'0000'
    000E     2E31  28 6 31               LDA   OEND,C
    000F     F200  F0 2 00               ZJP   $+X'0000'
    0010     7508  70 5 08               JMP   *)105,B
0033:        CALL M:TD(3)
0034: C
0035: C      STOP OUTPUT AFTER TIMEDELAY
0036: C
0037:        OCNT=0
0038: C
0039: C      PROCESS ADDRESS AND WORD-NO FOR 'DAT'
0040: C
    0011     EDE9  E8 5 E9               SST   *M:TD,B
    000C+B   0003
    0012     000C                        ADL   =X'0003'
    0013     1206  10 2 06               LDC   $+X'0006'
    0014     3E30  38 6 30               STZ   OCNT,C
0041:  105   HALF1=INP(3)
0042:        HALF2=INP(4)
0043:        HALF3=INP(5)
0044: C
0045: C      REDUCE NO OF OUTPUTS IF TOO HIGH
0046: C
0047:        IF (HALF3.GT.40) HALF3=40
    0015     1213  10 2 13               LDC   $+X'0013'
    0016     2E02  28 6 02               LDA   INP ,C
    0017     AC06  A8 4 06               STA   HALF1 ,B
    0018     2E03  28 6 03               LDA   INP ,C
    0019     AC07  A8 4 07               STA   HALF2 ,B
    001A     2E04  28 6 04               LDA   INP ,C
    001B     AC08  A8 4 08               STA   HALF3 ,B
    000D+B   0028
    001C     4C0D  48 4 0D               SUB   =X'0028' ,B
    001D     F200  F0 2 00               ZJP   $+X'0000'
    001E     BA01  B8 2 01               NJP   $+X'0001'
0048: C
    001F     2C0D  28 4 0D               LDA   =X'0028' ,B
    0020     AC08  A8 4 08               STA   HALF3 ,B
0049:        WDNO=HALF3/2
0050:        ADDR=HALF1*256+HALF2
0051: C
0052: C      CALCULATE CHECKSUM OF ADDRESS AND WDNO
0053: C
0054:        CCKS=0
0055: S      LDA       HALF3
    0021     2C08  28 4 08               LDA   HALF3 ,B
    000E+B   4001
    0022     1C0E  18 4 0E               LDG   =X'4001' ,B
    0023     9805  98 0 05               SHF   X'0005'
    0024     AC05  A8 4 05               STA   WDNO,B
    0025     2C06  28 4 06               LDA   HALF1 ,B
    000F+B   0008
    0026     1C0F  18 4 0F               LDG   =X'0008' ,B
```

–Continued

```
    0027    9805  98 0 05          SHF   X'0005'
    0028    4407  40 4 07          ADD   HALF2 ,B
    0029    AC03  A8 4 03          STA   ADDR,B
    002A    3C04  38 4 04          STZ   CCKS,B
    002B    2C08  28 4 08          LDA   HALF3 ,B
0056: S     EOR       HALF2
    002C    5407  50 4 07          EOR   HALF2 ,B
0057: S     EOR       HALF1
    002D    5406  50 4 06          EOR   HALF1 ,B
0058: S     STA       CCKS
    002E    AC04  A8 4 04          STA   CCKS,B
0059: C
0060:       OUT(3)=HALF1
0061:       OUT(4)=HALF2
0062:       OUT(5)=HALF3
0063: C
0064: C     PUT CONTROL-WORD IN OUTPUT-BUFFER
0065: C
0066:       OUT(2)=STXSY
0067:       M=INP(5)+6
0068:       OUT(M)=ETXSY
0069: C
0070: C
0071: C     PROCESSING 'DAT' REQUEST
0072: C
0073:       DO 150 K=1,WDNO
    002F    2C06  28 4 06          LDA   HALF1 ,B
    0030    121D  10 2 1D          LDC   $+X'001D'
    0031    AE02  A8 6 02          STA   OUT ,C
    0032    2C07  28 4 07          LDA   HALF2 ,B
    0033    AE03  A8 6 03          STA   OUT ,C
    0034    2C08  28 4 08          LDA   HALF3 ,B
    0035    AE04  A8 6 04          STA   OUT ,C
    0036    1200  10 2 00          LDC   $+X'0000'
    0037    2E06  28 6 06          LDA   STXSY ,C
    0038    1208  10 2 08          LDC   $+X'0008'
    0039    AE01  A8 6 01          STA   OUT ,C
    003A    1225  10 2 25          LDC   $+X'0025'
    003B    2E04  28 6 04          LDA   INP ,C
    0011+B  0006
    003C    4411  40 4 11          ADD   =X'0006' ,B
    003D    AC10  A8 4 10          STA   M ,B
    003E    2C10  28 4 10          LDA   M ,B
    003F    4200  40 2 00          ADD   =X'FFFF'
    0040    AC12  A8 4 12          STA   #AIA,B
    0041    1208  10 2 08          LDC   $+X'0008'
    0042    2E05  28 6 05          LDA   ETXSY ,C
    0043    AD12  A8 5 12          STA   *#AIA,B
    0014+B  0001
    0044    2C14  28 4 14          LDA   =X'0001' ,B
    0045    AC13  A8 4 13          STA   K ,B
0074:       N=2*K+5
0075: S     LDA       *ADDR
    0046    2C13  28 4 13          LDA   K ,B
    0047    4005  40 0 05          ADD   X'0005'
    0016+B  0005
    0048    4416  40 4 16          ADD   =X'0005' ,B
    0049    AC15  A8 4 15          STA   N ,B
    004A    2D03  28 5 03          LDA   *ADDR,B
0076: S     AND       MASK2
    004B    5C02  58 4 02          AND   MASK2 ,B
0077: S     STA       HALF1
    004C    AC06  A8 4 06          STA   HALF1 ,B
0078: S     LDA       *ADDR
    004D    2D03  28 5 03          LDA   *ADDR,B
0079: S     AND       MASK1
    004E    5C01  58 4 01          AND   MASK1 ,B
0080: S     STA       HALF2
    004F    AC07  A8 4 07          STA   HALF2 ,B
0081:       HALF1=HALF1/256
0082: S     LDA       CCKS
```

—Continued

```
    0050     2C06  28 4 06          LDA   HALF1 ,B
    0017+B   4008
    0051     1C17  18 4 17          LDG  =X'4008' ,B
    0052     9805  98 0 05          SHF   X'0005'
    0053     AC06  A8 4 06          STA   HALF1 ,B
    0054     2C04  28 4 04          LDA   CCKS,B
0083: S      EOR     HALF1
    0055     5406  50 4 06          EOR   HALF1 ,B
0084: S      EOR     HALF2
    0056     5407  50 4 07          EOR   HALF2 ,B
0085: S      STA     CCKS
    0057     AC04  A8 4 04          STA   CCKS,B
0086:        OUT(N-1)=HALF1
0087:        OUT(N)=HALF2
    0058     2C15  28 4 15          LDA   N ,B
    0059     AC12  A8 4 12          STA   #AIA,B
    005A     42C0  40 2 00          ADD  =X'FFFE'
    005B     AC18  A8 4 18          STA   #AIB,B

                                     LPL
    005C     7200  70 2 00          JMP   $+X'0000'
    005D     0000                   DAT   X'0000'
    005E     0000                   DAT   X'0000'
    005F     0000                   DAT   X'0000'
    0060     0000                   DAT   X'0000'
    0061     FFFF                   DAT   X'FFFF'
    0062     FFFE                   DAT   X'FFFE'
    0063     2C06  28 4 06          LDA   HALF1 ,B
    0064     AD18  A8 5 18          STA  *#AIB,B
    0065     2C12  28 4 12          LDA   #AIA,B
    0066     42F8  40 2 F8          ADD  =X'FFFF'
    0067     AC19  A8 4 19          STA   #AIC,B
    0068     2C07  28 4 07          LDA   HALF2 ,B
    0069     AD19  A8 5 19          STA  *#AIC,B
0088:  150   ADDR=ADDR+1
0089: C
    006A     6403  60 4 03          INC   ADDR,B
    006B     6413  60 4 13          INC   K ,B
    006C     2C05  28 4 05          LDA   WDNO,B
    006D     4C13  48 4 13          SUB   K ,B
    006E     B2D7  B0 2 D7          PJP   $+X'FFD7'
0090:        OUT(M+1)=CCKS
0091:        MO=1
0092:        OCNT=INP(5)+7
0093:        OEND=.FALSE.
0094:        ACCFL=.TRUE.
0095: C
0096: C      INITIATE 'DAT'-TRANSMISSION WITH FIRST OUTPUT
0097: C
0098: S      LDA      DATSY
    006F     2C10  28 4 10          LDA   M ,B
0070     42EF  40 2 EF          ADD  =X'0000'
0071     AC12  A8 4 12          STA   #AIA,B
0072     2C04  28 4 04          LDA   CCKS,B
0073     AD12  A8 5 12          STA  *#AIA,B
0074     2C14  28 4 14          LDA  =X'0001' ,B
0075     12EA  10 2 EA          LDC   $+X'FFEA'
0076     AE2F  A8 6 2F          STA   MO,C
0077     12E6  10 2 E6          LDC   $+X'FFE6'
0078     2E04  28 6 04          LDA   INP ,C
001A+B   0007
0079     441A  40 4 1A          ADD  =X'0007' ,B
007A     12E5  10 2 E5          LDC   $+X'FFE5'
007B     AE30  A8 6 30          STA   OCNT,C
001B+B   0000
007C     2C1B  28 4 1B          LDA  =X'0000' ,B
007D     AE31  A8 6 31          STA   OEND,C
001C+B   FFFF
007E     2C1C  28 4 1C          LDA  =X'FFFF' ,B
007F     12DE  10 2 DE          LDC   $+X'FFDE'
```

– Continued

```
    0080    AE07  A8 6 07          STA   ACCFL ,C
    0081    12DF  10 2 DF          LDC   $+X'FFDF'
    0082    2E00  28 6 00          LDA   DATSY ,C
0099: S     IOA       16
    0083    8810  88 0 10          IOA   X'0010'
0100: C
0101:       GOTO 1000
0102: C
0103: C     PROCESS ERROR MESSAGES
0104: C
    0084    751D  70 5 1D          JMP  *)1000 ,B
0105:  500  CALL M:TD(2)
0106:       MO=1
0107:       OCNT=1
0108: C
0109:       GOTO (1000,510,610) ,INFL
    0085    EDE9  E8 5 E9          SST  *M:TD,B
    001E+B  0002
    0086    001E                   ADL  =X'0002'
    0087    2C14  28 4 14          LDA  =X'0001' ,B
    0088    12D7  10 2 D7          LDC   $+X'FFD7'
    0089    AE2F  A8 6 2F          STA   MO,C
    008A    AE30  A8 6 30          STA   OCNT,C
    008B    EFD3  E8 7 D3          SST  *GOT:,B
    008C    0004                   DAT   X'0004'
    008D    0000                   ADL   )1000
    008E    0000                   ADL   )510
    008F    0000                   ADL   )610
0110: C
0111: C     SEND ERROR MESSAGE
0112: C
0113: C
    0090    800A                   ADL   INFL
0114: 5510  LDA       NAKSY
    0091    12CF  10 2 CF   )510   LDC   $+X'FFCF'
    0092    2E03  28 6 03          LDA   NAKSY ,C
0115: S     IOA       16
    0093    8810  88 0 10          IOA   X'0010'
0116:       GOTO 1000
0117: C
    0094    751D  70 5 1D          JMP  *)1000 ,B
0118: S610  LDA       CSFSY
    0095    12CB  10 2 CB   )610   LDC   $+X'FFCB'
    0096    2E07  28 6 07          LDA   CSFSY ,C
0119: S     IOA       16
    0097    8810  88 0 10          IOA   X'0010'
0120: C
0121: C     ZERO INPUT FLAGS
0122: C
0123:  1000 ICNT=0
0124:       INFL=0
0125: C
    0098    12C5  10 2 C5          LDC   $+X'FFC5'
    0099    3E08  38 6 08          STZ   ICNT,C
    009A    3E09  38 6 09          STZ   INFL,C
0126:  1010 CALL EXIT
0127: C
    009B    EDE7  E8 5 E7          SST  *EXIT,B
0128:       GOTO 5
0129: C
    009C    751F  70 5 1F          JMP  *)5,B
0130:       END
    0000    00A3                   ADL   X'00A3'
            EXT EXIT
            EXT M:TD
            ARR INP   0000 IN INPB
            ARR OUT   0000 IN OUTPB
            VAR ADDR  0003 IN DP
            VAR CCKS  0004 IN DP
            VAR WDNO  0005 IN DP
            VAR HALF1   0006 IN DP
```

—Continued

```
        VAR HALF2    0007 IN DP
        VAR HALF3    0008 IN DP
        VAR DATSY    0000 IN SYMB
        VAR ETXSY    0005 IN SYMB
        VAR STXSY    0006 IN SYMB
        VAR CSFSY    0007 IN SYMB
        VAR NAKSY    0003 IN SYMB
        ARR COSY  0000 IN SYMB
        VAR MO  002F IN OUTPB
        VAR OCNT  0030 IN OUTPB
        ARR INLOG    0000 IN INPB
        ARR OULOG    0000 IN OUTPB
        VAR ACCFL    0007 IN INPB
        VAR OEND  0031 IN OUTPB
        VAR ENDFL    0006 IN INPB
        VAR ICNT  0008 IN INPB
        VAR INFL  0009 IN INPB
        VAR MASK1    0001 IN DP
        VAR MASK2    0002 IN DP
        EXT GOT:
        VAR H    0010 IN DP
        VAR #AIA  0012 IN DP
        VAR K    0013 IN DP
        VAR N    0015 IN DP
        VAR #AIB  0018 IN DP
        VAR #AIC  0019 IN DP
      PROGRAM SIZE: 0163    DATA POOL SIZE: 0032    ERROR COUNT:  0000

!JOB X7002,1 PASEMANN        DEH SW DATA LINK CONTROL WD TABLE
!P2KASM
        BIN
        ABS
        ORG       X'0EBA'
*
*               CONTROL WORDS FOR DATA-LINK FOR DAT AND SPT
*
        DAT       X'003A'          DAT
        DAT       X'003B'          SPT
        DAT       X'0006'          ACK
        DAT       X'0095'          NAK
        DAT       X'0005'          ENQ
        DAT       X'0003'          ETX
        DAT       X'0082'          STX
        DAT       X'0096'          CSF
        DAT       X'0097'          SAF
        DAT       X'0098'          SVF
*
        END

!EOJ
```

```
                                 0001      BIN
0EBA                             0002      ABS
                                 0003      ORG    X'0EBA'
                                 0004  *
                                 0005  *       CONTROL WORDS FOR DATA-LINK FOR DAT AND SPT
                                 0006  *
0EBA  003A    00 0 3A A          0007      DAT    X'003A'          DAT
0EBB  003B    00 0 3B A          0008      DAT    X'003B'          SPT
0EBC  0006    00 0 06 A          0009      DAT    X'0006'          ACK
0EBD  0095    00 0 95 A          0010      DAT    X'0095'          NAK
0EBE  0005    00 0 05 A          0011      DAT    X'0005'          ENQ
0EBF  0003    00 0 03 A          0012      DAT    X'0003'          ETX
0EC0  0082    00 0 82 A          0013      DAT    X'0082'          STX
0EC1  0096    00 0 96 A          0014      DAT    X'0096'          CSF
0EC2  0097    00 0 97 A          0015      DAT    X'0097'          SAF
0EC3  0098    00 0 98 A          0016      DAT    X'0098'          SVF
      0000    00 0 00 A          0017  *
                                 0018      END
0000  ERRORS
```

What is claimed is:

1. A system for operating a steam turbine in an electric power plant, said system comprising an arrangement of throttle and governor valves for supplying steam to the turbine, means for actuating said valves to position said valves in accordance with valve position signals, means for generating signals representative of the turbine speed and the turbine load, a first digital controller having means for generating a speed setpoint and means for generating a load setpoint, said first controller including a speed control for generating valve position signals in response to the turbine speed signal and speed setpoint during turbine startup, said first controller further including a load control for generating valve position signals in response to the turbine load signal and load setpoint during turbine load operation, means for generating signals representative of additional turbine parameters and for coupling the additional signals to said first controller, means for registering the additional signals in said first controller, a second digital controller, means for linking at least digital data signals between said controllers, said data link means including respective first and second means for transmitting data word signals from said first and second controllers, respective first and second means for receiving data word signals in said first and second controllers, said second transmitting means including means for generating setpoint data control and data change word signals for transmittal to said first controller in one of the data link modes to modify at least one of the setpoints operative in said first controller, each of said transmitting means including means for generating a check signal related in a predetermined way to a predetermined group of transmitted digital data signals and each of said receiving means including means for generating a second check representation related in the same way to the group of transmitted data signals as received, and means for comparing the received check signal and the check representation and for generating an indication of a discrepancy between the two.

2. A steam turbine operating system as set forth in claim 1 wherein the check signal is a sum of the transmitted digital data signals.

3. A steam turbine operating system as set forth in claim 1 wherein each of said controllers includes a digital computer system.

4. A steam turbine operating system as set forth in claim 1 wherein the generated indication of a discrepancy includes a control word signal transmitted back to the original transmitting means to indicate a data link error.

* * * * *